US009524726B2

(12) United States Patent
Bayer et al.

(10) Patent No.: US 9,524,726 B2
(45) Date of Patent: Dec. 20, 2016

(54) AUDIO SIGNAL DECODER, AUDIO SIGNAL ENCODER, METHOD FOR DECODING AN AUDIO SIGNAL, METHOD FOR ENCODING AN AUDIO SIGNAL AND COMPUTER PROGRAM USING A PITCH-DEPENDENT ADAPTATION OF A CODING CONTEXT

(75) Inventors: Stefan Bayer, Nuremberg (DE); Tom Baeckstroem, Nuremberg (DE); Ralf Geiger, Erlangen (DE); Bernd Edler, Fürth (DE); Sascha Disch, Fuerth (DE); Lars Villemoes, Jaerfaella (SE)

(73) Assignees: Fraunhofer-Gesellschaft zur Foerderung der angewandten Forschung e.V., Munich (DE); Dolby International AB, Amsterdam-Zuidoost (NL)

( * ) Notice: Subject to any disclaimer, the term of this patent is extended or adjusted under 35 U.S.C. 154(b) by 889 days.

(21) Appl. No.: 13/608,980

(22) Filed: Sep. 10, 2012

(65) Prior Publication Data

US 2013/0117015 A1 May 9, 2013

Related U.S. Application Data

(63) Continuation of application No. PCT/EP2011/053541, filed on Mar. 9, 2011.
(Continued)

(51) Int. Cl.
*G10L 19/14* (2006.01)
*G10L 19/022* (2013.01)
(Continued)

(52) U.S. Cl.
CPC ..... *G10L 19/022* (2013.01); *G10L 19/0212* (2013.01); *G10L 25/90* (2013.01)

(58) Field of Classification Search
CPC ... G10L 19/0212; G10L 19/002; G10L 18/022
(Continued)

(56) References Cited

U.S. PATENT DOCUMENTS 6,581,032 B1 6/2003 Gao et al.
7,272,556 B1 * 9/2007 Aguilar et al. ..... 704/230
(Continued)

FOREIGN PATENT DOCUMENTS

CN 101325060 12/2008
EP 2059925 A2 5/2009
(Continued)

OTHER PUBLICATIONS

Neuendorf, M et al., "A Novel Scheme for Low Bitrate Unified Speech and Audio Coding", Presented at the 126th AES Convention. München, Germany., May 2009, pp. 1-13.
(Continued)

*Primary Examiner* — Jakieda Jackson
(74) *Attorney, Agent, or Firm* — Michael A. Glenn; Perkins Coie LLP

(57) ABSTRACT

An audio signal decoder includes a context-based spectral value decoder configured to decode a codeword describing one or more spectral values or at least a portion of a number representation thereof in dependence on a context state. The audio signal decoder also includes a context state determinator configured to determine a current context state in dependence on one or more previously decoded spectral values and a time warping frequency-domain-to-time-domain converter configured to provide a time-warped time-domain representation of a given audio frame on the basis of a set of decoded spectral values provided by the context-based spectral value decoder and in dependence on the time warp information. The context-state determinator is configured to adapt the determination of the context state to a
(Continued)

change of a fundamental frequency between subsequent audio frames. An audio signal encoder applies a comparable concept.

20 Claims, 43 Drawing Sheets

Related U.S. Application Data

(60) Provisional application No. 61/312,503, filed on Mar. 10, 2010.

(51) Int. Cl.
*G10L 19/02* (2013.01)
*G10L 25/90* (2013.01)

(58) Field of Classification Search
USPC ..... 704/205, 207, 211
See application file for complete search history.

(56) References Cited

U.S. PATENT DOCUMENTS

| | | | | |
|---|---|---|---|---|
| 7,680,651 | B2 | 3/2010 | Tammi et al. | |
| 8,078,474 | B2 | 12/2011 | Vos et al. | |
| 8,121,833 | B2 | 2/2012 | Tammi et al. | |
| 2004/0098255 | A1 | 5/2004 | Kovesi et al. | |
| 2004/0156397 | A1 | 8/2004 | Lakaniemi et al. | |
| 2005/0071153 | A1 | 3/2005 | Tammi et al. | |
| 2007/0100607 | A1 | 5/2007 | Villemoes | |
| 2008/0046252 | A1 | 2/2008 | Zopf et al. | |
| 2008/0312914 | A1 | 12/2008 | Rajendran et al. | |
| 2009/0012797 | A1 | 1/2009 | Boehm et al. | |
| 2009/0063139 | A1 | 3/2009 | Tammi et al. | |
| 2011/0178795 | A1 | 7/2011 | Bayer et al. | |
| 2011/0295598 | A1* | 12/2011 | Yang et al. | 704/205 |

FOREIGN PATENT DOCUMENTS

| | | | |
|---|---|---|---|
| JP | 2000209099 | A | 7/2000 |
| JP | 2004309893 | A | 11/2004 |
| JP | 2009515207 | A | 4/2009 |
| JP | 2011-527458 | | 10/2011 |
| RU | 2302665 | C2 | 7/2007 |
| RU | 2376657 | C2 | 12/2009 |
| WO | WO-2007051548 | | 5/2007 |
| WO | WO2008/157296 | | 12/2008 |
| WO | WO2009/121499 | | 10/2009 |
| WO | WO2010/003479 | | 1/2010 |
| WO | WO-2010003581 | | 1/2010 |
| WO | WO-2010003582 | | 1/2010 |
| WO | WO-2010003583 | | 1/2010 |
| WO | WO-2010003618 | | 1/2010 |

OTHER PUBLICATIONS

"WD6 of USAC", International Organisation for Standardisation Organisation Internationale De Normalisation ISO/IEC JTC1/SC29/WG11 Coding of Moving Pictures and Audio. Kyoto, Japan., Jan. 2010, 1-237.

Edler, B et al., "Time Warped MDCT", Provisional application for patent by Fraunhofer Gesellschaft. Version 3.0,, Mar. 28, 2008, 1-6.

Meine, N. et al, "Improved Quantization and Lossless Coding for Subband Audio Coding", Presented at the 118th AES Convention. Barcelona, Spain., May 2005, 9 Pages.

Meine, N. et al., "Vektorquantisierung and kontextabhangige arithmetische Codierung fur MPEG-4 AAC", VDI. Hannover., 2007, 121 Pages.

Dunn, R et al., "Sinewave Analysis/Synthesis Based on the Fan-Chirp Transform", 2007 IEEE Workshop on Applications of Signal Processing to Audio and Asoustics, 2007, 247-250.

Edler, B et al., "A Time-Warped MDCT Approach to Speech Transform Coding", Presented at the 126th AES Convention. Munich, Germany. Convention Paper 7710. XP40508992, May 7, 2009, 1-8.

Kepesi, M et al., "Adaptive Chirp-based Time-Frequency Analysis of Speech Signals", Speech Communication 48. www.elsevier.com/locate/specom, 2006, 474-492.

Huang, Zhenhua et al., "Speaker Normalization Using Dynamic Frequency Warping", The IEEE International Conference on Audio, Language and Image Processing, Jul. 2008 (ICALIP 2008), Jul. 7, 2008, pp. 1091-1995.

Silsbee, Peter L. et al., "A warped time-frequency expansion for speech signal representation", Time-Frequency and Time-Scale Analysis, Department of Electrical and Computer Engineering, Norfolk, VA, IEEE1994, 636-639.

* cited by examiner

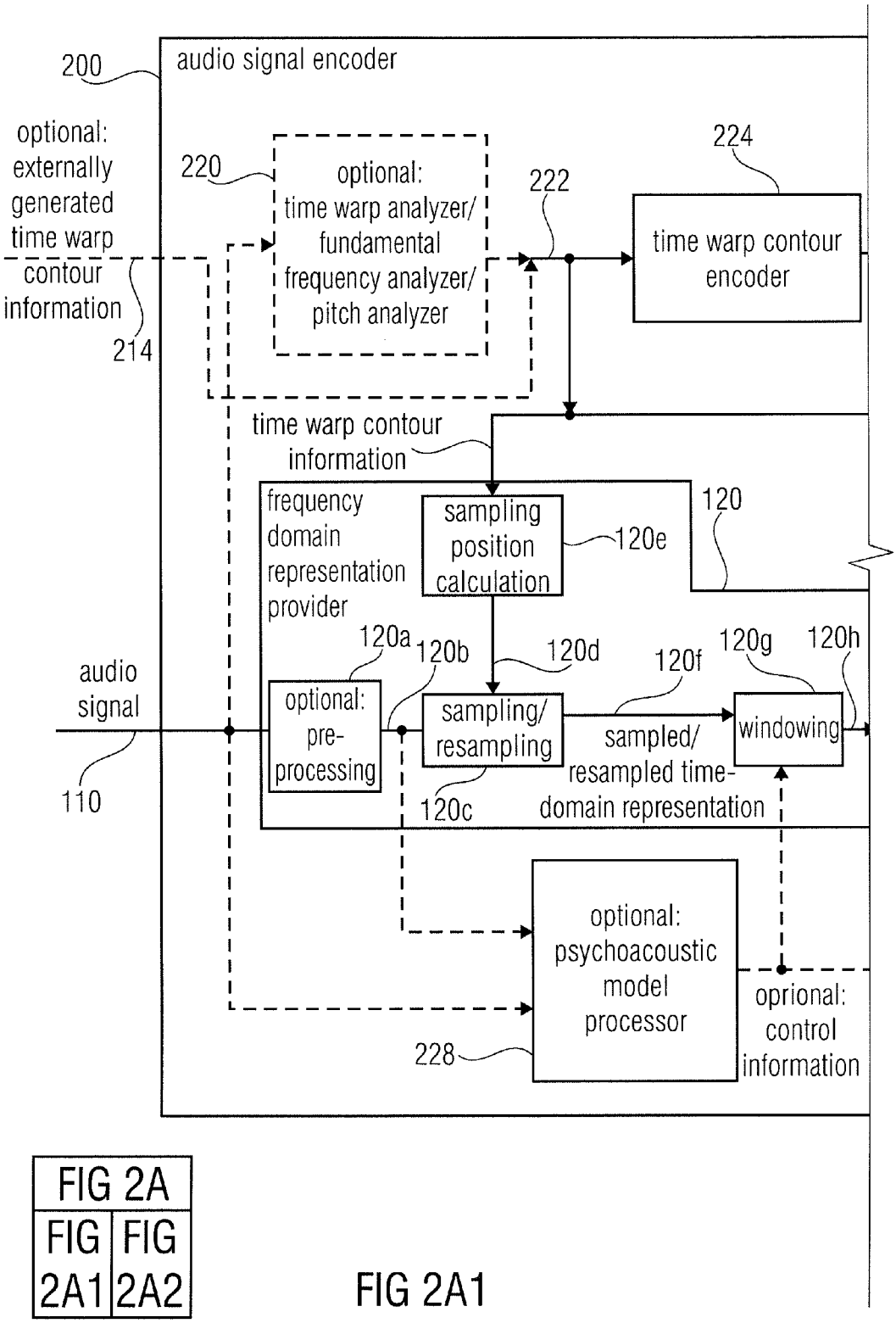
| FIG 2A | |
|---|---|
| FIG 2A1 | FIG 2A2 |
FIG 2A1

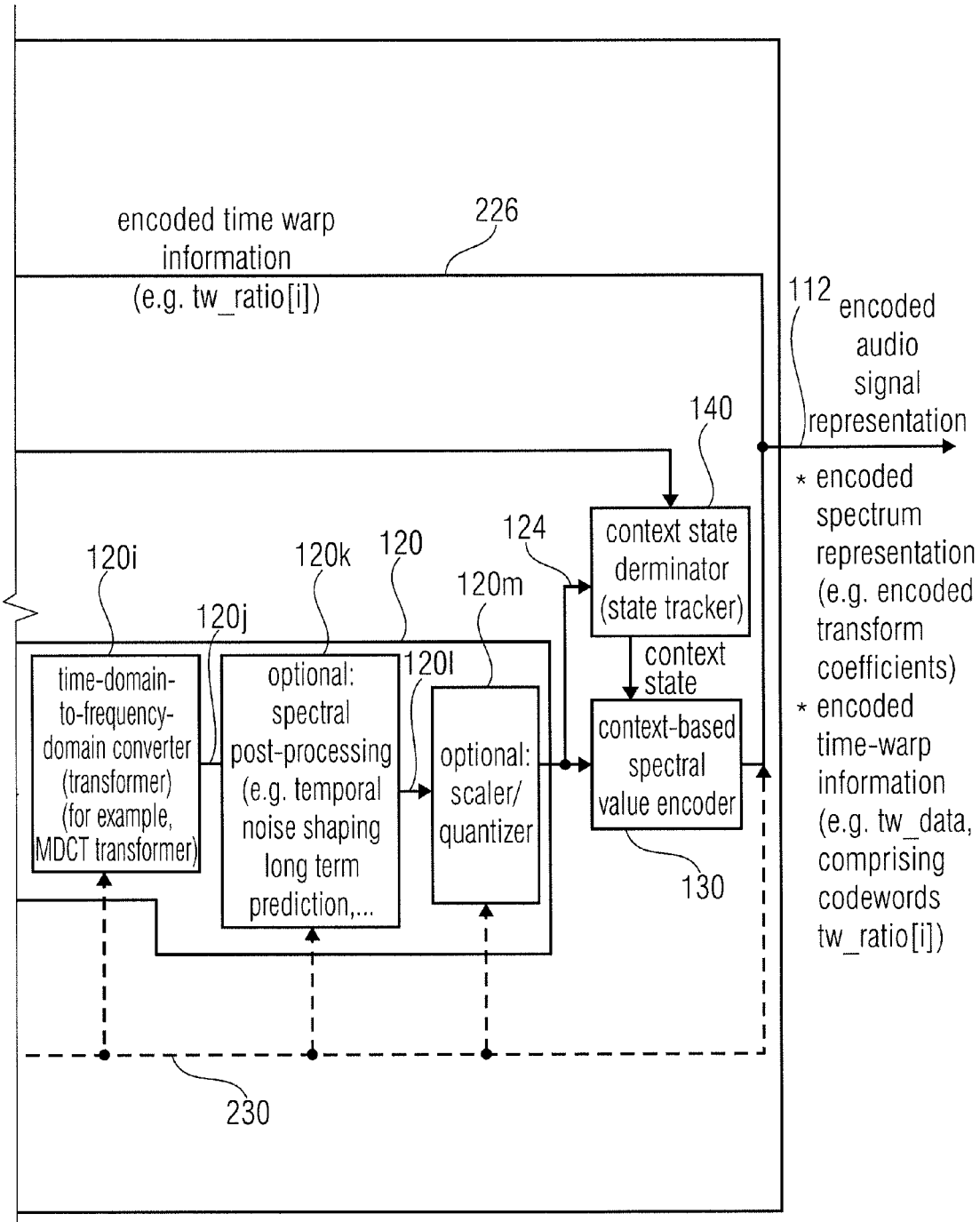
| FIG 2A | |
|---|---|
| FIG 2A1 | FIG 2A2 |
FIG 2A2

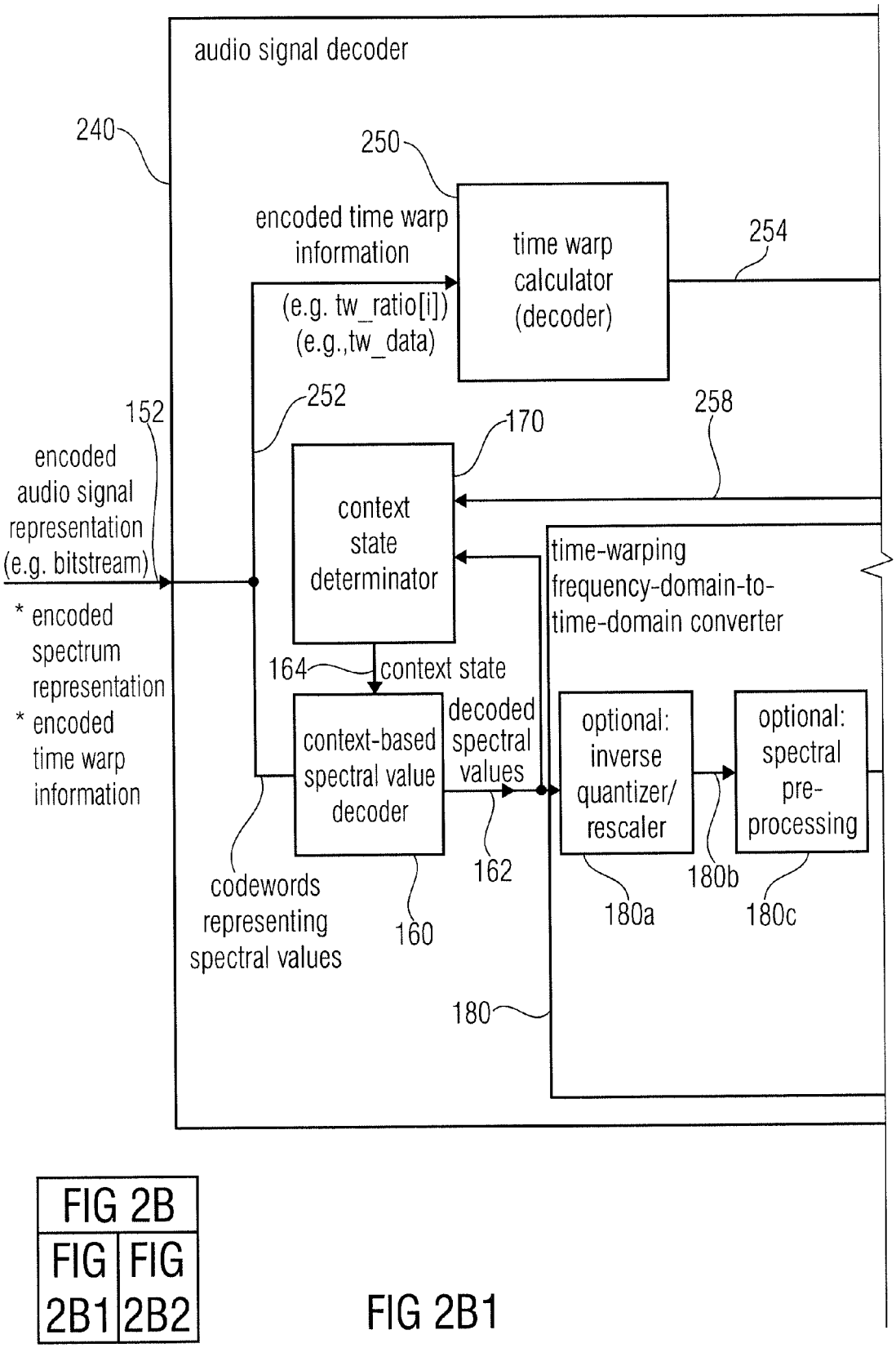
| FIG 2B | |
|---|---|
| FIG 2B1 | FIG 2B2 |
FIG 2B1

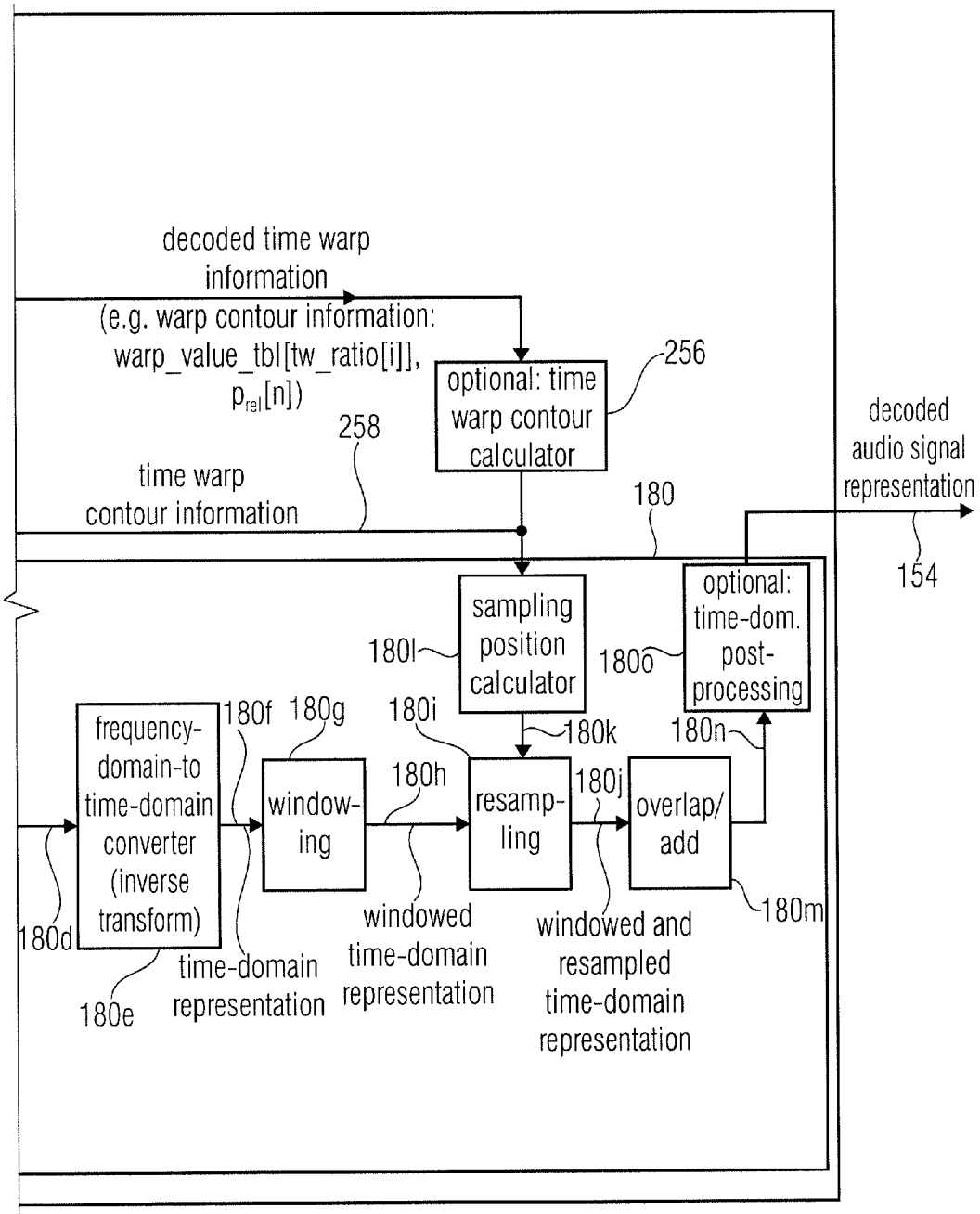
| FIG 2B | |
|---|---|
| FIG 2B1 | FIG 2B2 |
FIG 2B2

CONTEXT ADAPTIVE ARITHMETIC CODING

RELATIVE PITCH CONTOUR

460

```
{
460a  int nLinTupleIdx = 0;     /* target tuple index variable */
      int nWarpTupleIdx = 0;  /* source tuple index variable */
      int nTuples = 1024/4;
      int firstIdx = 1;
      Tqi4 qReorderBuf[(1152/4)+2][4];     /* Recorder buffer */
460b  memcpy(qReorderBuf,   self->base.m_qbuf,   sizeof(qReorderBuf));
460c  while (nLinTupleIdx < nTuples && nWarpTupleIdx < nTuples ) {
          /* "warp" context */
460ca     self->base.m_qbuf[nLinTupleIdx+firstIdx][0] = qReorderBuf[nWarpTupleIdx+firstIdx][0];
          self->base.m_qbuf[nLinTupleIdx+firstIdx][1] = qReorderBuf[nWarpTupleIdx+firstIdx][1];
          self->base.m_qbuf[nLinTupleIdx+firstIdx][2] = qReorderBuf[nWarpTupleIdx+firstIdx][2];
          self->base.m_qbuf[nLinTupleIdx+firstIdx][3] = qReorderBuf[nWarpTupleIdx+firstIdx][3];

          /* advance indices */
460cb     nLinTupleIdx++;
460cc     nWarpTupleIdx = (int) ((float)nLinTupleIdx * self-
      >base.m_ContextUpdateRatio); /* round to nearest index */
      }
      /* note: the last two contexts are kept as is */
}
```

FIG 4C

470'

```
{
    int linLineIdx = 0;     /* target line index variable */
    int warpLineIdx = 0;     /* source line index variable */
    int lineReorderBuf[1152];
    int lineTmpBuf[1152];
    int curTuple;
    int contextIdx;
    int activeLines, activeTuples;

    activeLines = BandOffsets[self->base.m_IcsInfo-
>m_ScaleFactorBandsTransmitted];
    activeTuples = (activeLines+3)/4;
    activeLines = activeTuples*4;

    for ( contextIdx = 2 ; contextIdx <= 3 ; contextIdx++ ) {
        memset(lineTmpBuf, 0,1152*sizeof(int));
        memset(lineReorderBuf, 0,1152*sizeof(int));
        for ( curTuple = 1 ; curTuple < (1152/4 + 1) ; curTuple++ ) {
            lineReorderBuf[(curTuple-1)*4 + 0] = self-
>base.m_qbuf[curTuple][contextIdx].a;
            lineReorderBuf[(curTuple-1)*4 + 1] = self-
>base.m_qbuf[curTuple][contextIdx].b;
        lineReorderBuf[(curTuple-1)*4 + 2] = self-
>base.m_qbuf[curTuple][contextIdx].c;
            lineReorderBuf[(curTuple-1)*4 + 3] = self-
>base.m_qbuf[curTuple][contextIdx].d;
        }
    copyINT(lineReorderBuf,lineTmpBuf,1152);
    linLineIdx = warpLineIdx = 0;
    while ( linLineIdx < activeLines && warpLineIdx < activeLines ) {
        lineTmpBuf[linLineIdx] = lineReorderBuf[warpLineIdx];
        linLineIdx++;
        warpLineIdx = (int) ((float) linLineIdx * self-
>base.m_ContextUpdateRatio);
    }
```

470a 470b 470c 470d 470e 470f 470g

FIG 4D

470

470h

```
/* calc new tuples */
for ( curTuple = 1 ; curTuple <= activeTuples ; curTuple++ ) {
    self->base.m_qbuf[curTuple][contextIdx].a =
lineTmpBuf[(curTuple-1)*4 + 0];
    self->base.m_qbuf[curTuple][contextIdx].b =
lineTmpBuf[(curTuple-1)*4 + 1];
    self->base.m_qbuf[curTuple][contextIdx].c =
lineTmpBuf[(curTuple-1)*4 + 2];
    self->base.m_qbuf[curTuple][contextIdx].d = l
ineTmpBuf[(curTuple-1)*4 + 3];
    self->base.m_qbuf[curTuple][contextIdx].e = energy4(self-
>base.m_qbuf[curTuple][contextIdx].a,
                                                        self-
>base.m_qbuf[curTuple][contextIdx].b,
                                                        self-
>base.m_qbuf[curTuple][contextIdx].c,
                                                        self-
>base.m_qbuf[curTuple][contextIdx].d);
    if ( (self->base.m_qbuf[curTuple][contextIdx].a>=-4) && (self-
>base.m_qbuf[curTuple][contextIdx].a<4) &&
        (self->base.m_qbuf[curTuple][contextIdx].b>=-4) && (self-
>base.m_qbuf[curTuple][contextIdx].b<4) &&
        (self->base.m_qbuf[curTuple][contextIdx].c>=-4) && (self-
>base.m_qbuf[curTuple][contextIdx].c<4) &&
        (self->base.m_qbuf[curTuple][contextIdx].d>=-4) && (self-
>base.m_qbuf[curTuple][contextIdx].d<4) ){
    self->base.m_qbuf[curTuple][contextIdx].v = egroups[4+self-
>base.m_qbuf[curTuple][contextIdx].a][4+self-
>base.m_qbuf[curTuple][contextIdx].b][4+self-
>base.m_qbuf[curTuple][contextIdx].c][4+self-
>base.m_qbuf[curTuple][contextIdx].d]>>16;
    }
  }
 }
}
}
```

FIG 4E

| FIG 5A | FIG 5 |
|---|---|
| FIG 5B | |

| FIG 5A | FIG 5 |
|---|---|
| FIG 5B | |

| FIG 6A | FIG |
|---|---|
| FIG 6B | 6 |

| FIG 6A | FIG 6 |
|---|---|
| FIG 6B | |

Definitions

Data elements

| | |
|---|---|
| tw_data() | contains the side information necessary to decode and apply the time warped MDCT on an fd_channel_stream() for SCE and CPE elements. The fd_channel_streams of a channel_pair_element() may share one common tw_data(). |
| **tw_data_present** | 1 bit indicating that a non-flat warp contour is transmitted in this frame |
| **tw_ratio[]** | codebook index of the warp ratio for node i. |
| **window_sequence** | 2 bit indicating which window sequence (i.e. block size) is used |
| **window shape** | 1 bit indicating which window function is selected |

Help elements

| | |
|---|---|
| warp_node_values[] | decoded warp contour node values |
| warp_value_tbl[] | quantization table for the warp node ratio values, please see FIG 8 |
| new_warp_contour[] | decoded and interpolated warp contour for this frame (n_long samples) |
| past_warp_contour[] | past warp contour (2*n_long samples) |
| norm_fac | normalization factor for the past *warp*_contour |
| warp_contour[] | complete warp contour (3*n_long samples) |
| last_warp_sum | sum of first part of the warp contour |
| cur_warp_sum | sum of the middle part of the warp contour |
| next_warp_sum | sum of the last part of the warp contour |
| time_contour[] | complete time contour (3*n_long+1_samples) |
| sample_pos[] | positions of the warped samples on a linear time scale (2*n_long samples + 2*IP_LEN_2S) |

| | |
|---|---|
| FIG 7A1 | FIG 7A |
| FIG 7A2 | |

FIG 7A1

| | |
|---|---|
| X[w][] | output of the IMDCT for window w |
| z[] | windowed and (optionally) internally overlapped time vector for one frame in the time warped domain |
| zp[] | z[] with zero padding |
| y[] | time vector for one frame in the linear time domain after resampling |
| $y'_{i,n}$ | time vector for frame i after postprocessing |
| out[] | output vector for one frame |
| b[] | impulse response of the resampling filter |
| N | synthesis window length |
| N_f | frame length, N_f = 2**coreCoderFrameLength* |
| next_window_sequence | following window sequence |
| prev_window_sequence | previous window sequence |

FIG 7A2

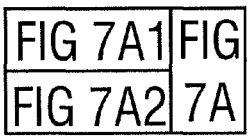

Constants

| | |
|---|---|
| NUM_TW_NODES | 16 |
| OS_FACTOR_WIN | 16 |
| OS_FACTOR_RESAMP | 128 |
| IP_LEN_2S | 12 |
| IP_LEN_2 | OS_FACTOR_RESAMP*IP_LEN_2S+1 |
| IP_SIZE | IP_LEN_2+OS_FACTOR_RESAMP |
| n_long | *coreCoderFrameLength* |
| n_short | *coreCoderFrameLength/8* |
| interp_dist | n_long/NUM_TW_NODES |
| NOTIME | -100000 |

FIG 7B table: warp_value_tbl

| index | value |
|---|---|
| 0 | 0.982857168 |
| 1 | 0.988571405 |
| 2 | 0.994285703 |
| 3 | 1 |
| 4 | 1.0057143 |
| 5 | 1.01142859 |
| 6 | 1.01714289 |
| 7 | 1.02285719 |

FIG 8

```
for ( i = 0 ; i < NUM_TW_NODES ; i++ ) {
    d = (warp_node_values[i+1]  warp_node_values[i] ) / interp_dist;
    for ( j = 0 ; j < interp_dist; j++ ) {
        new_warp_contour[i*interp_dist + j] = warp_node_values[i-1] + (j+1)*d;
    }
}
```

FIG 9

```
warp_time_inv(time_contour[],t_warp) {
    i = 0;
    if ( t_warp < time_contour[0] ) {
        return NOTIME;
    }
    while ( t_warp > time_contour[i+1] ) {
        i++;
    }
    return (i + (t_warp  time_contour[i])/(time_contour[i+1]-time_contour[i]));
}
```

FIG 10A

```
warp_inv_vec(time_contour[],t_start,n_samples,sample_pos[]) {
    t_warp = t_start;
    j = 0;
    while (( i = floor(warp_time_inv(time_contour,t_warp-0.5))) == NOTIME) {
        t_warp += 1;
        j++;
    }
    while ( j < n_samples && (t_warp + 0.5) < time_contour[3*n_long] ) {
        while ( t_warp > time_contour[i+1]) {
            i++;
        }
        sample_pos[j] =
            i + (t_warp  time_contour[i])/(time_contour[i+1]-time_contour[i]);
        j++;
        t_warp += 1;
    }
}
```

FIG 10B

```
t_start=n_long-3*N_f/4 - IP_LEN_2S + 0.5

warp_inv_vec(time_contour,
        t_start,
        N_f + 2*IP_LEN_2S,
        sample_pos[]);

if ( last_warp_sum > cur_warp_sum ) {
    warped_trans_len_left = n_long/2;
}
else {
    warped_trans_len_left = n_long/2*last_warp_sum/cur_warp_sum;
}

if (new_warpSum > cur_warp_sum ) {
    warped_trans_len_right = n_long/2;
}
else {
    warped_trans_len_right = n_long/2*new_warp_sum/cur_warp_sum;
}

switch ( window_sequence ) {
    case LONG_START_SEQUENCE:
        if ( next_window_sequence == LPD_SEQUENCE ) {
            warped_trans_len_right /= 4;
        }
        else {
            warped_trans_len_right /= 8;
        }
        break;
    case LONG_STOP_SEQUENCE:
        if ( prev_window_sequence == LPD_SEQUENCE ) {
            warped_trans_len_left /= 4;
        }
        else {
            warped_trans_len_left /= 8;
        }
        break;
```

FIG 11A

| FIG 11A | FIG |
|---|---|
| FIG 11B | 11 |

```
    case EIGHT_SHORT_SEQUENCE:
        warped_trans_len_right /= 8;
        warped_trans_len_left /= 8;
        break;
    case STOP_START_SEQUENCE:
        if ( prev_window_sequence == LPD_SEQUENCE ) {
            warped_trans_len_left /= 4;
        }
        else {
            warped_trans_len_left /= 8;
        }
        if ( next_window_sequence == LPD_SEQUENCE ) {
            warped_trans_len_right /= 4;
        }
        else {
            warped_trans_len_right /= 8;
        }
        break;
}
first_pos = ceil(N_f/4-0.5-warped_trans_len_left);
last_pos = floor(3*N_f/4-0.5+warped_trans_len_right);
```

FIG 11B

| FIG 11A | FIG |
|---|---|
| FIG 11B | 11 |

value of synthesis window length N depending on window_sequence and coreCoderframeLength

| window_sequence | coreCoderFrameLength ==768 | coreCoderFrameLength ==1024 |
|---|---|---|
| ONLY_LONG_SEQUENCE<br>LONG_START_SEQUENCE<br>LONG_STOP_SEQUENCE<br>STOP_START_SEQUENCE | 1536 | 2048 |
| EIGHT_SHORT-SEQUENCE | 192 | 256 |

FIG 12 allowed window sequences

| window sequence<br>from↓ to→ | ONLY_LONG_SEQUENCE | LONG_START_SEQUENCE | EIGHT_SHORT_SEQUENCE | LONG_STOP_SEQUENCE | STOP_START_SEQUENCE | LPD_SEQUENCE |
|---|---|---|---|---|---|---|
| ONLY_LONG_SEQUENCE | ☑ | ☑ | | | | |
| LONG_START_SEQUENCE | | | ☑ | ☑ | ☑ | ☑ |
| EIGHT_SHORT_SEQUENCE | | | ☑ | ☑ | ☑ | ☑ |
| LONG_STOP_SEQUENCE | ☑ | ☑ | | | | |
| STOP_START_SEQUENCE | | | ☑ | ☑ | ☑ | ☑ |
| LPD_SEQUENCE | | | ☑ | ☑ | ☑ | ☑ |

FIG 13

```
tw_windowing_short(X[][],z[],first_pos,last_pos,warpe_trans_len_left,warped_trans_len_righ
t,left_window_shape[],right_window_shape[]) {

    offset = n_long – 4*n_short – n_short/2;

    tr_scale_1 = 0.5*n_long/warped_trans_len_left*OS_FACTOR_WIN;
    tr_pos_l = warped_trans_len_left+(first_pos-n_long/2)+0.5)*tr_scale_l;
    tr_scale_r = 8*OS_FACTOR_WIN;
    tr_pos_r = tr_scale_r/2;

    for ( i = 0 ; i < n_short ; i++ ) {
        z[i] = X[0][i];
    }

    for (i=0;i<first_pos;i++)
        z[i] = 0.;

    for (i=n_long-1-first_pos;i>=first_pos;i--) {
        z[i] *= left_window_shape[floor(tr_pos_l)];
        tr_pos_l += tr_scale_l;
    }

    for (i=0;i<n_short;i++) {
        z[offset+i+n_short]=
            X[0][i+n_short]*right_window_shape[floor(tr_pos_r)];
        tr_pos_r += tr_scale_r;
    }

    offset += n_short;
```

FIG 14A

| FIG 14A | FIG |
|---|---|
| FIG 14B | 14 |

```
for ( k = 1 ; k < 7 ; k++ ) {
    tr_scale_l = n_short*OS_FACTOR_WIN;
    tr_pos_l = tr_scale_l/2;
    tr_pos_r = OS_FACTOR_WIN*n_long-tr_pos_l;
    for ( i = 0 ; i < n_short ; i++ ) {
        z[i + offset] += X[k][i]*right_window_shape[floor(tr_pos_r)];
        z[offset + n_short + i] =
            X[k][n_short + i]*right_window_shape[floor(tr_pos_l)];
        tr_pos_l += tr_scale_l;
        tr_pos_r -= tr_scale_l;
    }
    offset += n_short;
}

tr_scale_l = n_short*OS_FACTOR_WIN;
tr_pos_l = tr_scale_l/2;

for ( i = n_short - 1 ; i >= 0 ; i-- ) {
    z[i + offset] += X[7][i]*right_window_shape[(int) floor(tr_pos_l)];
    tr_pos_l += tr_scale_l;
}

    for ( i = 0 ; i < n_short ; i++ ) {
    z[offset + n_short + i] = X[7][n_short + i];
}

tr_scale_r = 0.5*n_long/warpedTransLenRight*OS_FACTOR_WIN;
tr_pos_r = 0.5*tr_scale_r+.5;

tr_pos_r = (1.5*n_long-(float)wEnd-0.5+warpedTransLenRight)*tr_scale_r;
for (i=3*n_long-1-last_pos ;i<=wEnd;i++) {
    z[i] *= right_window_shape[floor(tr_pos_r)];
    tr_pos_r += tr_scale_r;
}

for (i=lsat_pos+1;i<2*n_long;i++)
    z[i] = 0.;
```

FIG 14B

| FIG 14A | FIG |
|---|---|
| FIG 14B | 14 |

```
tw_windowing_long(X[][],z[],first_pos,last_pos,warpe_trans_len_left,warped_trans_len_right
,left_window_shape[],right_window_shape[]) {

   for (i=0;i<first_pos;i++)
      z[i] = 0.;
   for (i=last_pos+1;i<N_f;i++)
      z[i] = 0.;

   tr_scale = 0.5*n_long/warped_trans_len_left*OS_FACTOR_WIN;
   tr_pos = (warped_trans_len_left+first_pos-N_f/4)+0.5)*tr_scale;

   for (i=N_f/2-1-first_pos;i>=first_pos;i--) {
      z[i] = X[0][i]*left_window_shape[floor(tr_pos)]);
      tr_pos += tr_scale;
   }

   tr_scale = 0.5*n_long/warped_trans_len_right*OS_FACTOR_WIN;
   tr_pos = (3*N_f/4-last_pos-0.5+warped_trans_len_right)*tr_scale;

   for (i=3*N_f/2-1-last_pos;i<=last_pos;i++) {
      z[i] = X[0][i]*right_window_shape[floor(tr_pos)]);
      tr_pos += tr_scale;
   }
}
```

FIG 15

```
offset_pos=0.5;

num_samples_in = N_f+2*IP_LEN_2S;
num_samples_out = 3*n_long;
j_center = 0;
for (i=0;i<numSamplesOut;i++) {
   while (j_center<num_samples_in && sample_pos[j_center]-offset_pos<=i)
      j_center++;
   j_center--;
   y[i] = 0;
   if (j_center<num_samples_in-1 && j_center>0) {
      frac_time = floor((i-(sample_pos[j_center]-offset_pos))
            /(sample_pos[j_center+1]-sample_pos[j_center])
            *os_factor);
      j = IP_LEN_2S*os_factor+frac_time;

      for (k=j_center-IP_LEN_2S;k<=j_center+IP_LEN_2S;k++) {
         if (k>=0 && k<num_samples_in)
            y[i] += b[abs(j)]*zp[k];
         j -= os_factor;
      }

   }
   if (j_center<0)
      j_center++;
}
```

FIG 16

CONTEXT FOR THE STATE CALCULATION

Definitions

| | |
|---|---|
| a,b | 2-tuple to decode |
| m | The most significant 2-bits wise plane of the quantized spectral coefficient to decode. |
| r | The least significant bit planes of the quantized spectral coefficient to decode. |
| lev | Level of the remaining bit-planes. It corresponds to the number of less significant bit planes. |
| arith_hash_m[] | Hash table mapping context states to a cumulative frequencies table index pki. |
| arith_lookup_m[] | Look-up table mapping group of context states to a cumulative frequencies table index pki. |
| arith_cf_m[pki][17] | Models of the cumulative frequencies for the most significant 2-bits wise plane m and the ARITH_ESCAPE symbol. |
| arith_cf_r [lsbidx][4] | Models of the cumulative frequencies for the least significant bit-planes symbol r. |
| q[2][] | 2-tuple context elements of the previous and current frame. |
| x_ac_dec[] | Array which holds the decoded quantized spectral coefficients. |
| arith_reset_flag | Flag which indicates if the spectral noiseless context must be reset. |
| ARITH_STOP | Stop symbol consisting of the succession of ARITH_ESCAPE symbol and m=0. When it occurs, the rest of the frame is decoded with zero values. |
| N | Window length. For FD mode it is deduced from the window_sequence (see 7.9.3.1) and for TCX N=2*lg. |
| previous_N | Length of the previous window. |

FIG 18

```
/*Input variables*/
N    /* Length of the current window */
arith_reset_flag/* Arithmetic coder reset flag */

/*Global variables*/
previous_N    /* Length of the previous window */

c = arith_map_context(N,arith_reset_flag)
{
    if (arith_reset_flag) {
        for (j=0; j<N/4; j++) {
            q[0][j]=0;
        }
    } else {
        ratio = ((float)previous_N) / ((float) N);
        for (j=0; j<N/4; j++) {
            k = (int) ((float) j * ratio);
            q[0][j] = q[1][k];
        }
    }

    previous_N=N;

    return(q[0][0]<<12);
}
```

FIG 19

```
/*Input variables*/
c     /* old state context */
i     /* Index of the 2-tuple to decode in the vector */
N     /* Window Length */

/*Output value*/
c     /*updated state context*/

c = arith_get_context(c,i,N) {
    c = c>>4;
    if (i<N/4-1)
        c = c + (q[0][i+1]<<12);
    c = (c&0xFFF0);
    if (i>0)
        c = c + (q[1][i-1]);

    if (i > 3) {
        if ((q[1][i-3] + q[1][i-2] + q[1][i-1]) < 5)
            return(c+0x10000);
    }

    return (c);
}
```

FIG 20

```
/*Input variable*/
c    /*State of the context*/

/*Output value*/
pki/*Index of the probability model */

pki = arith_get_pk(c) {
    i_min = -1;
    i = i_min;
    i_max = (sizeof(ari_lookup_m)/sizeof(ari_lookup_m[0]))-1;
    while ((i_max-i_min)>1) {
        i = i_min+((i_max-i_min)/2);
        j = ari_hash_m[i];
        if (c<(j>>8))

            i_max = i;
        else if (c>(j>>8))
            i_min=i;
        else
            return(j&0xFF);
    }

    return ari_lookup_m[i_max];
}
```

FIG 21

```
/*helper functions*/
bool arith_first_symbol(void);
    /* Return TRUE if it is the first symbol of the sequence,
        FALSE otherwise */
Ushort arith_get_next_bit(void);
    /* Get the next bit of the bitstream */

/* global variables */
low
high
value

/* input variables */
cum_freq[];     /* cumulative frequencies table */
cfl;     /* length of cum_freq[] */

symbol = arith_decode(cum_freq, cfl) {
    if (arith_first_symbol()) {
        value = 0;
        for (i=1; i<=16; i++) {
            value = (val<<1) | arith_get_next_bit();
        }
        low  = 0;
        high  = 65535;
    }

    range = high-low+1;
    cum =((((int) (value-low+1))<<14)-((int) 1))/range;
    p = cum_freq-1;

    do {
        q = p + (cfl>>1);
        if ( *q > cum ) {p=q; cfl++; }
        cfl>>=1;
    }
```

| FIG 22A | FIG |
|---|---|
| FIG 22B | 22 |

FIG 22A

```
        while ( cfl>1 );

        symbol = p-cum_freq+1;
        if (symbol)
            high = low + (range*cum_freq[symbol-1])>>14 - 1;

        low += (range * cum_freq[symbol])>>14;

        for (;;) {
            if (high<32768) {}
            else if (low>=32768) {
                value -= 32768;
                low   -= 32768;
                high  -= 32768;
            }
            else if (low>=16384 && high<49152) {
                value -= 16384;
                low   -= 16384;
                high  -= 16384;
            }
            else break;

            low += low;
            high += high+1;
            value = (value<<1) | arith_get_next_bit();
        }
        return symbol;
    }
```

FIG 22B

| FIG 22A | FIG |
|---|---|
| FIG 22B | 22 |

```
b = m>>2;
a = m-(b<<2);
for (j=0;j<lev;j++) {
    lsbidx = (a==0) ? 1 : ((b==0)?0:2);
    r = arith_decode(arith_cf_r[lsbidx], 4);
    a = (a<<1) | (r&1);
    b = (a<<1) | ((r>>1)&1);
}
```

FIG 23

```
x_ac_dec[2*i]   = a
x_ac_dec[2*i+1] = b
```

FIG 24

```
/*input variables*/
a,b/* Decoded unsigned quantized spectralcoefficients of the 2-tuple */
i  /* Index of the quantized spectral coefficient to decode */

arith_update_context(i, a, b) {
    q[1][i] = a+b+1;
    if (q[1][i]>0xF)
        q[1][i] = 0xF;
}
```

FIG 25

```
/*input variables*/
offset      /* number of decoded 2-tuples */
N           /* Window length */
x_ac_dec /* vector of decoded spectal coefficients */

arith_finish(x_ace_dec,offset,N)
{
    for (i=offset ;i<N/4;i++) {
        x_ac_dec[2*i]   = 0;
        x_ac_dec[2*i+1] = 0;
        q[1][i] = 1;
    }
}
```

FIG 26

```
usac_raw_data_block()
{
    single_channel_element ();
    or
    channel_pair_element ();
    or
    single_channel_element ();
    and
    channel_pair_element ();
}
```

FIG 27A

```
single_channel_element ()
{
    fd_channel_stream (*,*,*);
}
```

FIG 27B

```
channel_pair_element
{
if (tw_mdct) {
    common_tw;
    if (common_tw) {
        tw_data();
    }
}
fd_channel_steram(*,*,*);
fd_channel_steram(*,*,*);
}
```

FIG 27C

```
fd_channel_stream (*,*,*);
{
    global gain;
    if (tw_mdct) {
        if (not common_tw) {
            tw_data ();
        }
    }
    scale_factor_data ();
    ac_spectral_data ();
}
```

FIG 27D

Table - Syntax of tw_data()

| syntax | no. of bits | mnemonic |
|---|---|---|
| tw_data() | | |
| { | | |
| **tw_data_present;** | **1** | **uimsbf** |
| if (tw_data_prsent==1) { | | |
| for (i=1; i<NUM_TW_NODES; i++) { | | |
| **tw_ratio[i];** | **3** | **uimsbf** |
| } | | |
| } | | |
| } | | |

FIG 27E

Table - Syntax of ac_spectral_data()

| syntax | no. of bits | mnemonic |
|---|---|---|
| ac_spectral_data(indepFlag) | | |
| { | | |
| if(indepflag) { | | |
| arith_reset_flag=1; | | |
| } else { | | |
| **arith_reset_flag;** | **1** | **uimsbf** |
| } | | |
| for (win=0; win<num_windows; win++) { | | Note 1 |
| arith_data(lg, arith_reset_flag && (win==0)); | | |
| } | | |
| } | | |

Note 1: num_windows indicates the number of windows in the current window_sequence. In case window_sequence is EIGHT_SHORT_SEQUENCE num_windows equals 8. In all other cases num_windows equals 1

FIG 27F

AUDIO SIGNAL DECODER, AUDIO SIGNAL ENCODER, METHOD FOR DECODING AN AUDIO SIGNAL, METHOD FOR ENCODING AN AUDIO SIGNAL AND COMPUTER PROGRAM USING A PITCH-DEPENDENT ADAPTATION OF A CODING CONTEXT

CROSS-REFERENCE TO RELATED APPLICATIONS

This application is a continuation of copending International Application No. PCT/EP2011/053541, filed Mar. 9, 2011, which is incorporated herein by reference in its entirety, and additionally claims priority from U.S. Application No. 61/312,503, filed Mar. 10, 2010, which is also incorporated herein by reference in its entirety.

BACKGROUND OF THE INVENTION

Embodiments according to the invention are related to an audio signal decoder for providing a decoded audio signal representation on the basis of an encoded audio signal representation.

Further embodiments according to the invention are related to an audio signal encoder for providing an encoded representation of an input audio signal.

Further embodiments according to the invention are related to a method for providing a decoded audio signal representation on the basis of an encoded audio signal representation.

Further embodiments according to the invention are related to a method for providing an encoded representation of an input audio signal.

Further embodiments according to the invention are related to computer programs.

Some embodiments according to the invention are related to a concept for adapting the context of an arithmetic coder using warp information, which may be used in combination with a time-warped-modified-discrete-cosine-transform (briefly designated as TW-MDCT).

In the following, a brief introduction will be given into the field of time-warped audio encoding, concepts of which can be applied in conjunction with some of the embodiments of the invention.

In the recent years, techniques have been developed to transform an audio signal to a frequency-domain representation, and to efficiently encode the frequency-domain representation, for example, taking into account perceptual masking thresholds. This concept of audio signal encoding is particularly efficient if the block length, for which a set of encoded spectral coefficients are transmitted, is long, and if only a comparatively small number of spectral coefficients are well above the global masking threshold while a large number of spectral coefficients are nearby or below the global masking threshold and can thus be neglected (or coded with minimum code length). A spectrum in which said condition holds is sometimes called a sparse spectrum.

For example, cosine-based or sine-based modulated lapped transforms are often used in applications for source coding due to their energy compaction properties. That is, for harmonic tones with constant fundamental frequencies (pitch), they concentrate the signal energy to a low number of spectral components (sub-bands), which leads to an efficient signal representation.

Generally, the (fundamental) pitch of a signal shall be understood to be the lowest dominant frequency distinguishable from the spectrum of the signal. In the common speech model, the pitch is the frequency of the excitation signal modulated by the human throat. If only one single fundamental frequency would be present, the spectrum would be extremely simple, comprising the fundamental frequency and the overtones only. Such a spectrum could be encoded highly efficiently. For signals with varying pitch, however, the energy corresponding to each harmonic component is spread over several transform coefficients, thus leading to a reduction of coding efficiency.

In order to overcome the reduction of coding efficiency, the audio signal to be encoded is effectively resampled on a non-uniform temporal grid. In the subsequent processing, the sample positions obtained by the non-uniform resampling are processed as if they would represent values on a uniform temporal grid. This operation is commonly denoted by the phrase "time warping". The sample times may be advantageously chosen in dependence on the temporal variation of the pitch, such that a pitch variation in the time warped version of the audio signal is smaller than a pitch variation in the original version of the audio signal (before time warping). After time warping of the audio signal, the time-warped version of the audio signal is converted into the frequency-domain. The pitch-dependent time warping has the effect that the frequency-domain representation of the time-warped audio signal typically exhibits an energy compaction into a much smaller number of spectral components than a frequency-domain representation of the original (non-time-warped audio signal).

At the decoder side the frequency-domain representation of the time-warped audio signal is converted to the time-domain, such that a time-domain representation of the time-warped audio signal is available at the decoder side. However, in the time-domain representation of the decoder-sided reconstructed time-warped audio signal, the original pitch variations of the encoder-sided input audio signal are not included. Accordingly, yet another time warping by resampling of the decoder-sided reconstructed time-domain representation of the time-warped audio signal is applied.

In order to obtain a good reconstruction of the encoder-sided input audio signal at the decoder, it is desirable that the decoder-sided time warping is at least approximately the inverse operation with respect to the encoder-sided time warping. In order to obtain an appropriate time warping, it is desirable to have an information available at the decoder, which allows for an adjustment of the decoder-sided time warping.

As it is typically necessitated to transfer such an information from the audio signal encoder to the audio signal decoder, it is desirable to keep the bitrate necessitated for this transmission small while still allowing for a reliable reconstruction of the necessitated time warp information at the decoder side.

Moreover, a coding efficiency when encoding or decoding spectral values is sometimes increased by the use of a context-dependent encoder or a context-dependent decoder.

However, it has been found that a coding efficiency of an audio encoder or of an audio decoder is often comparatively low in the presence of a variation of a fundamental frequency or of a pitch, even though the time warp concept is applied.

In view of this situation, there is a desire to have a concept which allows for a good coding efficiency even in the presence a variation of a fundamental frequency.

SUMMARY

According to an embodiment, an audio signal decoder for providing a decoded audio signal representation on the basis of an encoded audio signal representation including an encoded spectrum representation and an encoded time warp information may have: a context-based spectral value decoder configured to decode a codeword describing one or more spectral values or at least a portion of a number representation of one or more spectral values in dependence on a context state, to obtain decoded spectral values; a context state determinator configured to determine a current context state in dependence on one or more previously decoded spectral values; a time warping frequency-domain-to-time-domain converter configured to provide a time-warped time-domain representation of a given audio frame on the basis of a set of decoded spectral values associated with the given audio frame and provided by the context-based spectral value decoder and in dependence on the time warp information; wherein the context-state determinator is configured to adapt the determination of the context state to a change of a fundamental frequency between subsequent audio frames.

According to another embodiment, an audio signal encoder for providing an encoded representation of an input audio signal including an encoded spectrum representation and an encoded time warp information may have: a frequency-domain representation provider configured to provide a frequency-domain representation representing a time-warped version of the input audio signal, time-warped in accordance with the time warp information; a context-based spectral value encoder configured to provide a codeword describing one or more spectral values of the frequency-domain representation, or at least a portion of a number representation of one or more spectral values of the frequency-domain representation, in dependence on a context state, to obtain encoded spectral values of the encoded spectrum representation; and a context state determinator configured to determine a current context state in dependence on one or more previously-encoded spectral values, wherein the context state determinator is configured to adapt the determination of the context state to a change of a fundamental frequency between subsequent audio frames.

According to another embodiment, a method for providing a decoded audio signal representation on the basis of an encoded audio signal representation including an encoded spectrum representation and an encoded time warp information, may have the steps of: decoding a codeword describing one or more spectral values or at least a portion of a number representation of one or more spectral values in dependence on a context state, to obtain decoded spectral values; determining a current context state in dependence on one or more previously decoded spectral values; providing a time-warped time-domain representation of a given audio frame on the basis of a set of decoded spectral values associated with the given audio frame and provided by the context-based spectral value decoder and in dependence on the time warp information; wherein the determination of the context state is adapted to a change of a fundamental frequency between subsequent audio frames.

According to another embodiment, a method for providing an encoded representation of an input audio signal including an encoded spectrum representation and an encoded time warp information may have the steps of: providing a frequency-domain representation representing a time-warped version of the input audio signal, time-warped in accordance with the time warp information; providing a codeword describing one or more spectral values of the frequency-domain representation, or at least a portion of a number representation of one or more spectral values of the frequency-domain representation, in dependence on a context state, to obtain encoded spectral values of the encoded spectrum representation; and determining a current context state in dependence on one or more previously-encoded spectral values, wherein the determination of the context state is adapted to a change of a fundamental frequency between subsequent audio frames.

Another embodiment may have a computer program for performing the inventive methods when the computer program runs on a computer.

An embodiment according to the invention creates an audio signal decoder for providing a decoded audio signal representation on the basis of an encoded audio signal representation comprising an encoded spectrum representation and an encoded time warp information. The audio signal decoder comprises a context-based spectral value decoder configured to decode a codeword describing one or more spectral values or at least a portion of a number representation of one or more spectral values in dependence on a context state, to obtain decoded spectral values. The audio signal decoder also comprises a context state determinator configured to determine a current context state in dependence on one or more previously decoded spectral values. The audio signal decoder also comprises a time-warping frequency-domain-to-time-domain converter configured to provide a time-warped time-domain representation of an audio frame on the basis of a set of decoded spectral values associated with the given audio frame and provided by the context-based spectral value determinator and in dependence on the time warp information. The context state determinator is configured to adapt the determination of the context state to a change of a fundamental frequency between subsequent frames.

This embodiment according to the invention is based on the finding that a coding efficiency, which is achieved by a context-based spectral value decoder in the presence of an audio signal having a time-variant fundamental frequency is improved if the context state is adapted to the change of a fundamental frequency between subsequent frames because a change of a fundamental frequency over time (which is equivalent to a variation of the pitch in many cases) has the effect that a spectrum of a given audio frame is typically similar to a frequency-scaled version of a spectrum of a previous audio frame (preceding the given audio frame), such that the adaptation of the determination of the context in dependence on the change of the fundamental frequency allows to exploit said similarity for improving the coding efficiency.

In other words, it has been found that the coding efficiency (or decoding efficiency) of the context-based spectral value coding is comparatively poor in the presence of a significant change of a fundamental frequency between two subsequent frames, and that the coding efficiency can be improved by adapting the determination of the context state in such a situation. The adaptation of the determination of the context state allows to exploit similarities between the spectra of the previous audio frame and of the current audio frame while also considering the systematic differences between the spectra of the previous audio frame and of the current audio frame like, for example, the frequency scaling of the spectrum which typically appears in the presence of a change of the fundamental frequency over time (i.e. between two audio frames).

To summarize, this embodiment according to the invention helps to improve the coding efficiency without necessitating additional side information or bitrate (assuming an information describing the change of the fundamental frequency between subsequent frames is available anyway in an audio bitstream using the time warp feature of an audio signal encoder or decoder).

In an embodiment, the time warping frequency-domain-to-time-domain converter comprises a normal (non-time warping) frequency-domain-to-time-domain converter configured to provide a time-domain representation of a given audio frame on the basis of a set of decoded spectral values associated with the given audio frame and provided by the context-based spectral value decoder and a time warp re-sampler configured to resample the time-domain representation of the given audio frame, or a processed version thereof, in dependence on the time warp information, to obtain a re-sampled (time-warped) time-domain representation of the given audio frame. Such an implementation of a time warping frequency-domain-to-time-domain converter is easy to implement because it relies on a "standard" frequency-domain-to-time-domain converter and comprises, as a functional extension, a time-warp re-sampler, the function of which may be independent of the function of the frequency-domain-to-time-domain converter. Accordingly, the frequency-domain-to-time-domain converter may be reused both in a mode of operation in which time warping (or time-dewarping) is inactive and in a mode of operation in which time-warping (or time-dewarping) is active.

In an embodiment the time warp information describes a variation of a pitch over time. In this embodiment, the context state determinator is configured to derive a frequency stretching information (i.e., a frequency scaling information) from the time warp information. Moreover, the context state determinator is configured to stretch or compress a past context associated with a previous audio frame along the frequency axis in dependence on the frequency stretching information, to obtain an adapted context for a context-based decoding of one or more spectral values of a current audio frame. It has been found that a time warp information, which describes a variation of a pitch over time, is well-suited for deriving the frequency stretching information. Moreover, it has been found that stretching or compressing the past context associated with a previous audio frame along the frequency axis typically results in a stretched or compressed context which allows for a derivation of a meaningful context state information, which is well-adapted to the spectrum of the present audio frame and consequently brings along a good coding efficiency.

In an embodiment, the context state determinator is configured to derive a first average frequency information of a first audio frame from the time warp information, and to derive a second average frequency information over a second audio frame following the first audio frame from the time warp information. In this case, the context state determinator is configured to compute a ratio between the second average frequency information over the second audio frame and the first average frequency information over the first audio frame in order to determine the frequency stretching information. It has been found that it is typically easily possible to derive the average frequency information from the time warp information, and it has also been found that the ratio between the first and second average frequency information allows for a computationally efficient derivation of the frequency stretching information.

In another embodiment, the context state determinator is configured to derive a first average time warp contour information over a first audio frame from the time warp information, and to derive a second average time warp contour information over a second audio frame following the first audio frame from the time warp information. In this case, the context state determinator is configured to compute a ratio between the first average time warp contour information over the first audio frame and the second average time warp contour information over the second audio frame, in order to determine the frequency stretching information. It has been found that it is computationally particularly efficient to compute the averages of the time warp contour information over the first and second audio frame (which may be overlapping) and that a ratio between said first average time warp contour information and said second average time warp contour information provides a sufficiently accurate frequency stretching information.

In an embodiment, the context state determinator is configured to derive the first and second average frequency information or the first and second average time warp contour information from a common time warp contour extending over a plurality of consecutive audio frames. It has been found that the concept of establishing a common time warp contour extending over a plurality of consecutive audio frames does not only facilitate the accurate and distortion-free computation of the re-sampling time, but also provides a very good basis for an estimation of a change of a fundamental frequency between two subsequent audio frames. Accordingly, the common time warp contour has been identified as a very good means for identifying a relative frequency change over time between different audio frames.

In an embodiment, the audio signal decoder comprises a time warp contour calculator configured to calculate a time warp contour information describing a temporal evolution of a relative pitch over a plurality of consecutive audio frames on the basis of the time warp information. In this case, the context state determinator is configured to use the time warp contour information for deriving the frequency stretching information. It has been found that a time warp contour information which may, for example, be defined for each sample of an audio frame, constitutes a very good basis for an adaptation of the determination of the context state.

In an embodiment, the audio signal decoder comprises a re-sampling position calculator. The re-sampling position calculator is configured to calculate re-sampling positions for use by the time warp re-sampler on the basis of the time warp contour information, such that a temporal variation of the re-sampling positions is determined by the time warp contour information. It has been found that the common use of the time warp contour information for the determination of the frequency stretching information and for the determination of the re-sampling positions has the effect that a stretched context, which is obtained by applying the frequency stretching information, is well-adapted to the characteristics of the spectrum of a current audio frame, wherein the audio signal of the current audio frame is, at least approximately, a continuation of the audio signal of the previous audio signal reconstructed by the re-sampling operation using the calculated re-sampling positions.

In an embodiment, the context state determinator is configured to derive a numeric current context value in dependence on a plurality of previously decoded spectral values (which may be included in or described by a context memory structure), and to select a mapping rule describing the mapping of a code value onto a symbol code representing one or more spectral values, or a portion of a number representation of one or more spectral values, in dependence on the numeric current context value. In this case, the context-based spectral value decoder is configured to decode the code value describing one or more spectral values, or at least a portion of a number representation of one or more spectral values, using the mapping rule selected by the context state determinator. It has been found that a context adaptation, in which a numeric current context value is derived from a plurality of previously decoded spectral values, and in which a mapping rule is selected in accordance with said numeric (current) context value, benefits significantly from an adaptation of the determination of the context state, for example, of the numeric (current) context value, because the selection of a significantly inappropriate mapping rule can be avoided by using this concept. In contrast, if the derivation of the context state, i.e., of the numeric current context value, would not be adapted in dependence on the change of the fundamental frequency between subsequent frames, a mis-selection of a mapping rule would often occur in the presence of a change of the fundamental frequency, such that a coding gain would decrease. Such decrease of the coding gain is avoided by the described mechanism.

In an embodiment, the context state determinator is configured to set up and update a preliminary context memory structure, such that the entries of the preliminary context memory structure describe one or more spectral values of a first audio frame, wherein entry indices of the entries of the preliminary context memory structure are indicative of a frequency bin or of a set of adjacent frequency bins of the frequency-domain-to-time-domain converter to which the respective entries are associated (e.g., in a provision of a time-domain representation of the first audio frame). The context state determinator is further configured to obtain a frequency-scaled context memory structure on the basis of the preliminary context memory structure such that a given entry or sub-entry of the preliminary context memory structure having a first frequency index is mapped onto a corresponding entry or sub-entry of the frequency-scaled context memory structure having a second frequency index. The second frequency index is associated with a different bin or a different set of adjacent frequency bins of the frequency-domain-to-time-domain converter than the first frequency index.

In other words, an entry of the preliminary context memory structure, which is obtained on the basis of one or more spectral values which correspond to an i-th spectral bin of the frequency-domain-to-time-domain converter (or the i-th set of spectral bins of the frequency-domain-to-time-domain converter) is mapped onto an entry of the frequency-scaled context memory structure which is associated with a j-th frequency bin (or j-th set of frequency bins) of the frequency-domain-to-time-domain converter, wherein j is different from i. It has been found that this concept of mapping the entries of the preliminary context memory structure onto entries of the frequency-scaled context memory structure provides for a computationally particularly efficient method of adapting the determination of the context state to the change of the fundamental frequency. A frequency scaling of the context can be achieved with low effort using this concept. Accordingly, the derivation of the numeric current context value from the frequency-scaled context memory structure may be identical to a derivation of a numeric current context value from a conventional (e.g. the preliminary) context memory structure in the absence of a significant pitch variation. Thus, the described concept allows for the implementation of the context adaptation in an existing audio decoder with minimum effort.

In an embodiment, the context state determinator is configured to derive a context state value describing the current context state for a decoding of a codeword describing one or more spectral values of a second audio frame or at least a portion of a number representation of one or more spectral values of a second audio frame having associated a third frequency index using values of the frequency-scaled context memory structure, frequency indices of which values of the frequency-scaled context memory structure are in a predetermined relationship with the third frequency index. In this case, the third frequency index designates a frequency bin or a set of adjacent frequency bins of the frequency-domain-to-time-domain decoder to which one or more spectral values of the audio frame to be decoded using the current context state value are associated.

It has been found that the usage of a predetermined (and, advantageously, fixed) relative environment (in terms of frequency bins) of the one or more spectral values to be decoded for the derivation of the context state value (for example, a numeric current context value) allows to keep the computation of said context state value reasonably simple. By using the frequency-scaled context memory structure as an input to the derivation of the context state value, a variation of the fundamental frequency can be considered efficiently.

In an embodiment, the context state determinator is configured to set each of a plurality of entries of the frequency-scaled context memory structure having a corresponding target frequency index to a value of a corresponding entry of the preliminary context memory structure having a corresponding source frequency index. The context state determinator is configured to determine corresponding frequency indices of an entry of the frequency-scaled context memory structure and of a corresponding entry of the preliminary context memory structure such that a ratio between said corresponding frequency indices is determined by the change of the fundamental frequency between a current audio frame, to which entries of the preliminary context memory structure are associated, and a subsequent audio frame, the decoding context of which is determined by the entries of the frequency-scaled context memory structure. By using such a concept for the derivation of the entries of the frequency-scaled context memory structure, the complexity can be kept small while it is still possible to adapt the frequency-scaled context memory structure to the change of the fundamental frequency.

In an embodiment, the context state determinator is configured to set up the preliminary context memory structure such that each of a plurality of entries of the preliminary context memory structure is based on a plurality of spectral values of a first audio frame, wherein entry indices of the entries of the preliminary context memory structure are indicative of a set of adjacent frequency bins of the frequency-domain-to-time-domain converter to which the respective entries are associated (with respect to the first audio frame). The context state determinator is configured to extract preliminary frequency-bin-individual context values having associated individual frequency bin indices from the entries of the preliminary context memory structure. In addition, the context state determinator is configured to obtain frequency-scaled frequency-bin-individual context values having associated individual frequency bin indices, such that a given preliminary frequency-bin-individual context value having a first frequency bin index is mapped onto a corresponding frequency-scaled frequency-bin-individual context value having a second frequency bin index, such that a frequency-bin-individual mapping of the preliminary frequency-bin-individual context values is obtained. The context state determinator is further configured to combine a plurality of frequency-scaled frequency-bin-individual context values into a combined entry of the frequency-scaled context memory structure. Accordingly, it is possible to adapt the frequency-scaled context memory structure to a change of the fundamental frequency in a very fine-grained manner, even if a plurality of frequency bins are summarized in a single entry of the context memory structure. Thus, a particularly precise adaptation of the context to the change of the fundamental frequency can be achieved.

Another embodiment according to the invention creates an audio signal encoder for providing an encoded representation of an input audio signal comprising an encoded spectrum representation and an encoded time warp information. The audio signal encoder comprises a frequency-domain-representation provider configured to provide a frequency-domain representation representing a time-warped version of the input audio signal, time-warped in accordance with a time warp information. The audio signal encoder further comprises a context-based spectral value encoder configured to encode a codeword describing one or more spectral values of the frequency-domain representation, or at least a portion of a number representation of one or more spectral values of the frequency-domain representation, in dependence on a context state, to obtain encoded spectral values of the encoded spectral representation. The audio signal decoder also comprises a context state determinator configured to determine a current context state in dependence on one or more previously encoded spectral values. The context state determinator is configured to adapt the determination of the context to a change of a fundamental frequency between subsequent frames.

This audio signal encoder is based on the same ideas and findings as the above-described audio signal decoder. Also, the audio signal encoder can be supplemented by any of the features and functionalities discussed with respect to the audio signal decoder, wherein previously encoded spectral values take the role of previously decoded spectral values in the context state calculation.

In an embodiment, the context state determinator is configured to derive a numeric current context value in dependence on a plurality of previously encoded spectral values, and to select a mapping rule describing a mapping of one or more spectral values, or of a portion of a number representation of one or more spectral values, onto a code value in dependence on the numeric current context value. In this case, the context-based spectral value encoder is configured to provide the code value describing one or more spectral values or at least a portion of a number representation of one or more spectral values using the mapping rule selected by the context state determinator.

Another embodiment according to the invention creates a method for providing a decoded audio signal representation on the basis of an encoded audio signal representation.

Another embodiment according to the invention creates a method for providing an encoded representation of an input audio signal.

Another embodiment according to the invention creates a computer program for performing one of said methods.

The methods and the computer program are based on the same considerations as the above-discussed audio signal decoder and audio signal encoder.

Moreover, the audio signal encoder, the methods and the computer programs can be supplemented by any of the features and functionalities discussed above and described below with respect to the audio signal decoder.

BRIEF DESCRIPTION OF THE DRAWINGS

Embodiments of the present invention will be detailed subsequently referring to the appended drawings, in which:

FIG. 2*a* shows a block schematic diagram of an audio signal encoder, according to another embodiment of the invention;

FIG. 2*b* shows a block schematic diagram of an audio signal decoder, according to another embodiment of the invention;

FIG. 4*c* shows a pseudo program code representation of an algorithm for stretching or compressing a context, which may be applied in the embodiments according to the invention;

FIGS. 4*d* and 4*e* show a pseudo program code representation of an algorithm for stretching or compressing a context, which may be used in embodiments according to the invention;

FIG. 7*a* shows a legend of definitions of data elements and help elements, which are used in an audio decoder according to an embodiment of the invention;

FIG. 7*b* shows a legend of definitions of constants, which are used in an audio decoder according to an embodiment of the invention;

FIG. 8 shows a table representation of a mapping of a codeword index onto a corresponding decoded time warp value;

FIG. 9 shows a pseudo program code representation of an algorithm for interpolating linearly between equally spaced warp nodes;

FIG. 10*a* shows a pseudo program code representation of a helper function "warp_time_inv";

FIG. 10*b* shows a pseudo program code representation of a helper function "warp_inv_vec";

FIG. 11 shows a pseudo program code representation of an algorithm for computing a sample position vector and a transition length;

FIG. 12 shows a table representation of values of a synthesis window length N depending on a window sequence and a core coder frame length;

FIG. 13 shows a matrix representation of allowed window sequences;

FIG. 14 shows a pseudo program code representation of an algorithm for windowing and for an internal overlap-add of a window sequence of type "EIGHT_SHORT_SEQUENCE";

FIG. 15 shows a pseudo program code representation of an algorithm for the windowing and the internal overlap-and-add of other window sequences, which are not of type "EIGHT_SHORT_SEQUENCE";

FIG. 16 shows a pseudo program code representation of an algorithm for resampling.

FIG. 18 shows a legend of definitions;

FIG. 19 shows a pseudo program code representation of an algorithm "arith_map_context( )";

FIG. 20 shows a pseudo program code representation of an algorithm "arith_get_context( )";

FIG. 21 shows a pseudo program code representation of an algorithm "arith_get_pk( )";

FIG. 22 shows a pseudo program code representation of an algorithm "arith_decode( )";

FIG. 23 shows a pseudo program code representation of an algorithm for decoding one or more less significant bit planes;

FIG. 24 shows a pseudo program code representation of an algorithm for setting entries of an array of arithmetically decoded spectral values;

FIG. 25 shows a pseudo program code representation of a function "arith_update_context( )";

FIG. 26 shows a pseudo program code representation of an algorithm "arith_finish( )";

FIGS. 27*a*-27*f* show representations of syntax elements of the audio stream, according to an embodiment of the invention.

DETAILED DESCRIPTION OF THE INVENTION

1. Audio Signal Encoder According to FIG. 1*a*

Figure 1A:
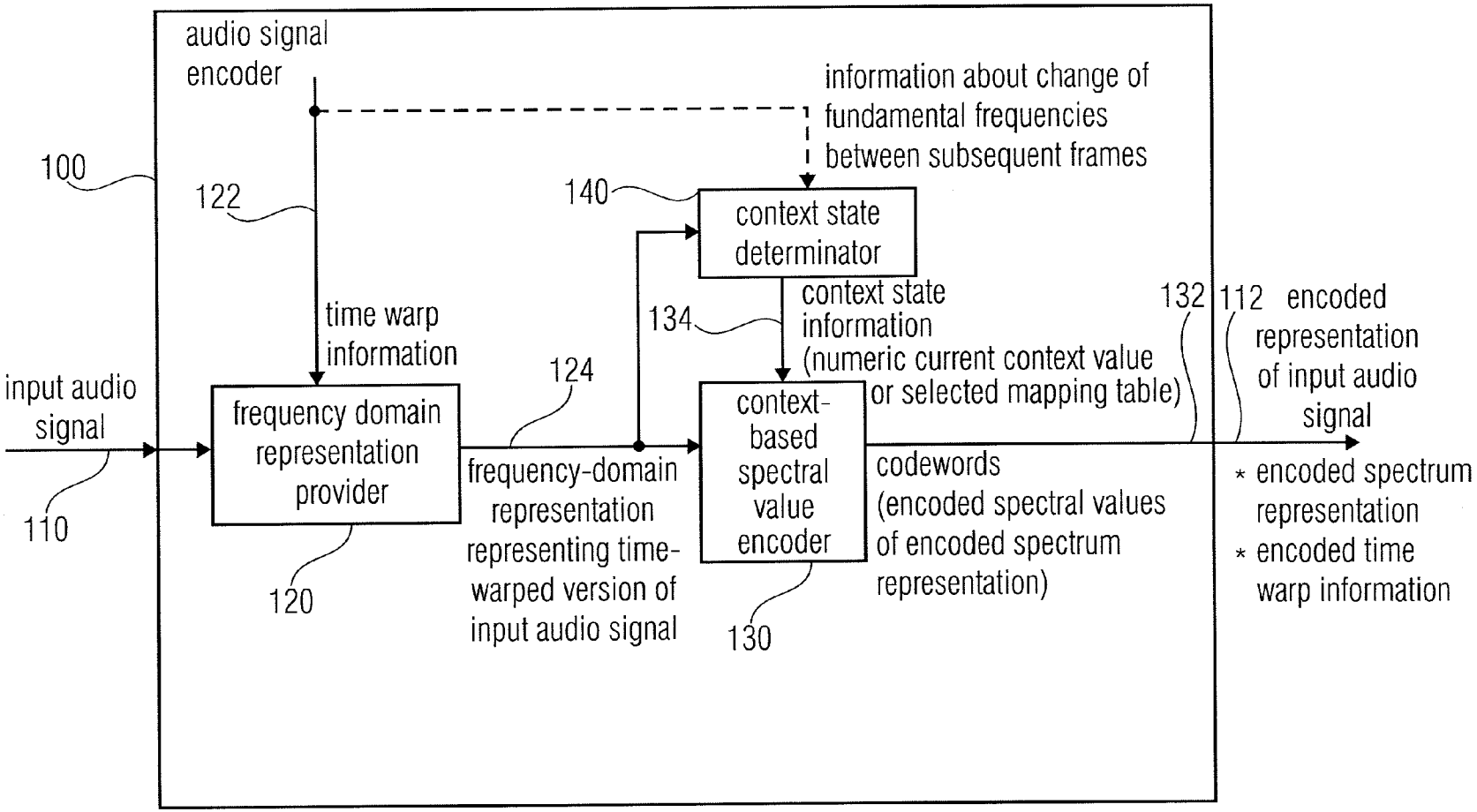
FIG. 1*a* shows a block schematic diagram of an audio signal encoder, according to an embodiment of the invention.

FIG. 1*a* shows a block schematic diagram of an audio signal encoder 100, according to an embodiment of the invention.

The audio signal encoder 100 is configured to receive an input audio signal 110 and to provide an encoded representation 112 of the input audio signal. The encoded representation 112 of the input audio signal comprises an encoded spectrum representation and an encoded time warp information.

The audio signal encoder 100 comprises a frequency-domain representation provider 120 which is configured to receive the input audio signal 110 and a time warp information 122. The frequency-domain representation provider 120 (which may be considered as a time-warping frequency-domain representation provider) is configured to provide a frequency-domain representation 124 representing a time warped version of the input audio signal 110, time warped in accordance with the time warp information 122. The audio signal encoder 100 also comprises a context-based spectral value encoder 130 configured to provide a codeword 132 describing one or more spectral values of the frequency-domain representation 124, or at least a portion of a number representation of one or more spectral values of the frequency-domain representation 124, in dependence on a context state, to obtain encoded spectral values of the encoded spectral representation. The context state may, for example, be described by a context state information 134. The audio signal encoder 100 also comprises a context state determinator 140 which is configured to determine a current context state in dependence on one more previously encoded spectral values 124. The context state determinator 140 may consequently provide the context state information 134 to the context-based spectral value encoder 130, wherein the context state information may, for example, take the form of a numeric current context value (for the selection of a mapping rule or mapping table) or of a reference to a selected mapping rule or mapping table. The context state determinator 140 is configured to adapt the determination of the context state to a change of a fundamental frequency between subsequent frames. Accordingly, the context state determinator may evaluate an information about a change of a fundamental frequency between subsequent audio frames. This information about the change of the fundamental frequency between subsequent frames may, for example, be based on the time warp information 122, which is used by the frequency-domain representation provider 120.

Accordingly, the audio signal encoder may provide a particularly high coding efficiency in the case of audio signal portions comprising a fundamental frequency varying over time, or a pitch varying over time, because the derivation of the context state information 134 is adapted to the variation of the fundamental frequency between two audio frames. Accordingly, the context, which is used by the context-based spectral value encoder 130, is well-adapted to the spectral compression (with respect to frequency) or spectral expansion (with respect to frequency) of the frequency-domain representation 124, which occurs if the fundamental frequency changes from one audio frame to the next audio frame (i.e., between the two audio frames). Consequently, the context state information 134 is well-adapted, on average, to the frequency-domain representation 124 even in the case of a change of the fundamental frequency which, in turn, results in a good coding efficiency of the context-based spectral value encoder. It has been found that, if, in contrast, the context state would not be adapted to the change of the fundamental frequency, the context would be inappropriate in situations in which the fundamental frequency changes, thereby resulting in a significant degradation of the coding efficiency.

Accordingly, it can be said that the audio signal encoder 100 typically out-performs conventional audio signal encoders using a context-based spectral value encoding in situations in which the fundamental frequency changes.

It should be noted here that many different implementations how to adapt the determination of the context state to a change of the fundamental frequency between subsequent frames (i.e. from a first frame to a second, subsequent frame) exist. For example, a context memory structure, entries of which are defined by or derived from the spectral values of the frequency-domain representation 124, (or, more precisely, a content thereof) may be stretched or compressed in frequency before a numeric current context value describing the context state is derived. Such concepts will be discussed in detail below. Alternatively, however, it is also possible to change (or adapt) the algorithm for deriving the context state information 134 from the entries of a context memory structure, entries of which are based on the frequency-domain representation 124. For example, it could be adjusted which entry (entries) of such a non-frequency-scaled context memory structure is (are) considered, even though such a solution is not discussed herein in detail.

2. Audio Signal Decoder According to FIG. 1*b*

Figure 1B:
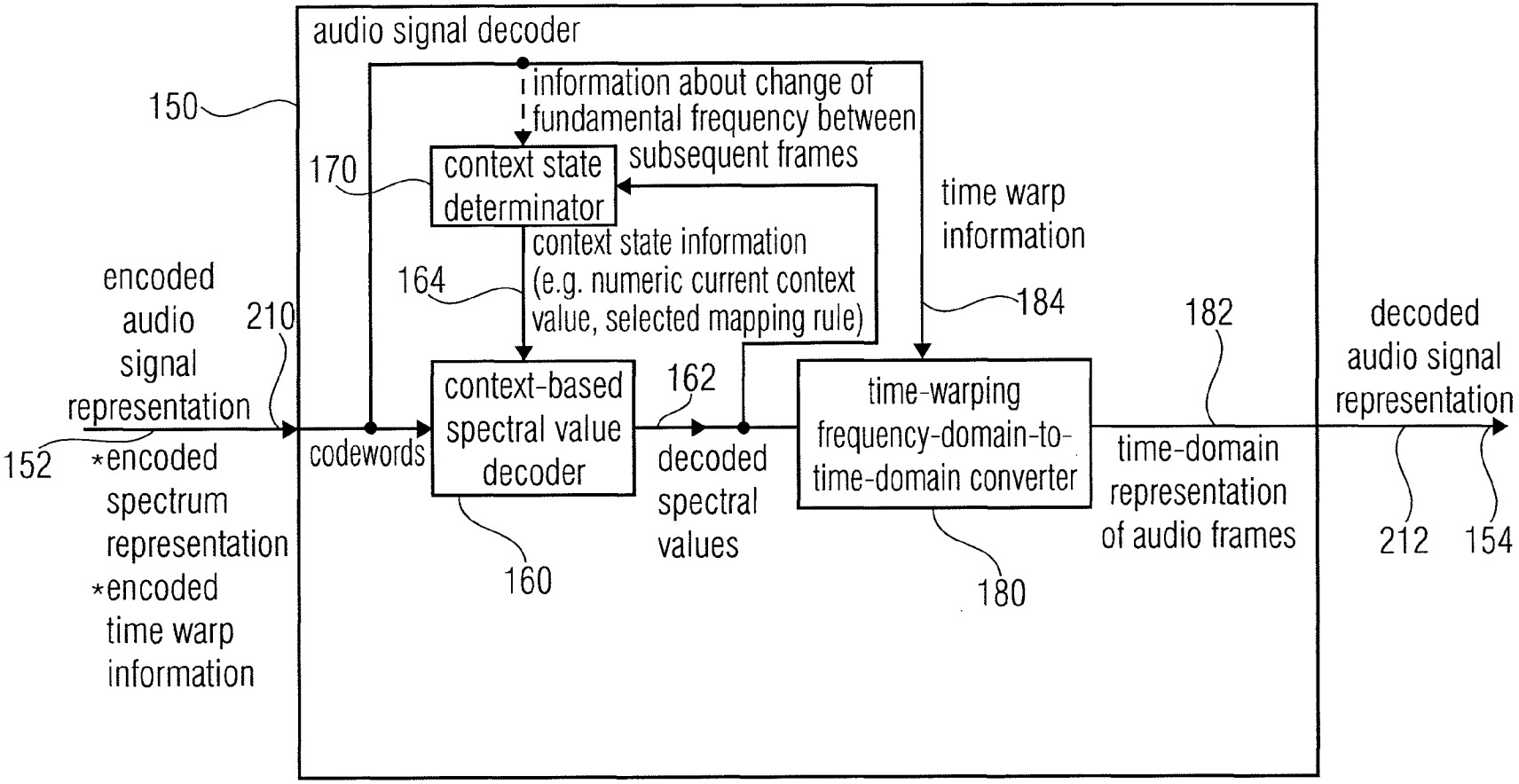
FIG. 1*b* shows a block schematic diagram of an audio signal decoder, according to an embodiment of the invention.

FIG. 1*b* shows a block schematic diagram of an audio signal decoder 150.

The audio signal decoder 150 is configured to receive an encoded audio signal representation 152, which may comprise an encoded spectrum representation and an encoded time warp information. The audio signal decoder 150 is configured to provide a decoded audio signal representation 154 on the basis of the encoded audio signal representation 152.

The audio signal decoder 150 comprises a context-based spectral value decoder 160, which is configured to receive codewords of the encoded spectrum representation and to provide, on the basis thereof, decoded spectral values 162. Moreover, the context-based spectral value decoder 160 is configured to receive a context state information 164 which may, for example, take the form of a numeric current context value, of a selected mapping rule or of a reference to a selected mapping rule. The context-based spectral value decoder 160 is configured to decode a codeword describing one or more spectral values, or at least a portion of a number representation of one or more spectral values, in dependence on a context state (which may be described by the context state information 164) to obtain the decoded spectral values 162. The audio signal decoder 150 also comprises a context state determinator 170 which is configured to determine a current context state in dependence on one or more previously decoded spectral values 162. The audio signal decoder 150 also comprises a time-warping frequency-domain-to-time-domain converter 180 which is configured to provide a time-warped time-domain representation 182 on the basis of a set of decoded spectral values 162 associated with a given audio frame and provided by the context-based spectral value decoder. The time warping frequency-domain-to-time-domain converter 180 is configured to receive a time warp information 184 in order to adapt the provision of the time-warped time domain representation 182 to the desired time warp described by the encoded time warp information of the encoded audio signal representation 152, such that the time warped time-domain representation 182 constitutes the decoded audio signal representation 154 (or, equivalently, forms the basis of the decoded audio signal representation, if a post-processing is used).

The time-warping frequency-domain-to-time-domain converter 180 may, for example, comprise a frequency-domain-to-time-domain converter configured to provide a time-domain representation of a given audio frame on the basis of set of the decoded spectral values 162 associated with a given audio frame and provided by the context-based spectral value decoder 160. The time-warping frequency-domain-to-time-domain converter may also comprise a time-warp re-sampler configured to resample the time-domain representation of the given audio frame, or a processed version thereof, in dependence on the time warp information 184, to obtain the re-sampled time-domain representation 182 of the given audio frame.

Moreover, the context state determinator 170 is configured to adapt the determination of the context state (which is described by the context state information 164) to a change of a fundamental frequency between subsequent audio frames (i.e., from a first audio frame to a second, subsequent audio frame).

The audio signal decoder 150 is based on the findings which have already been discussed with respect to the audio signal encoder 100. In particular, the audio signal decoder is configured to adapt the determination of the context state to a change of a fundamental frequency between subsequent audio frames, such that the context state (and, consequently, the assumptions used by the context-based spectral value decoder 160 regarding the statistical probability of the occurrence of different spectral values) is well-adapted, at least on average, to the spectrum of a current audio frame to be decoded using said context information. Accordingly, the codewords encoding the spectral values of said current audio frame can be particularly short, because a good matching between the selected context, selected in accordance with the context state information provided by the context state determinator 170, and the spectral values to be decoded generally results in comparatively short codewords, which brings along a good bitrate efficiency.

Moreover, the context state determinator 170 can be implemented efficiently, because the time warp information 184, which is included in the encoded audio signal representation 152 anyway for usage by the time warping frequency-domain-to-time-domain converter, can be reused by the context state determinator 170 as an information about a change of the fundamental frequency between subsequent audio frames, or to derive an information about a change of a fundamental frequency between subsequent audio frames.

Accordingly, the adaptation of the determination of the context state to the change of the fundamental frequency between subsequent frames does not even necessitating any additional side information. Accordingly, the audio signal decoder 150 brings along an improved coding efficiency of the context-based spectral value decoding (and allows for an improved encoding efficiency at the side of the encoder 100) without necessitating any additional side information, which constitutes a significant improvement in bitrate efficiency.

Moreover, it should be noted that different concepts can be used for adapting the determination of the context state to a change of the fundamental frequency between subsequent frames (i.e. from a first audio frame to a second, subsequent audio frame). For example, a context memory structure, entries of which are based on the decoded spectral values 162, can be adapted, for example, using a frequency scaling (for example, a frequency stretching or frequency compression) before the context state information 164 is derived from the frequency-scaled context memory structure by the context state determinator 170. Alternatively, however, a different algorithm may be used by the context state determinator 170 to derive the context state information 164. For example, it can be adapted which entries of a context memory structure are used for determining a context state for the decoding of a codeword having a given codeword frequency index. Even though latter concept has not been described herein in detail, it may of course be applied in some embodiments according to the invention. Also, different concepts may be applied for determining the change of the fundamental frequency.

Figure 2C:
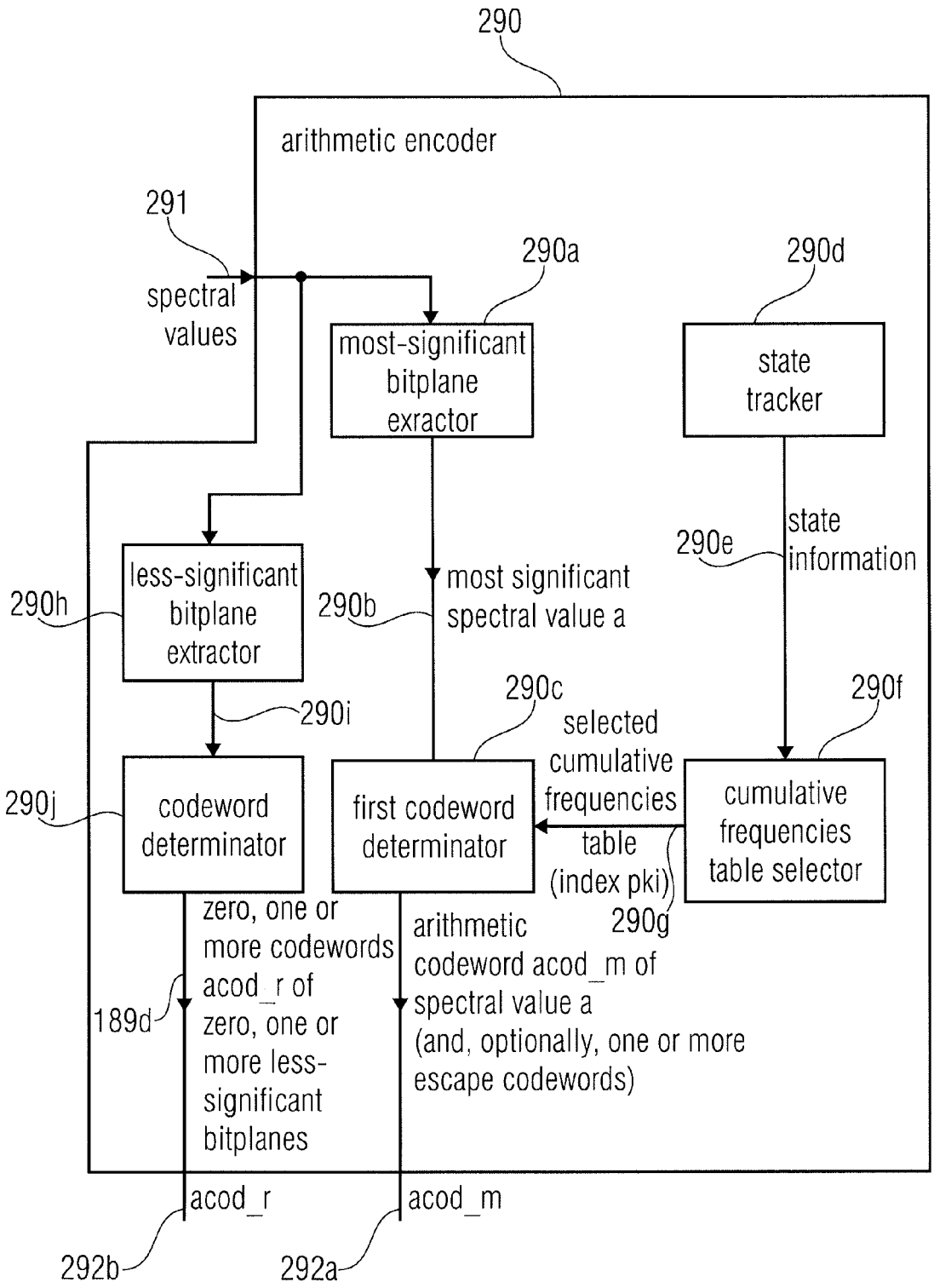
FIG. 2*c* shows a block schematic diagram of an arithmetic encoder for use in the audio encoders according to the embodiments of the invention.

3. Audio Signal Encoder According to FIG. 2*a*

FIG. 2*a* shows a block schematic diagram of an audio signal encoder 200 according to an embodiment of the invention. It should be noted that the audio signal encoder 200 according to FIG. 2 is very similar to the audio signal encoder 100 according to FIG. 1*a*, such that identical means and signals will be designated with identical reference numerals and not explained in detail again.

The audio signal encoder 200 is configured to receive an input audio signal 110 and to provide, on the basis thereof, an encoded audio signal representation 112. Optionally, the audio signal encoder 200 is also configured to receive an externally generated time warp information 214.

The audio signal encoder 200 comprises a frequency-domain representation provider 120, the functionality of which may be identical to the functionality of the frequency-domain representation provider 120 of the audio signal encoder 100. The frequency-domain representation provider 120 provides a frequency-domain representation representing a time warped version of the input audio signal 110, which frequency-domain representation is designated with 124. The audio signal encoder 200 also comprises a context-based spectral value encoder 130 and a context state determinator 140, which operate as discussed with respect to the audio signal encoder 100. Accordingly, the context-based spectral value encoder 130 provides codewords (e.g., acod_m), each codeword representing one or more spectral values of the encoded spectrum representation, or at least a portion of a number representation of one or more spectral values.

The audio signal encoder optionally comprises a time warp analyzer or fundamental frequency analyzer or pitch analyzer 220, which is configured to receive the input audio signal 110 and to provide, on the basis thereof, a time warp contour information 222, which describes, for example, a time warp to be applied by the frequency-domain representation provider 120 to the input audio signal 110, in order to compensate for a change of the fundamental frequency during an audio frame, and/or a temporal evolution of a fundamental frequency of the input audio signal 110, and/or a temporal evolution of a pitch of the input audio signal 110. The audio signal encoder 200 also comprises a time warp contour encoder 224, which is configured to provide an encoded time warp information 226 on the basis of the time warp contour information 222. The encoded time warp information 226 is included into the encoded audio signal representation 112, and may, for example, take the form of (encoded) time warp ratio values "tw_ratio[i]".

Moreover, it should be noted that the time warp contour information 222 may be provided to the frequency-domain representation provider 120 and also to the context state determinator 140.

The audio signal encoder 200 may, additionally, comprise a psychoacoustic model processor 228, which is configured to receive the input audio signal 110, or a preprocessed version thereof, and to perform a psychoacoustic analysis, to determine, for example, temporal masking effects and/or frequency masking effects. Accordingly, the psychoacoustic model processor 228 may provide a control information 230, which represents, for example, a psychoacoustic relevance of different frequency bands of the input audio signal, as it is well known for frequency-domain audio encoders.

In the following, the signal path of the frequency-domain representation provider 120 will be briefly described. The frequency-domain representation provider 120 comprises an optional preprocessing 120*a*, which may optionally preprocess the input audio signal 110, to provide a preprocessed version 120*b* of the input audio signal 110. The frequency-domain representation provider 120 also comprises a sampler/re-sampler configured to sample or re-sample the input audio signal 110, or the preprocessed version 120*b* thereof, in dependence on a sampling position information 120*d* received from a sampling position calculator 120*e*. Accordingly, the sampler/re-sampler 120*c* may apply a time-variant sampling or re-sampling to the input audio signal 110 (or the preprocessed version 120*b* thereof). By applying such a time-variant sampling (with temporally varying temporal distances between effective sample points), a sampled or re-sampled time domain representation 120*f* is obtained, in which a temporal variation of a pitch or of a fundamental frequency is reduced when compared to the input audio signal 110. The sampling positions are calculated by the sampling position calculation 120*e* in dependence on the time warp contour information 222. The frequency-domain representation provider 120 also comprises a windower 120*g*, wherein the windower 120*g* is configured to window the sampled or re-sampled time-domain representation 120*f* provided by the sampler or re-sampler 120*c*. The windowing is performed in order to reduce or eliminate blocking artifacts, to thereby allow for a smooth overlap-and-add operation at an audio signal decoder. The frequency-domain representation provider 120 also comprises a time-domain-to-frequency-domain converter 120*i* which is configured to receive the windowed and sampled/re-sampled time-domain representation 120*h* and to provide, on the basis thereof, a frequency-domain representation 120*j* which may, for example, comprise one set of spectral coefficients per audio frame of the input audio signal 110 (wherein the audio frames of the input audio signal may, for example, be overlapping or non-overlapping, wherein an overlap of approximately 50% is advantageous in some embodiments for overlapping audio frames). However, it should be noted that in some embodiments, a plurality of sets of spectral coefficients may be provided for a single audio frame.

The frequency-domain representation provider 120 optionally comprises a spectral processor 120*k* which is configured to perform a temporal noise shaping and/or a long term prediction and/or any other form of spectral post-processing, to thereby obtain a post-processed frequency-domain representation 120*l*.

The frequency-domain representation provider 120 optionally comprises a scaler/quantizer 120*m*, wherein the scaler/quantizer 120*m* may, for example, be configured to scale different frequency bins (or frequency bands) of the frequency-domain representation 120*j* or of the post-processed version 120*l* thereof, in accordance with the control information 230 provided by the psychoacoustic model processor 228. Accordingly, frequency bins (or frequency bands, which comprise a plurality of frequency bins) may, for example, be scaled in accordance with the psychoacoustic relevance, such that, effectively, frequency bins (or frequency bands) having high psychoacoustic relevance are encoded with high accuracy by a context-based spectral value encoder, while frequency bins (or frequency bands) having low psychoacoustic relevance are encoded with low accuracy. Moreover, it should be noted that the control information 230 may, optionally, adjust parameters of the windowing, of the time-domain-to-frequency-domain converter and/or of the spectral post-processing. Also, the control information 230 may be included, in an encoded form, into the encoded audio signal representation 112, as is known to the man skilled in the art.

Regarding the functionality of the audio signal encoder 200, it can be said that a time warp (in the sense of a time-variant non-uniform sampling or re-sampling) is applied by the sampler/re-sampler 120*c* in accordance with the time warp contour information 220. Accordingly, it is possible to achieve a frequency-domain representation 120*j* having pronounced spectral peaks and valleys even in the presence of an input audio signal having a temporal variation of the pitch, which would, in the absence of the time-variant sampling/re-sampling, result in a smeared spectrum. In addition, the derivation of the context state for use by the context-based spectral value encoder 130 is adapted in dependence on a change of a fundamental frequency between subsequent audio frames, which results in a particularly high coding efficiency, as discussed above. Moreover, the time warp contour information 222, which serves as the basis for both the computation of the sampling position for the sampler/re-sampler 120*c* and for the adaptation of the determination of the context state, is encoded using the time warp contour encoder 224, such that an encoded time warp information 226 describing the time warp contour information 222 is included in the encoded audio signal representation 112. Accordingly, the encoded audio signal representation 112 provides the necessitated information for the efficient decoding of the encoded input audio signal 110 at the side of an audio signal decoder.

Moreover, it should be noted that the individual components of the audio signal encoder 200 may perform substantially an inverse functionality of the individual components of the audio signal decoder 240, which will be described below taking reference to FIG. 2*b*. Moreover, reference is also made to the detailed discussion regarding the functionality of the audio signal decoder throughout the entirety of the present description, which also allows to understand the audio signal decoder.

It should also be noted that substantial modifications may be made to the audio signal decoder and the individual components thereof. For example, some functionalities may be combined like, for example, the sampling/re-sampling, the windowing and the time-domain-to-frequency-domain conversion. Moreover, additional processing steps may be introduced where appropriate.

Moreover, the encoded audio signal representation may, naturally, comprise additional side information, as desired or necessitated.

4. Audio Signal Decoder According to FIG. 2*b*

FIG. 2*b* shows a block schematic diagram of an audio signal decoder 240 according to an embodiment of the invention. The audio signal decoder 240 may be very similar to the audio signal decoder 150 according to FIG. 1*b*, such that identical means and signals are designated with identical reference numerals and will not be discussed in detail again.

The audio signal decoder 240 is configured to receive an encoded audio signal representation 152, for example, in the form of a bitstream. The encoded audio signal representation 152 comprises an encoded spectrum representation, for example, in the form of codewords (e.g., acod_m) representing one or more spectral values, or at least a portion of a number representation of one or more spectral values. The encoded audio signal representation 152 also comprises an encoded time warp information. Moreover, the audio signal decoder 240 is configured to provide a decoded audio signal representation 154, for example, a time-domain representation of the audio content.

The audio signal decoder 240 comprises a context-based spectral value decoder 160, which is configured to receive the codewords representing spectral values from the encoded audio signal representation 152 and to provide, on the basis thereof, decoded spectral values 162. Moreover, the audio signal decoder 240 also comprises a context state determinator 170, which is configured to provide the context state information 164 to the context-based spectral value decoder 160. The audio signal decoder 240 also comprises a time warping frequency-domain-to-time-domain converter 180, which receives the decoded spectral values 162 and which provides the decoded audio signal representation 154.

The audio signal decoder 240 also comprises a time warp calculator (or time warp decoder) 250, which is configured to receive the encoded time warp information, which is included in the encoded audio signal representation 152, and to provide, on the basis thereof, a decoded time warp information 254. The encoded time warp information may, for example, comprise codewords "tw_ratio[i]" describing a temporal variation of a fundamental frequency or of a pitch. The decoded time warp information 254 may, for example, take the form of a warp contour information. For example, the decoded time warp information 254 may comprise values "warp_value_tbl[tw_ratio[i]]" or values $p_{rel}[n]$, as will be discussed in detail below. Optionally, the audio signal decoder 240 also comprises a time warp contour calculator 256, which is configured to derive a time warp contour information 258 from the decoded time warp information 254. The time warp contour information 258 may, for example, serve as an input information for the context state determinator 170, and also for the time-warping frequency-domain-to-time-domain converter 180.

In the following, some details regarding the time-warping frequency-domain-to-time-domain converter will be described. The converter 180 may, optionally, comprise an inverse quantizer/rescaler 180*a*, which may be configured to receive the decoded spectral values 162 from the context-based spectral value decoder 160 and to provide an inversely quantized and/or rescaled version 180*b* of the decoded spectral values 162. For example, the inverse quantizer/rescaler 180*a* may be configured to perform an operation which is, at least approximately, inverse to the operation of the optional scaler/quantizer 120*m* of the audio signal encoder 200. Accordingly, the optional inverse quantizer/rescaler 180*a* may receive a control information which may correspond to the control information 230.

The time-warping frequency-domain-to-time-domain converter 180 optionally comprises a spectral preprocessor 180*c* which is configured to receive the decoded spectral values 162 or the inversely quantized/rescaled spectral values 180*b* and to provide, on the basis thereof, spectrally preprocessed spectral values 180*d*. For example, the spectral preprocessor 180*c* may perform an inverse operation when compared to the spectral post-processor 120*k* of the audio signal encoder 200.

The time-warping frequency-domain-to-time-domain converter 180 also comprises a frequency-domain-to-time-domain converter 180*e*, which is configured to receive the decoded spectral values 162, the inversely quantized/rescaled spectral values 180*b* or the spectrally preprocessed spectral values 180*d* and to provide, on the basis thereof, a time-domain representation 180*f*. For example, the frequency-domain-to-time-domain converter may be configured to perform an inverse spectral-domain-to-time-domain transform, for example, an inverse modified discrete cosine transform (IMDCT). The frequency-domain-to-time-domain converter 180*e* may, for example, provide a time-domain representation of an audio frame of the encoded audio signal on the basis of one set of decoded spectral values or, alternatively, on the basis of a plurality of sets of decoded spectral values. However, the audio frames of the encoded audio signal may, for example, be overlapping in time in some cases. Nevertheless, the audio frames may be non-overlapping in some other cases.

The time-warping frequency-domain-to-time-domain converter 180 also comprises a windower 180*g*, which is configured to window the time-domain representation 180*f* and to provide a windowed time-domain representation 180*h* on the basis of the time-domain representation 180*f* provided by the frequency-domain-to-time-domain converter 180*e*.

The time-warping frequency-domain-to-time-domain converter 180 also comprises a re-sampler 180*i*, which is configured to resample the windowed time-domain representation 180*h* and to provide, on the basis thereof, a windowed and re-sampled time-domain representation 180*j*. The re-sampler 180*i* is configured to receive a sampling position information 180*k* from a sampling position calculator 180*l*. Accordingly, the re-sampler 180*i* provides a windowed and re-sampled time-domain representation 180*j* for each frame of the encoded audio signal representation, wherein subsequent frames may be overlapping.

Accordingly, an overlapper/adder 180*m* receives the windowed and re-sampled time-domain representations 180*j* of subsequent audio frames of the encoded audio signal representation 152 and overlaps and adds said windowed and re-sampled time-domain representations 180*j* in order to obtain smooth transitions between subsequent audio frames.

The time-warping frequency-domain-to-time-domain converter optionally comprises a time-domain post-processing 180*o* configured to perform a post-processing on the basis of a combined audio signal 180*n* provided by the overlapper/adder 180*m*.

The time warp contour information 258 serves as an input information for the context state determinator 170, which is configured to adapt the derivation of the context state information 164 in dependence on the time warp contour information 258. Moreover, the sampling position calculator 180*l* of the time-warping frequency-domain-to-time-domain converter 180 also receives the time warp contour information and provides the sampling position information 180*k* on the basis of said time warp contour information 258, to thereby adapt the time varying re-sampling performed by the re-sampler 180*i* in dependence on the time warp contour described by the time warp contour information. Accordingly, a pitch variation is introduced into the time-domain signal described by the time-domain representation 180*f* in accordance with the time warp contour described by the time warp contour information 258. Thus, it is possible to provide a time-domain representation 180*j* of an audio signal having a significant pitch variation over time (or a significant change of the fundamental frequency over time) on the basis of a sparse spectrum 180*d* having pronounced peaks and valleys. Such a spectrum can be encoded with high bitrate efficiency and consequently results in a comparatively low bitrate demand of the encoded audio signal representation 152.

Moreover, the context (or, more generally, the derivation of the context state information 164) is also adapted in dependence on the time warp contour information 258 using the context state determinator 170. Accordingly, the encoded time warp information 252 is re-used two times and contributes to an improvement of the coding efficiency by allowing for an encoding of a sparse spectrum and by allowing for an adaptation of the context state information to the specific characteristics of the spectrum in the presence of a time warp or of a variation of the fundamental frequency over time.

Further details regarding the functionality of individual components of the audio signal encoder 240 will be described below.

5. Arithmetic Encoder According to FIG. 2*c*

In the following, an arithmetic encoder 290 will be described, which may take the place of the context-based spectral value encoder 130 in combination with the context state determinator 140 in the audio signal encoder 100 or in the audio signal encoder 200. The arithmetic encoder 290 is configured to receive spectral values 291 (for example, spectral values of the frequency domain representation 124) and to provide codewords 292*a*, 292*b* on the basis of these spectral values 291.

In other words, the arithmetic encoder 290 may, for example be configured to receive a plurality of post-processed and scaled and quantized spectral values 291 of the frequency-domain audio representation 124. The arithmetic encoder comprises a most-significant bit-plane extractor 290*a*, which is configured to extract a most-significant bit-plane m from a spectral value. It should be noted here that the most-significant bit-plane may comprise one or even more bits (e.g., two or three bits), which are the most-significant bits of the spectral value.

Thus, the most-significant bit-plane extractor 290*a* provides a most-significant bit-plane value 290*b* of a spectral value. The arithmetic encoder 290 also comprises a first codeword determinator 290*c*, which is configured to determine an arithmetic codeword acod_m[pki][m] representing the most-significant bit-plane value m.

Optionally, the first codeword determinator 290*c* may also provide one or more escape codewords (also designated herein with "ARITH_ESCAPE") indicating, for example, how many less-significant bit-planes are available (and, consequently, indicating the numeric weight of the most-significant bit-plane). The first codeword determinator 290*c* may be configured to provide the codeword associated with a most-significant bit-plane value m using a selected cumulative-frequencies-table having (or being referenced by) a cumulative-frequencies-table index pki.

In order to determine as to which cumulative-frequencies-table should be selected, the arithmetic encoder comprises a state tracker 290*d* which may, for example, take the function of the context state determinator 140. The state tracker 290*d* is configured to track the state of the arithmetic encoder, for example, by observing which spectral values have been encoded previously. The state tracker 290*d* consequently provides a state information 290*e* which may be equivalent to the context state information 134, for example, in the form of a state value designated with "s" or "t" sometimes (wherein the state value s should not be mixed up with the frequency stretching factor s).

The arithmetic encoder 290 also comprises a cumulative-frequencies-table selector 290*f*, which is configured to receive the state information 290*e* and to provide an information 290*g* describing the selected cumulative-frequencies-table to the codeword determinator 290*c*. For example, the cumulative-frequencies-table selector 290*f* may provide a cumulative-frequencies-table index "pki" describing which cumulative-frequencies-table, out of a set of, for example, 64 cumulative-frequencies-tables, is selected for usage by the codeword determinator 290*c*. Alternatively, the cumulative-frequencies-table selector 290*f* may provide the entire selected cumulative-frequencies-table to the codeword determinator 290*c*. Thus, the codeword determinator 290*c* may use the selected cumulative-frequencies-table for the provision of the codeword acod_m[pki][m] of the most significant bit-plane value m, such that the actual codeword acod_m[pki][m] encoding the most significant bit-plane value m is dependent on the value of m and the cumulated-frequencies-table index pki, and consequently on the current state information 290*e*. Further details regarding the coding process and the obtained codeword format will be described below. Moreover, details regarding the operation of the state tracker 290*d*, which is equivalent to the context state determinator 140, will be discussed below.

The arithmetic encoder 290 further comprises a less significant bit-plane extractor 290*h*, which is configured to extract one or more less significant bit planes from the scaled and quantized frequency-domain audio representation 291, if one or more of the spectral values to be encoded exceed the range of values encodable using the most significant bit-plane only. The less significant bit-planes may comprise one or more bits, as desired. Accordingly, the less significant bit-plane extractor 290*h* provides a less significant bit-plane information 290*i*.

The arithmetic encoder 290 also comprises a second codeword determinator 290*j*, which is configured to receive the less significant bit-plane information 290*i* and to provide, on the basis thereof, zero, one or even more codewords "acod_r" representing the content of zero, one or more less significant bit-planes. The second codeword determinator 290*j* may be configured to apply an arithmetic encoding algorithm or any other encoding algorithm in order to derive the less significant bit-plane codeword "acod_r" from the less significant bit-plane information 290*i*.

It should be noted here that the number of less significant bit planes may vary in dependence on the value of the scaled and quantized spectral values 291, such that there may be no less significant bit-planes at all, if the scaled and quantized spectral value to be encoded is comparatively small, such that there may be one less significant bit-plane if the current scaled and quantized spectral value to be encoded is of a medium range and such that there may be more than one less significant bit-plane if the scaled and quantized spectral value to be encoded takes a comparatively large value.

To summarize the above, the arithmetic encoder 290 is configured to encode scaled and quantized spectral values, which are described by the information 291, using a hierarchical encoding process. The most significant bit-plane (comprising, for example, one, two or three bits per spectral value) is encoded to obtain an arithmetic codeword "acod_m [pki][m]" of a most significant bit-plane value. One or more less significant bit-planes (each of the less significant bit-planes comprising, for example, one, two or three bits) are encoded to obtain one or more codewords "acod_r". When encoding the most significant bit-plane, the value m of the most significant bit-plane is mapped to a codeword acod_m [pki][m]. 64 different cumulative-frequencies-tables are available for the encoding of the value m in dependence on a state of the arithmetic encoder 170, i.e. in dependence on previously encoded spectral values. Accordingly, the codeword "acod_m[pki][m]" is obtained. In addition, one or more codewords "acod_r" are provided and included into the bitstream if one or more less significant bit-planes are present.

However, in accordance with the present invention, the derivation of the state information 290*e*, which is equivalent to the context state information 134, is adapted to changes of a fundamental frequency from a first audio frame to a subsequent second audio frame (i.e. between two subsequent audio frames). Details regarding this adaptation, which may be performed by the state tracker 290*d*, will be described below.

6. Arithmetic Decoder According to FIG. 2*d*

Figure 2D:
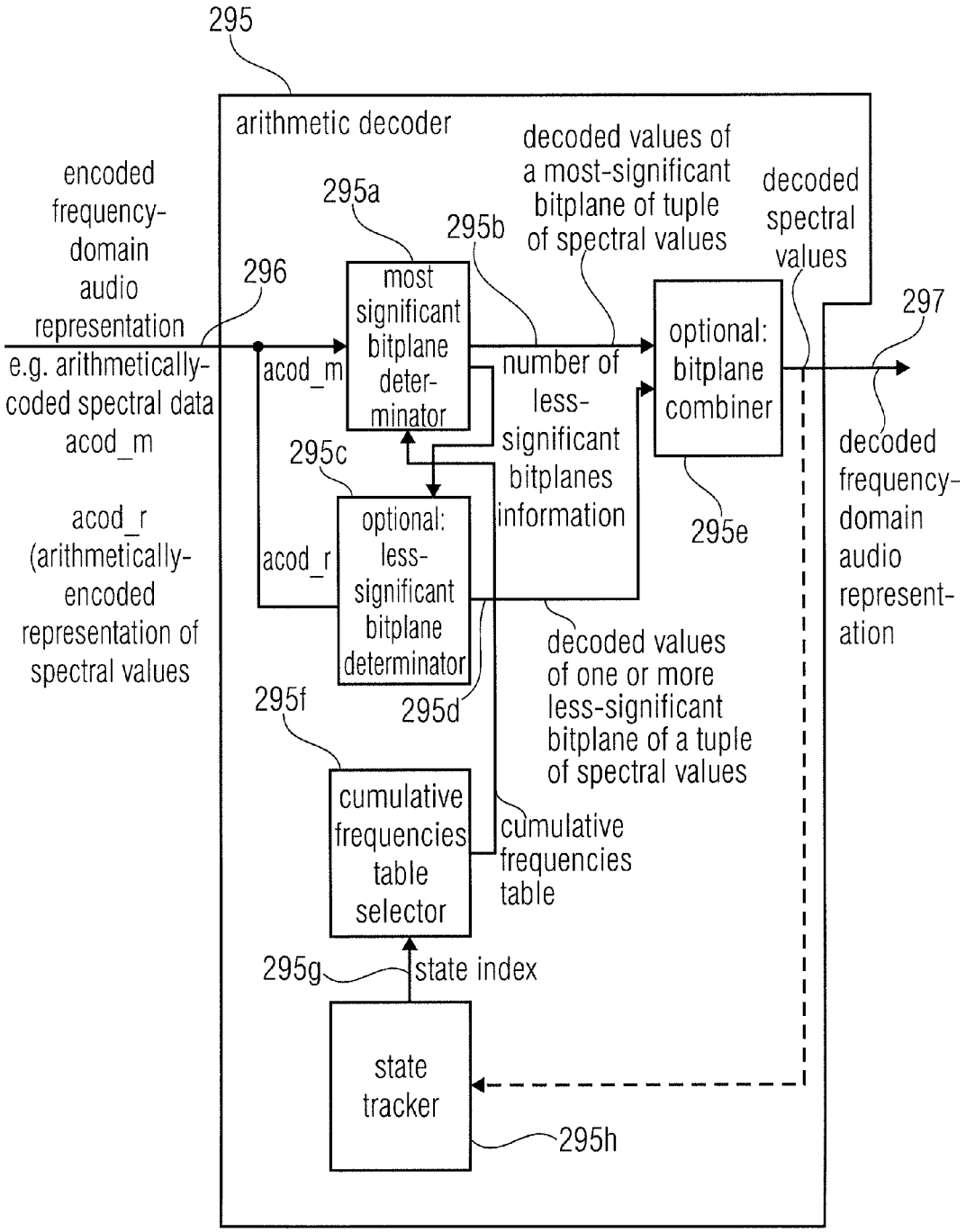
FIG. 2*d* shows a block schematic diagram of an arithmetic decoder for use in the audio signal decoders according to the embodiments of the invention.

FIG. 2*d* shows a block schematic diagram of an arithmetic decoder 295, which may take the place of the context-based spectral value decoder 160 and of the context state determinator 170 in the audio signal decoder 150 according to FIG. 1*d* and the audio signal decoder 240 according to FIG. 2*b*.

The arithmetic decoder 295 is configured to receive an encoded frequency-domain representation 296, which may comprise, for example, arithmetically coded spectral data in the form of codewords "acod_m" and "acod_r". The encoded frequency-domain representation 296 may be equivalent to the codewords input into the context based spectral value decoder 160. Moreover, the arithmetic decoder is configured to provide a decoded frequency-domain audio representation 297, which may be equivalent to the decoded spectral values 162 provided by the context based spectral value decoder 160.

The arithmetic decoder 295 comprises a most significant bit-plane determinator 295*a*, which is configured to receive the arithmetic codeword acod_m[pki][m] describing the most significant bit-plane value m. The most significant bit-plane determinator 295*a* may be configured to use a cumulative-frequencies-table out of a set comprising a plurality of, for example, 64 cumulative-frequencies-tables for deriving the most significant bit-plane value m from the arithmetic codeword "acod_m[pki][m]".

The most significant bit-plane determinator 295*a* is configured to derive values 295*b* of a most significant bit-plane of spectral values on the basis of the codeword "acod_m". The arithmetic decoder 295 further comprises a less-significant bit-plane determinator 295*c*, which is configured to receive one or more codewords "acod_r" representing one or more less significant bit-planes of a spectral value. Accordingly, the less significant bit-plane determinator 295*c* is configured to provide decoded values 295*d* of one or more less significant bit-planes. The arithmetic decoder 295 also comprises a bit-plane combiner 295*e*, which is configured to receive the decoded values 295*b* of the most significant bit-plane of the spectral values and the decoded values 295*b* of one or more less significant bit-planes of the spectral values if such less significant bit-planes are available for the current spectral values. Accordingly, the bit-plane combiner 295*e* provides the coded spectral values, which are part of the decoded frequency-domain audio representation 297. Naturally, the arithmetic decoder 295 is typically configured to provide a plurality of spectral values in order to obtain a full set of decoded spectral values associated with a current frame of the audio content.

The arithmetic decoder 295 further comprises a cumulative-frequencies-table selector 295*f*, which is configured to select, for example, one of the 64 cumulative-frequencies-tables in dependence on a state index 295*g* describing a state of the arithmetic decoder 295. The arithmetic decoder 295 further comprises a state tracker 295*h*, which is configured to track a state of the arithmetic decoder in dependence on the previously decoded spectral values. The state tracker 295*h* may correspond to the context state determinator 170. Details regarding the state tracker 295*h* will be described below.

Accordingly, the cumulative-frequencies-tables selector 295*f* is configured to provide an index (for example, pki) of a selected cumulative-frequencies-table, or a selected cumulative-frequencies-table itself, for application in the decoding of the most significant bit-plane value m in dependence on the codeword "acod_m".

Accordingly, the arithmetic decoder 295 exploits different probabilities of different combinations of values of the most significant bit-plane of adjacent spectral values. Different cumulative-frequencies-tables are selected and applied in dependence on the context. In other words, statistic dependencies between spectral values are exploited by selecting different cumulative-frequencies-tables, out of a set comprising, for example, 64 different cumulative-frequencies-tables, in dependence on a state index 295*g* (which may be equivalent to the context state information 164), which is obtained by observing the previously decoded spectral values. A spectral scaling is considered by adapting the derivation of the state index 295*g* (or of the context state information 164) in dependence on an information about a change of a fundamental frequency (or of a pitch) between the subsequent audio frames.

7. Overview over the Concept of Adapting the Context

In the following, an overview will be given over the concept of adapting the context of an arithmetic coder using the time warp information.

7.1 Background Information

In the following, some background information will be provided in order to facilitate the understanding of the present invention. It should be noted that in Reference [3] a context adaptive arithmetic coder (see, for example, Reference [5]) is used to losslessly code the quantized spectral bins.

Figure 3A:
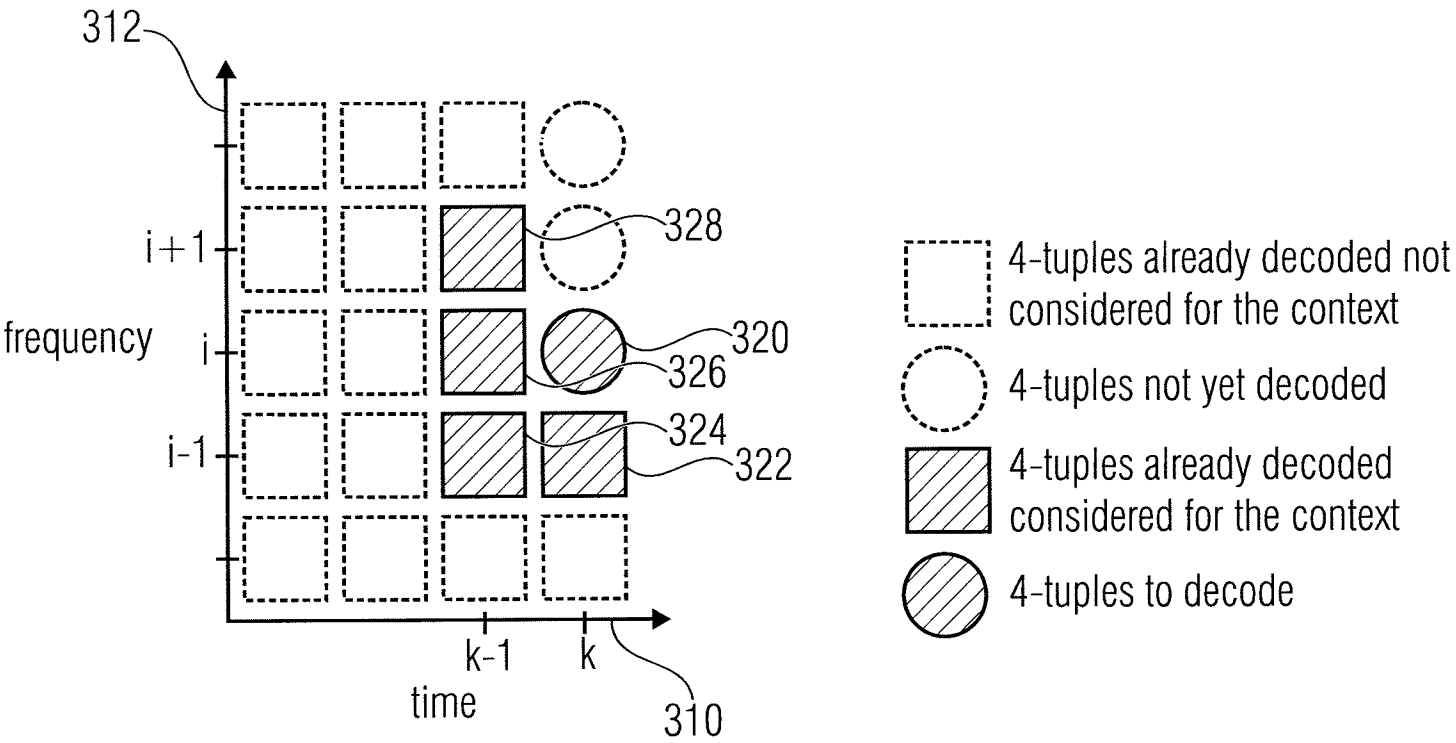
FIG. 3*a* shows a graphical representation of a context adaptive arithmetic coding (encoding/decoding)

The context used is described in FIG. 3*a*, which shows a graphic representation of such a context adaptive arithmetic coding. In FIG. 3*a*, it can be seen that already decoded bins from the previous frame are used to determine the context for the frequency bins that are to be decoded. It should be noted here that it does not matter for the described invention if the context and coding is organized in four-tuples or line-wise or other n-tuples, where n may vary.

Taking reference again to FIG. 3*a*, which shows a context adaptive arithmetic coding or decoding, it should be noted that an abscissa 310 describes a time and that an ordinate 312 describes a frequency. It should be noted here that four-tuples of spectral values are decoded using a common context state in accordance with the context shown in FIG. 3*a*. For example, a context for a decoding of a four-tuple 320 of spectral values associated with an audio frame having time index k and frequency index i is based on spectral values of a first four-tuple 322 having time index k and frequency index i−1, a second four-tuple 324 having time index k−1 and frequency index i−1, a third four-tuple 326 having time index k−1 and frequency index i and a fourth four-tuple 328 having time index k−1 and frequency index i+1. It should be noted that each of the frequency indices i−1, i, i+1 designates (or, more precisely, is associated with) four frequency bins of the time-domain-to-frequency-domain-conversion or frequency-domain-to-time-conversion. Accordingly, the context for the decoding of the four-tuple 320 is based on the spectral values of the four-tuples 322, 324, 326, 328 of spectral values. Accordingly, the spectral values having tuple frequency indices i−1, i and i+1 of the previous audio frame having time index k−1 are used for deriving the context for the decoding of the spectral values having tuple frequency index i of the current audio frame having time index k (typically in combination with the spectral values having tuple frequency index i−1 of the currently decoded audio frame having time index k).

It has been found that the time-warped transform typically leads to better energy compaction for harmonic signals with variations in the fundamental frequencies, leading to spectra which exhibit a clear harmonic structure instead of more or less smeared higher partials which would occur if no time warping was applied. One other effect of the time warping is caused by the possible different average local sampling frequencies of consecutive frames. It has been found that this effect causes the consecutive spectra of a signal with an otherwise constant harmonic structure but varying fundamental frequency to be stretched along the frequency axis.

Figure 3B:
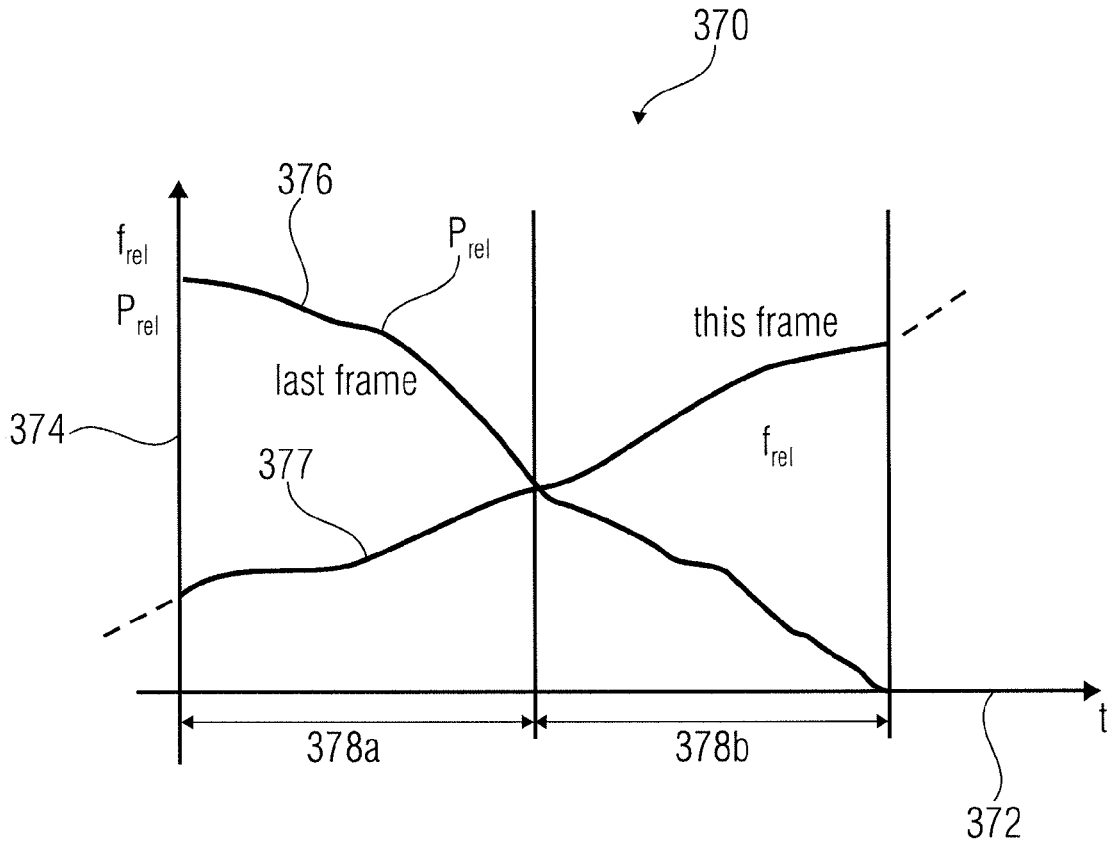
FIG. 3*b* shows a graphic representation of relative pitch contours.
Figure 3C:
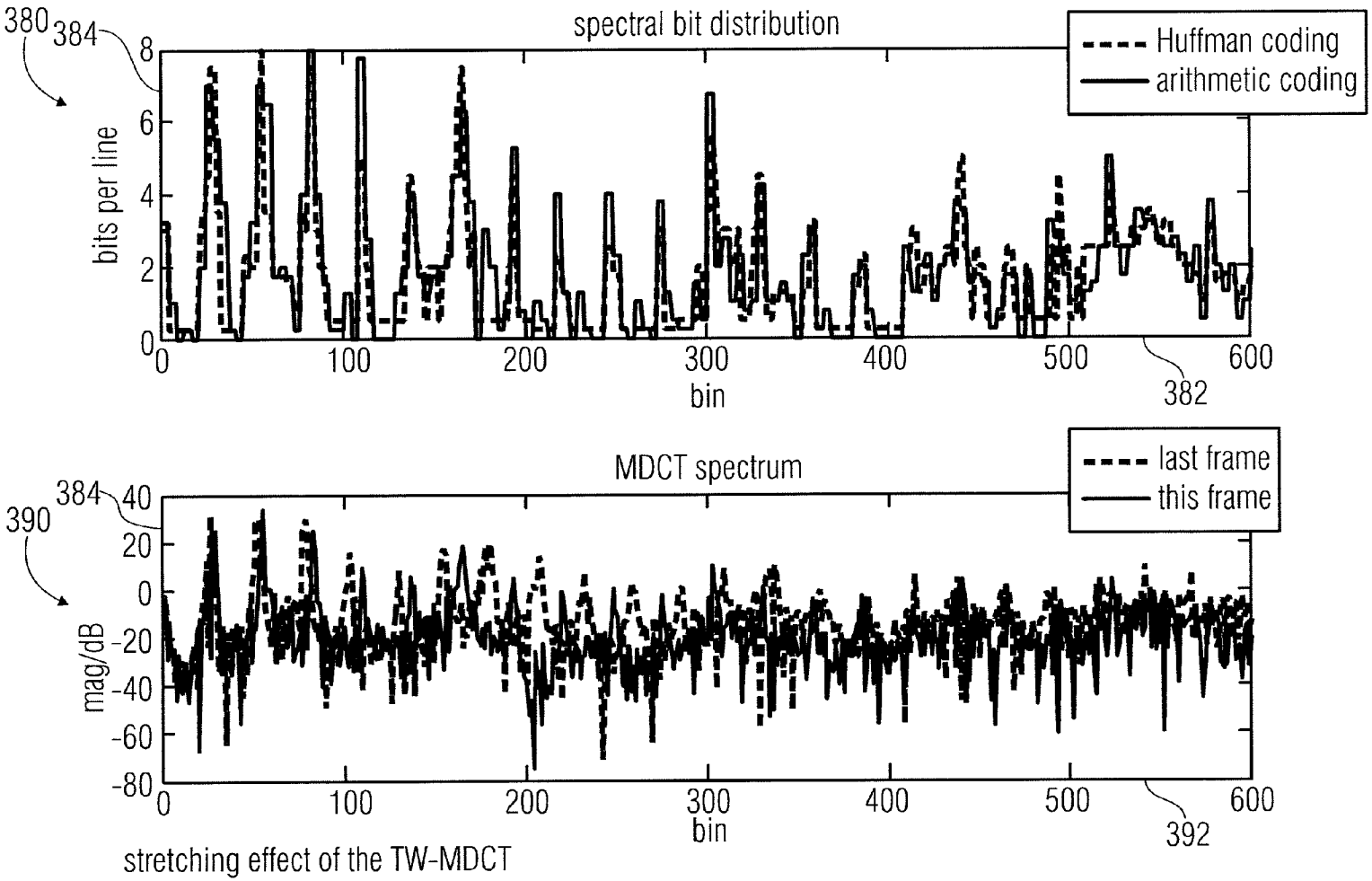
FIG. 3*c* shows a graphic representation of a stretching effect of the time-warped modified discrete cosine transform (TW-MDCT)

A lower plot 390 of FIG. 3*c* shows such an example. It contains the plots (for example, of a magnitude in dB as a function of a frequency bin index) of two consecutive frames (for example, frames designated as "last frame" and "this frame", where a harmonic signal with a varying fundamental frequency is coded by a time-warped-modified-discrete-cosine-transform coder (TW-MDCT coder).

The corresponding relative pitch evolution can be found in a plot 370 of FIG. 3*b*, which shows a decreasing relative pitch and therefore an increasing relative frequency of the harmonic lines.

This leads to an increased frequency of the harmonic lines after application of the time warp algorithm (for example, the time warping sampling or re-sampling). It can clearly be seen that this spectrum of the current frame (also designated as "this frame") is an approximate copy of the spectrum of the last frame, but stretched along the frequency axis 392 (labeled in terms of frequency bins of the modified discrete cosine transform). This would also mean that, if we used the past frame (also designated as "last frame") as a context for the arithmetic coder (for example, for the decoding of the spectral values of the current frame (which is also designated as "this frame"), the context would be sub-optimal since matching partials would now occur in different frequency bins.

An upper plot 380 of FIG. 3*c* shows this (e.g., a bit demand for encoding spectral values using a context-dependent arithmetic coding) in comparison to a Huffman coding scheme which is normally considered less effective than an arithmetic coding scheme. Due to the sub-optimal past context (which may, for example, be defined by the spectral values of the "last frame", which are represented in plot the 390 of FIG. 3*c*), the arithmetic coding scheme is spending more bits where partial tones of the current frame are situated in areas with low energy in the past frame and vice versa. On the other hand, the plot 380 of FIG. 3*c* shows that, if the context is good, which at least is the case for the fundamental partial tone, the bit distribution is lower (for example, when using a context-dependent arithmetic coding) than with the Huffman coding in comparison.

To summarize the above, plot 370 of FIG. 3*b* shows an example of a temporal evolution of a relative pitch contour. An abscissa 372 describes the time and an ordinate 374 describes both, a relative pitch $p_{rel}$ and a relative frequency $f_{rel}$. A first curve 376 describes a temporal evolution of the relative pitch, and a second curve 377 describes a temporal evolution of the relative frequency. As can be seen, the relative pitch decreases over time, while the relative frequency increases over time. Moreover, it should be noted that a temporal extension 378*a* of a previous frame (also designated as "last frame") and a temporal extension 378*b* of a current frame (also designated as "this frame") are non-overlapping in the plot 370 of FIG. 3*b*. However, typically, temporal extensions 378*a*, 378*b* of subsequent audio frames may be overlapping. For example, the overlap may be approximately 50%.

Taking reference now to FIG. 3*c*, it should be noted that the plot 390 shows MDCT spectra for two subsequent frames. An abscissa 392 describes the frequency in terms of frequency bins of the modified-discrete-cosine-transform. An ordinate 394 describes a relative magnitude (in terms of decibels) of the individual spectral bins. As can be seen, spectral peaks of the spectrum of the current frame ("this frame") are shifted in frequency (in a frequency-dependent manner) with respect to corresponding spectral peaks of the spectrum of the previous frame ("last frame"). Accordingly, it has been found that a context for the context-based encoding of the spectral values of the current frame is not well-adapted if said context is formed on the basis of the original version of the spectral values of the previous audio frame, because the spectral peaks of the spectrum of the current frame do not coincide (in terms of frequency) with the spectral peaks of the spectrum of the previous audio frame. Thus, a bitrate demand for the context-based encoding of the spectral values is comparatively high, and may be even higher than in the case of a non-context-based Huffman coding. This can be seen in the plot 380 of FIG. 3*c*, wherein an abscissa describes the frequency (in terms of bins of the modified-discrete-cosine-transform), and wherein an ordinate 384 describes a number of bits necessitated for the encoding of the spectral values.

7.2. Discussion of the Solution

However, embodiments according to the present invention provide for a solution to the above-discussed problem. It has been found that the pitch variation information can be used to derive an approximation of the frequency-stretching factor between consecutive spectra of a time-warped-modified-discrete-cosine-transform coder (e.g., between spectra of consecutive audio frames). It has been found that this stretching factor can then be used to stretch the past context along the frequency axis to derive a better context and to therefore reduce the number of bits needed to code one frequency line and increase the coding gain.

It has been found that good results can be achieved if this stretching factor is approximately the ratio of the average frequencies of the last frame and of the current frame. Moreover, it has been found that it might be done line-wise, or, if the arithmetic coder codes n-tuples of lines as one item, tuple-wise.

In other words, the stretching of the context may be done line-wise (i.e., individually per frequency bin of the modified-discrete-cosine-transform) or tuple-wise (i.e. per tuple or set of a plurality of spectral bins of the modified-discrete-cosine-transform).

Moreover, the resolution for the computation of the stretching factor may also vary in dependence on the requirements of the embodiments.

7.3 Examples for Deriving the Stretching Factor

In the following, some concepts for deriving the stretching factor will be described in detail. The time-warped-modified-discrete-cosine-transform method described in reference [3], and, alternatively, the time-warped-modified-discrete-cosine-transform method described herein, provides a so-called smooth pitch contour as an intermediate information. This smoothed pitch contour (which may, for example, be described by the entries of the array "warp_contour[ ]", or by the entries of the arrays "new_warp_contour[ ]" and "past_warp_contour[ ]") contains the information of the evolution of the relative pitch over several consecutive frames, so that, for each sample within one frame, an estimation of the relative pitch is known. The relative frequency for this sample is then simply the inverse of this relative pitch.

For example, the following relationship may hold:

$$f_{rel}[n] = \frac{1}{p_{rel}[n]}$$

In the above equation, $p_{rel}[n]$ designates the relative pitch for a given time index n, which may be a short-term relative pitch (wherein the time index n may, for example, designate an individual sample). Moreover, $f_{rel}[n]$ may designate a relative frequency for the time index n, and may be a short-term relative frequency value.

7.3.1 First Alternative

The average relative frequency over one frame k (wherein k is a frame index) can then be described as an arithmetic mean over all relative frequencies within this frame k:

$$f_{rel,mean,k} = \frac{1}{N}\sum_{n=0}^{N-1} f_{rel}[n]$$

In the above equation $f_{rel,mean,k}$ designates the average relative frequency over the audio frame having temporal frame index k. N designates a number of time-domain samples for the audio frame having the temporal frame index k. n is a variable running over the time-domain sample indices n=0 to n=N−1 of the time-domain samples of the current audio frame having audio frame index k. $f_{rel}[n]$ designates the local relative frequency value associated with the time-domain sample having a time-domain sample time index n.

From this (i.e. from the computation of $f_{rel,mean,k}$ for the current audio frame, and from the computation of $f_{rel,mean,k-1}$ for the previous audio frame), the stretching factor s for the current audio frame k can then be derived as:

$$s = \frac{f_{rel,mean,k}}{f_{rel,mean,k-1}}$$

7.3.2 Second Alternative

In the following, another alternative for the computation of the stretching factor s will be described. A simpler and less exact approximate of the stretching factor s (for example, when compared to the first alternative) can be found if it is taken into consideration that, on average, the relative pitch is close to one, so that the relation of relative pitch and relative frequency is approximately linear, and so that the step of inverting the relative pitch to obtain the relative frequency can be omitted, and using the mean relative pitch:

$$p_{rel,mean,k} = \frac{1}{N}\sum_{n=0}^{N-1} p_{rel}[n]$$

In the above equation, $p_{rel,mean,k}$ designates a mean relative pitch for the audio frame having temporal audio frame index k. N designates a number of time-domain samples of the audio frame having temporal audio frame index k. Running variable n takes values between 0 and N−1 and thereby runs over the time-domain samples having temporal indices n of the current audio frame. $p_{rel}[n]$ designates a (local) relative pitch value for the time-domain sample having time-domain index n. For example, the relative pitch value $p_{rel}[n]$ may be equal to the entry warp_contour[n] of the warp contour array "warp_contour[ ]".

In this case, the stretching factor s for the audio frame having temporal frame k can be approximated as:

$$s = \frac{p_{rel,mean,k-1}}{p_{rel,mean,k}}$$

In the above equation $p_{rel,mean,k-1}$ designates an average pitch value for the audio frame having temporal audio frame index k−1, and the variable $p_{rel,mean,k}$ describes an average relative pitch value for the audio frame having temporal audio frame k.

7.3.3 Further Alternatives

However, it should be noted that significantly different concepts for the computation, or estimation, of the stretching factor s may be used, wherein the stretching factor s typically also describes a change of the fundamental frequency between the first audio frame and a subsequent second audio frame. For example, the spectra of the first audio frame and of the subsequent second audio frame may be compared by means of a pattern comparison concept, to thereby derive the stretching factor. Nevertheless, it appears that the computation of the frequency stretching factor s using the warp contour information, as discussed above, is computationally particularly efficient, such that this is an advantageous option.

8. Details Regarding the Context State Determination 8.1. Example According to FIGS. 4*a* and 4*b*

Figure 4A:
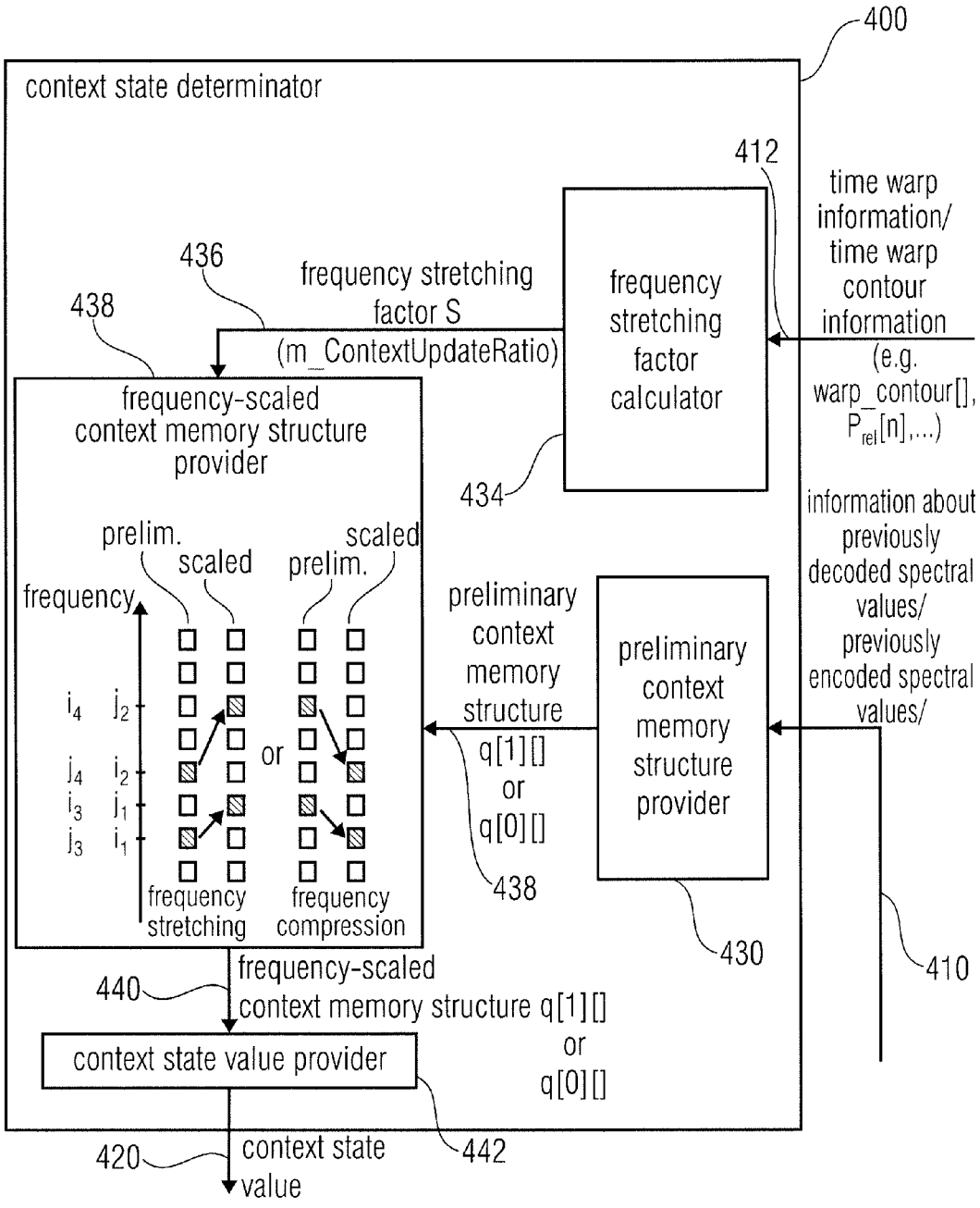
FIG. 4*a* shows a block schematic diagram of a context state determinator for use in the audio signal encoders and audio signal decoders according to the embodiments of the present invention.

In the following, details regarding the determination of the context state will be described. For this purpose, the functionality of the context state determinator 400, a block schematic diagram of which is shown in FIG. 4*a*, will be described.

The context state determinator 400 may, for example, take the place of the context state determinator 140 or of the context state determinator 170. Even though details regarding the context state determinator will be described in the following for the case of an audio signal decoder, the context state determinator 400 may also be used in the context of an audio signal encoder.

The context state determinator 400 is configured to receive an information 410 about previously decoded spectral values or about previously encoded spectral values. In addition, the context state determinator 400 receives a time warp information or time warp contour information 412. The time warp information or time warp contour information 412 may, for example, be equal to the time warp information 122 and may, consequently, describe (at least implicitly) a change of a fundamental frequency between subsequent audio frames. The time warp information or time warp contour information 412 may, alternatively, be equivalent to the time warp information 184 and may, consequently, describe a change of a fundamental frequency between subsequent frames. However, the time warp information/time warp contour information 412 may, alternatively, be equivalent to the time warp contour information 222 or to the time warp contour information 258. Generally, speaking it can be said that the time warp information/time warp contour information 412 may describe the frequency variation between subsequent audio frames directly or indirectly. For example, the time warp information/time warp contour information 212 may describe the warp contour and may, consequently, comprise the entries of the array "warp_contour[ ]", or may describe the time contour, and may, consequently, comprise the entries of the array "time_contour[ ]".

The context state determinator 400 provides a context state value 420, which describes the context to be used for the encoding or decoding of the spectral values of the current frame, and which may be used by the context based spectral value encoder or context based spectral decoder for the selection of an appropriate mapping rule for the encoding or decoding of the spectral values of the current audio frame. The context state value 420 may, for example, be equivalent to the context state information 134 or to the context state information 164.

The context state determinator 400 comprises a preliminary context memory structure provider 430, which is configured to provide a preliminary context memory structure 432 like, for example, the array q[1][ ]. For example, the preliminary context memory structure provider 430 may be configured to perform the functionality of the algorithms according to FIGS. 25 and 26, to thereby provide a set of, for example, N/4 entries q[1][i] of the array q[1][ ] (for i=0 to i=M/4−1).

Generally speaking, the preliminary context memory structure provider 430 may be configured to provide the entries of the preliminary context memory structure 432 such that an entry having an entry frequency index i is based on a (single) spectral value having frequency index i, or on a set of spectral values having a common frequency index i. However, the preliminary context memory structure provider 430 is configured to provide the preliminary context memory structure 432 such that there is a fixed frequency index relationship between a frequency index of an entry of the preliminary context memory structure 432 and frequency indices of one or more encoded spectral values or decoded spectral values on which the entry of the preliminary context memory structure 432 is based. For example, said predetermined index relationship may be such that the entry q[1][i] of the preliminary context memory structure is based on the spectral value of the frequency bin having frequency bin index i (or i-const, wherein const is a constant) of the time-domain-to-frequency-domain converter or of the frequency-domain-to-time-domain converter. Alternatively, the entry q[1][i] of the preliminary context memory structure 432 may be based on the spectral values of frequency bins having frequency bin indices 2i -1 and 2i of the time-domain-to-frequency-domain converter or the frequency-domain-to-time-domain converter (or a shifted range of frequency bin indices). Alternatively, however, an index q[1][i] of the preliminary context memory structure 432 may be based on spectral values of frequency bins having frequency bin indices 4i-3, 4i-2, 4i-1 and 4i of the time-domain-to-frequency-domain converter or the frequency-domain-to-time-domain converter (or a shifted range of frequency bin indices). Thus, each entry of the preliminary context memory structure 432 may be associated with a spectral value of a predetermined frequency index or a set of spectral values of predetermined frequency indices of the audio frames, on the basis of which the preliminary context memory structure 432 is set up.

The context state determinator 400 also comprises a frequency stretching factor calculator 434, which is configured to receive the time warp information/time warp contour information 412 and to provide, on the basis thereof, a frequency stretching factor information 436. For example, the frequency stretching factor calculator 434 may be configured to derive a relative pitch information $p_{rel}[n]$ from the entries of the array warp_contour[ ] (wherein the relative pitch information $p_{rel}[n]$ may, for example, be equal to a corresponding entry of the array warp_contour[ ]). Moreover, the frequency stretching factor calculator 434 may be configured to apply one of the above equations to derive the frequency stretching factor information s from said relative pitch information $p_{rel}$ of two subsequent audio frames. Generally speaking, the frequency stretching factor calculator 434 may be configured to provide the frequency stretching factor information (for example, a value s or, equivalently, a value m_ContextUpdateRatio) such that the frequency stretching factor information describes a change of a fundamental frequency between a previously encoded or decoded audio frame and the current audio frame to be encoded or decoded using the current context state value 420.

The context state determinator 400 also comprises a frequency-scaled-context-memory-structure provider, which is configured to receive the preliminary context memory structure 432 and to provide, on the basis thereof, a frequency-scaled-context-memory-structure. For example, the frequency-scaled context memory structure may be represented by an updated version of the array q[1][ ], which may be an updated version of the array carrying the preliminary context memory structure 432.

The frequency-scaled-context-memory-structure provider may be configured to derive the frequency-scaled context memory structure from the preliminary context memory structure 432 using a frequency scaling. In the frequency scaling, a value of an entry having entry index i of the preliminary context memory structure 432 may be copied, or shifted, to an entry having entry index j of the frequency-scaled context memory structure 440, wherein the frequency index i may be different from the frequency index j. For example, if a frequency stretching of the content of the preliminary context memory structure 432 is performed, an entry having entry index $j_1$ of the frequency-scaled context memory structure 440 may be set to the value of an entry having entry index $i_1$ of the preliminary context memory structure 432, and an entry having entry index $j_2$ of the frequency-scaled context memory structure 440 may be set to a value of an entry having entry index $i_2$ of the preliminary context memory structure 432, wherein $j_2$ is larger than $i_2$, and wherein $j_1$ is larger than $i_1$. A ratio between corresponding frequency indices (for example, $j_1$ and $i_1$, or $j_2$ and $i_2$) may take a predetermined value (except for rounding errors). Similarly, if a frequency compression of the content described by the preliminary context memory structure 432 is to be performed by the frequency-scaled context memory structure provider 438, an entry having entry index $j_3$ of the frequency-scaled context memory structure 440 may be set to the value of an entry having entry index $i_3$ of the preliminary context memory structure 432, and an entry having entry index $j_4$ of the frequency-scaled context memory structure 440 may be set to a value of an entry having entry index $i_4$ of the preliminary context memory structure 432. In this case, entry index $j_3$ may be smaller than entry index $i_3$, and entry index $j_4$ may be smaller than entry index $i_4$. Moreover, a ratio between corresponding entry indices (for example, between entry indices $j_3$ and $i_3$, or between entry indices $j_4$ and $i_4$), may be constant (except for rounding errors), and may be determined by the frequency stretching factor information 436. Further details regarding the operation of the frequency-scaled context memory structure provider 440 will be described below.

The context state determinator 400 also comprises a context state value provider 442, which is configured to provide the context state value 420 on the basis of the frequency-scaled context memory structure 440. For example, the context state value provider 442 may be configured to provide a context state value 420 describing the context for the decoding of a spectral value having frequency index $l_0$ on the basis of entries of the frequency-scaled context memory structure 440, frequency indices of which entries are in a predetermined relationship with the frequency index $l_0$. For example, the context state value provider 442 may be configured to provide the context state value 420 for the decoding of the spectral value (or tuple of spectral values) having frequency index $l_0$ on the basis of entries of the frequency-scaled context memory structure 440 having frequency indices $l_0-1$, $l_0$ and $l_0+1$.

Accordingly, the context state determinator 400 may effectively provide the context state value 420 for the decoding of a spectral value (or tuple of spectral values) having frequency index $l_0$ on the basis of entries of the preliminary context memory structure 432 having respective frequency indices smaller than $l_0-1$, smaller than $l_0$ and smaller than $l_0+1$ if a frequency stretching is performed by the frequency-scaled context memory structure provider 438, and on the basis of entries of the preliminary context memory structure 432 having respective frequency indices larger than $l_0-1$, larger than $l_0$ and larger than $l_0+1$, respectively, in the case that a frequency compression is performed by the frequency-scaled context memory structure provider 438.

Thus, the context state determinator 400 is configured to adapt the determination of the context to a change of a fundamental frequency between subsequent frames by providing the context state value 420 on the basis of a frequency-scaled context memory structure, which is a frequency-scaled version of the preliminary context memory structure 432, frequency-scaled in dependence on the frequency stretching factor 436, which in turn describes a variation of the fundamental frequency over time.

Figure 4B:
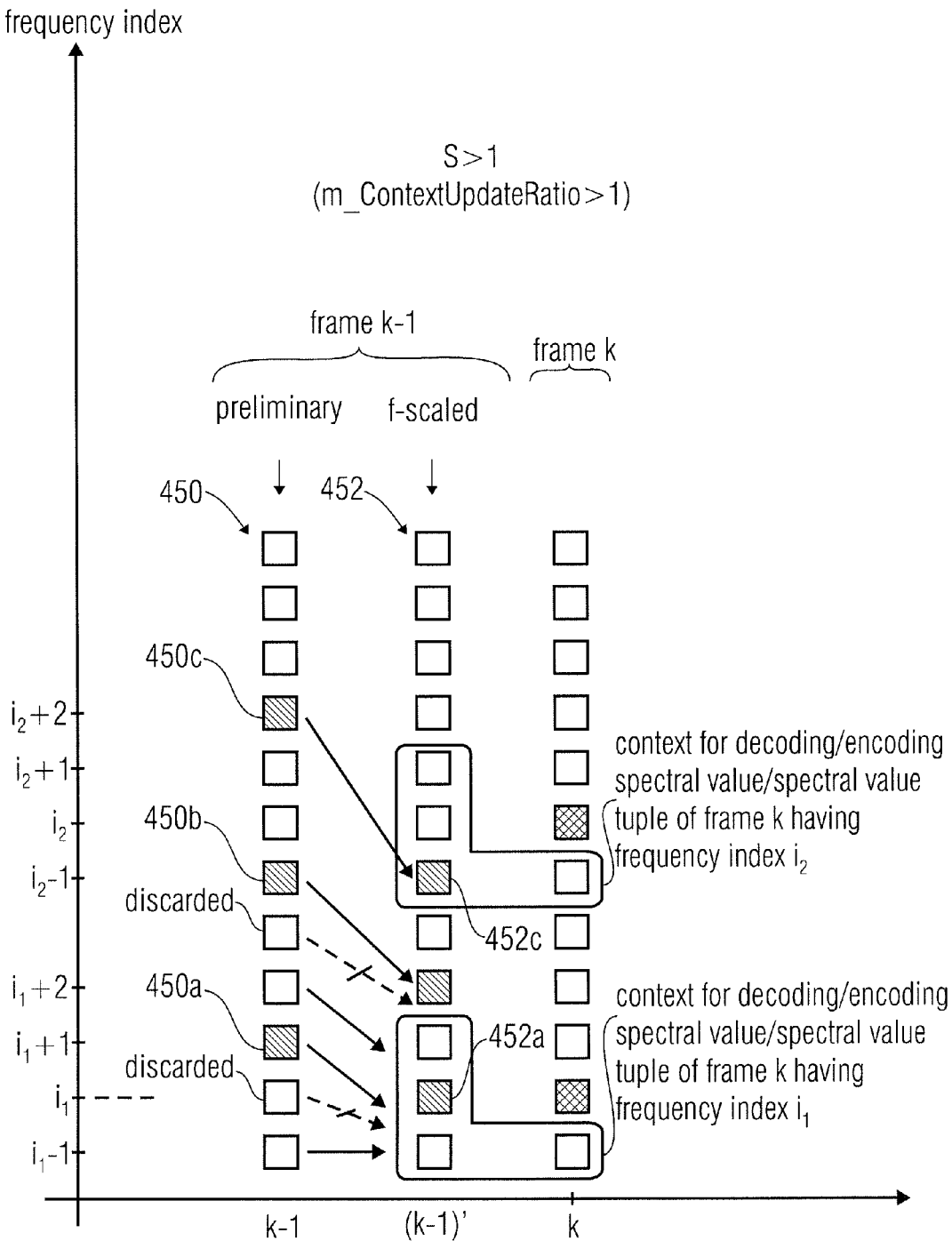
FIG. 4*b* shows a graphic representation of a frequency compression of the context, which may be performed by the context state determinator according to FIG. 4*a;*
Figure 5A:
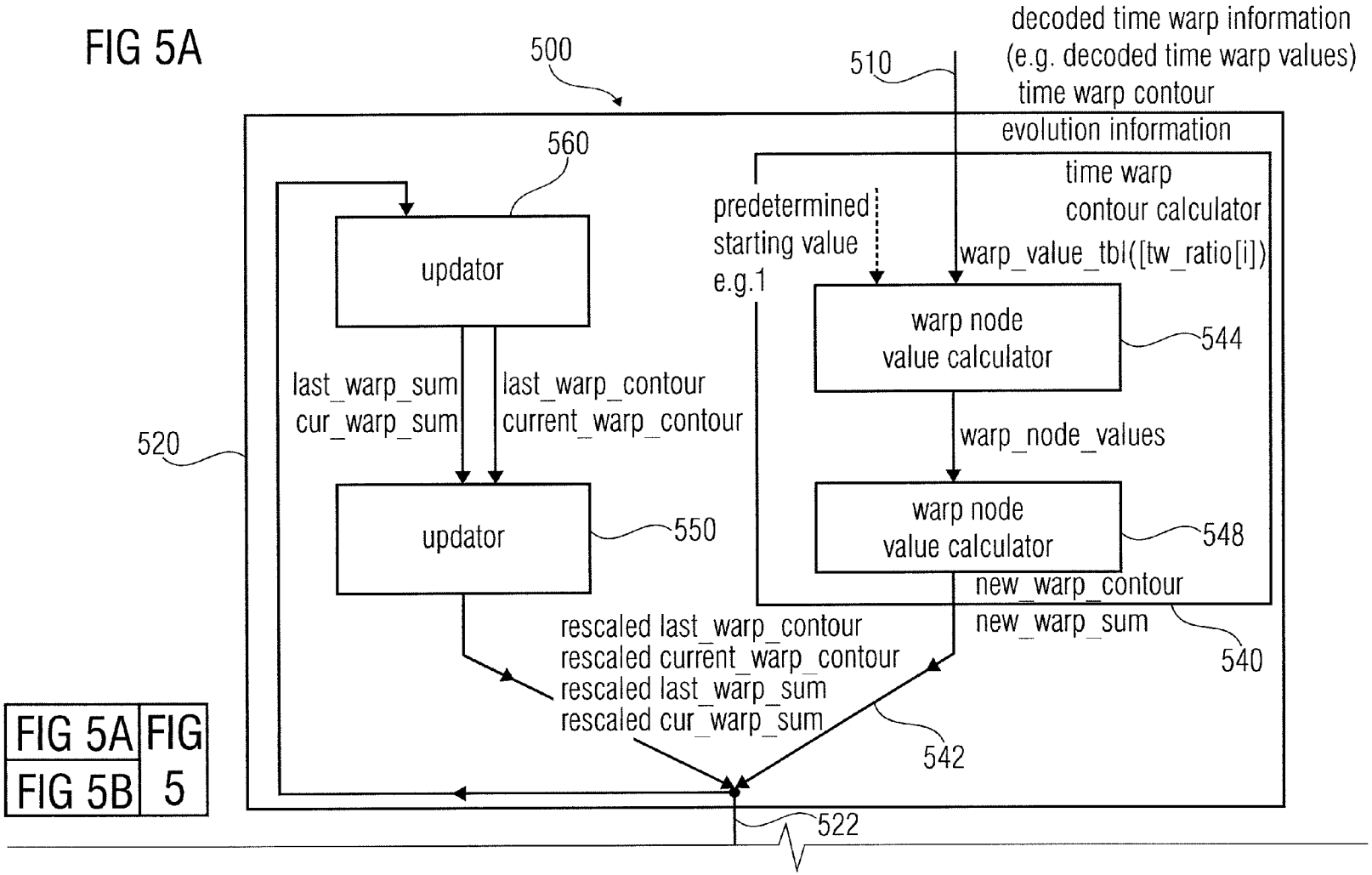
FIGS. 5*a*, 5*b* show a detailed extract from a block schematic diagram of an audio signal decoder, according to an embodiment of the invention.
Figure 5B:
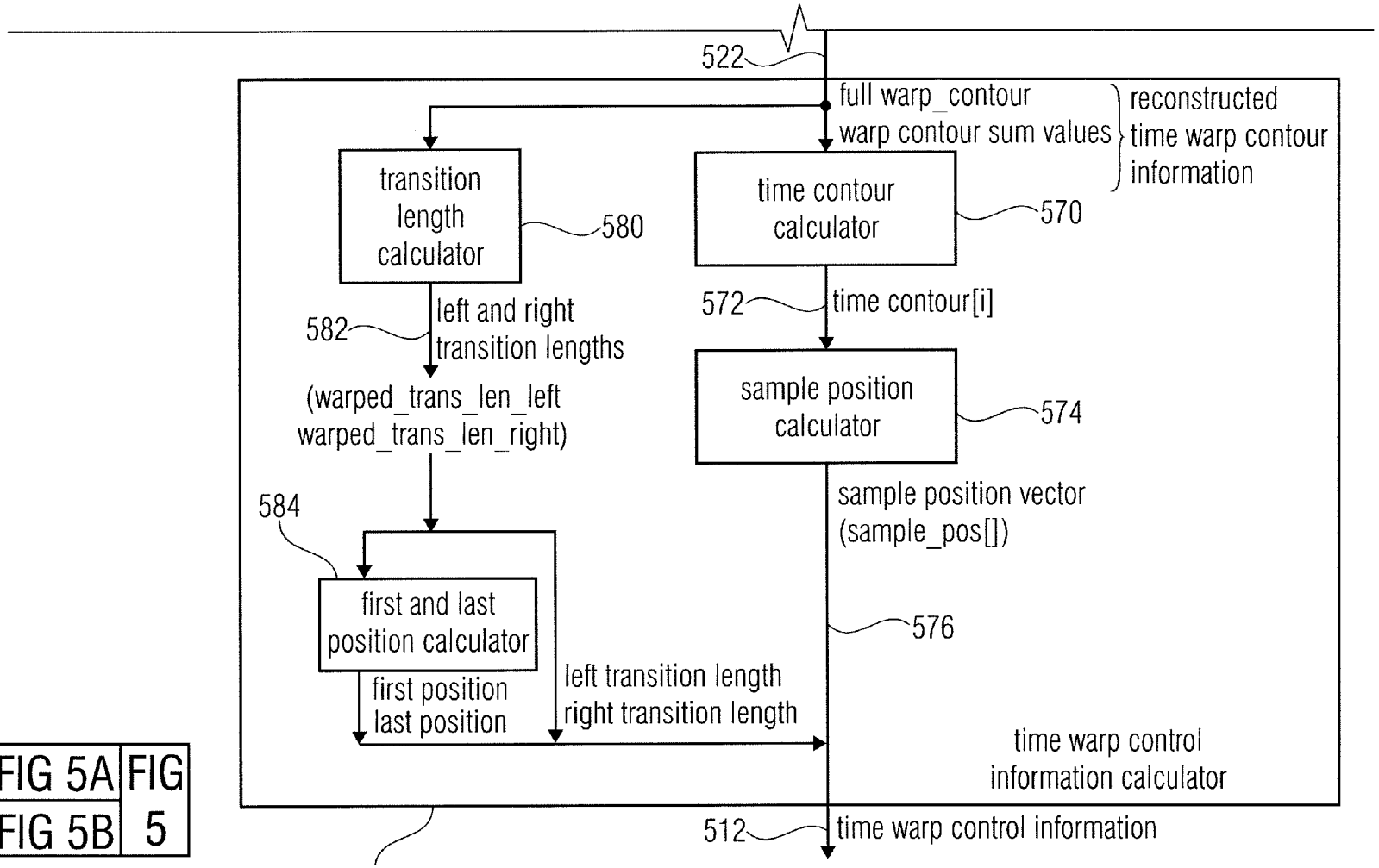
Figure 6A:
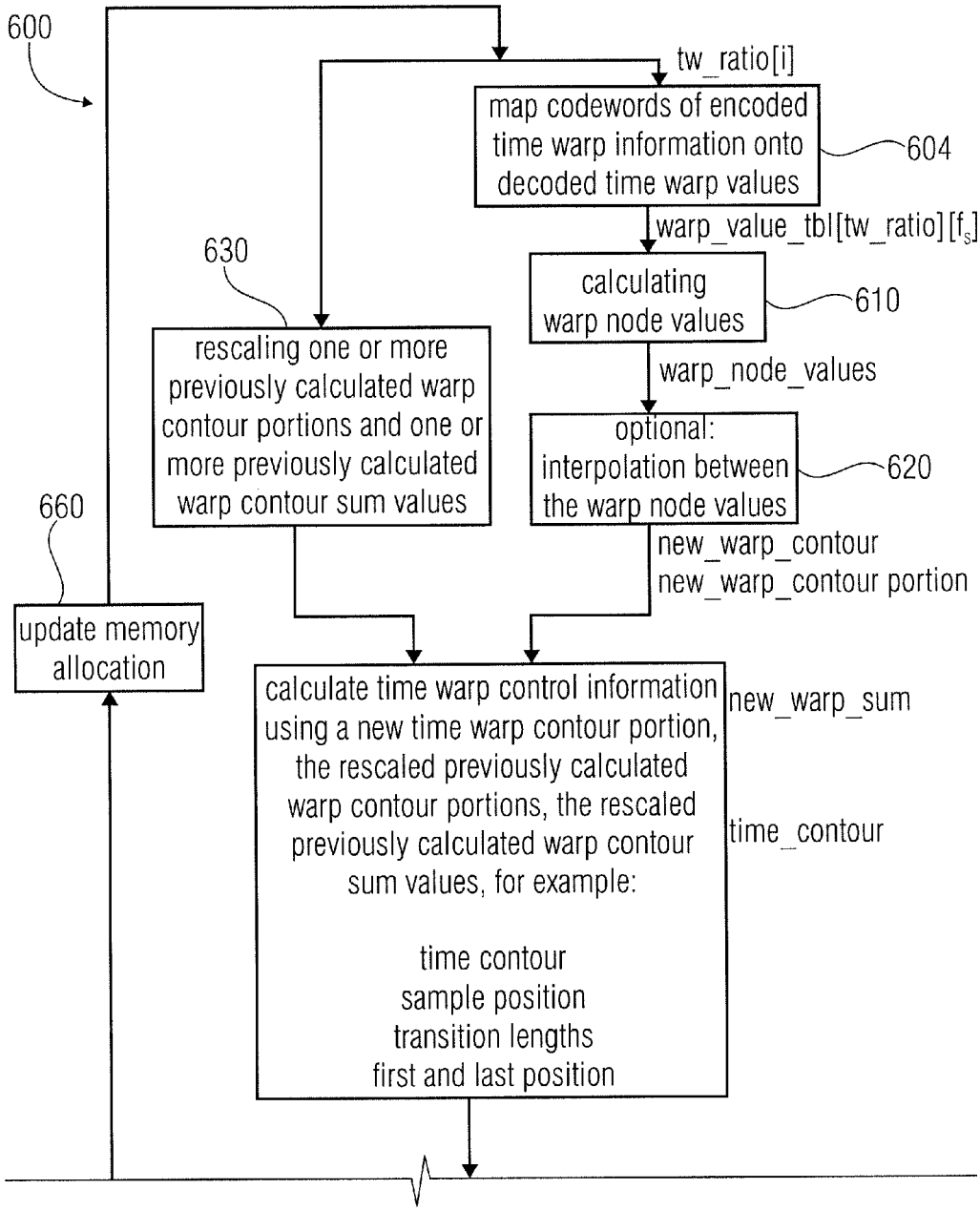
FIGS. 6*a*, 6*b* show a detailed extract of a flowchart of a mapper for providing a decoded audio signal representation, according to an embodiment of the invention.
Figure 6B:
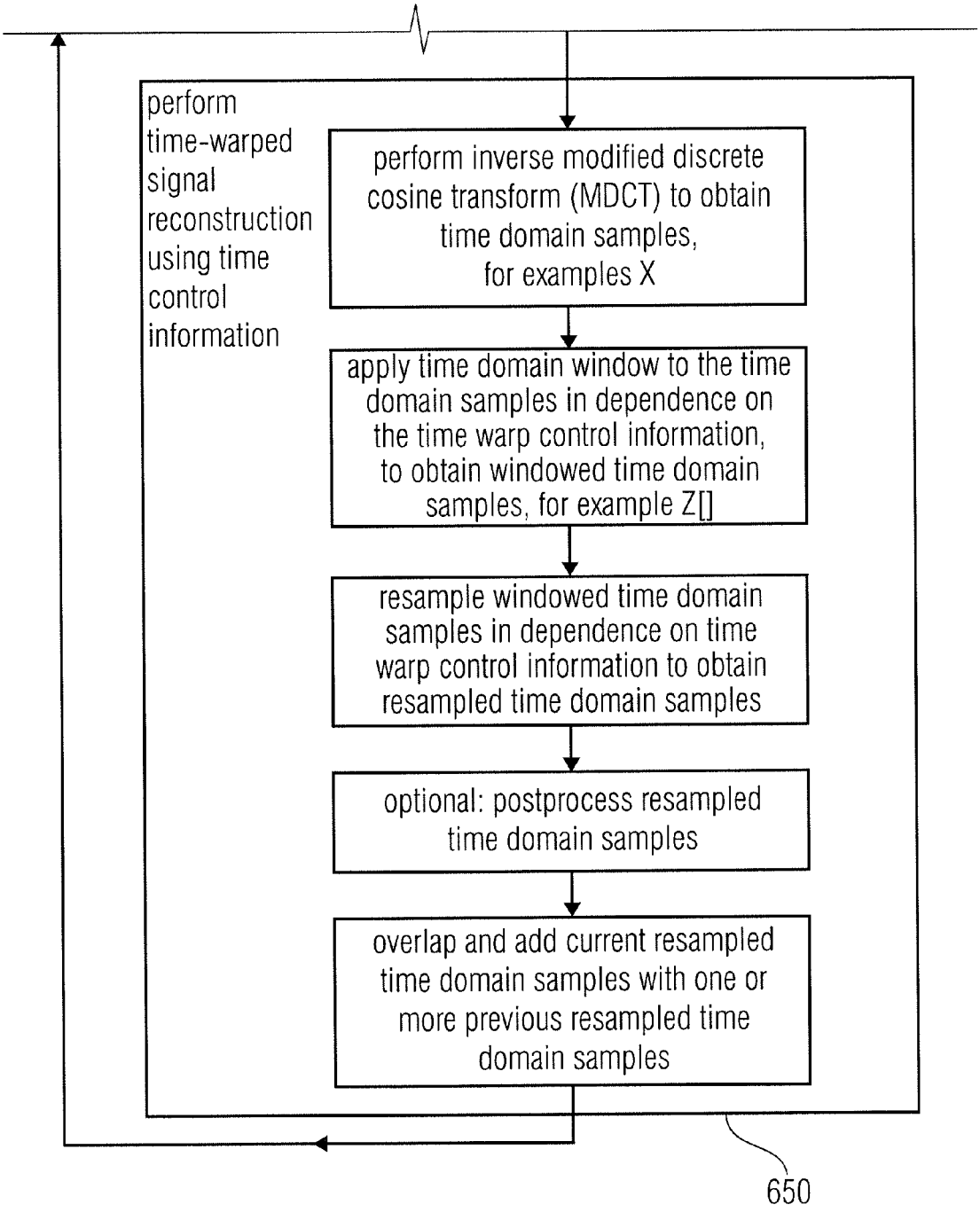
Figure 17:
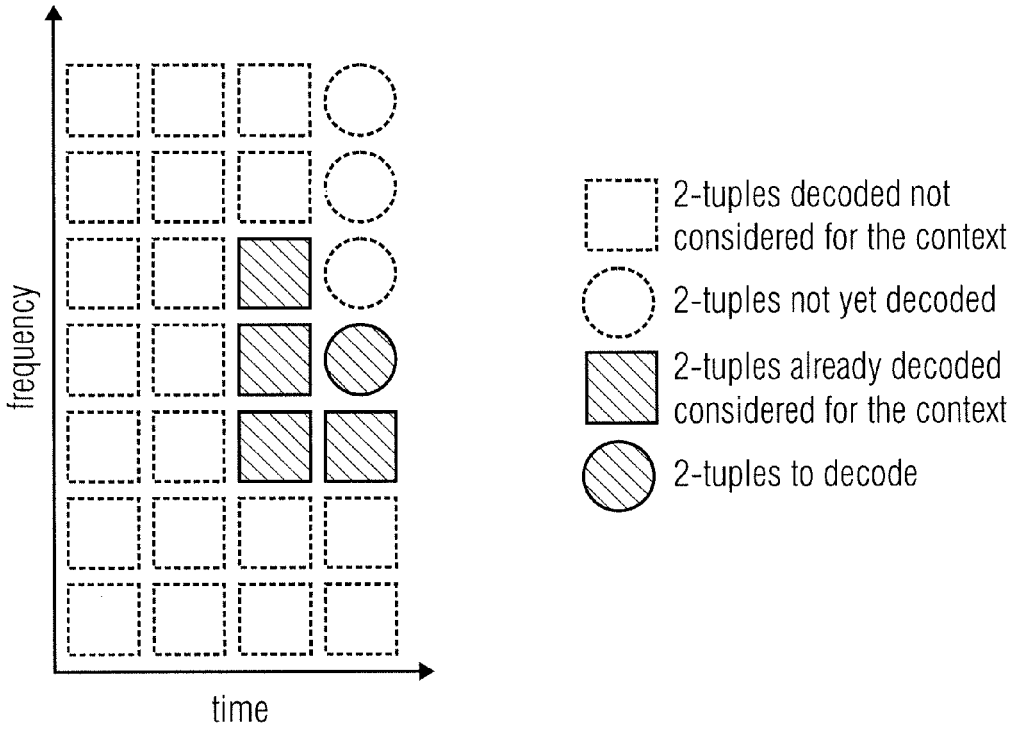
FIG. 17 shows a graphic representation of a context for state calculation, which may be used in some embodiments according to the invention.

FIG. 4*b* shows a graphical representation of the determination of the context state according to an embodiment of the invention. FIG. 4*b* shows a schematic representation of the entries of the preliminary context memory structure 432, which is provided by the preliminary context memory structure provider 430, at reference numeral 450. For example, an entry 450*a* having frequency index $i_1+1$, an entry 450*b* and an entry 450*c* having frequency index $i_2+2$ are marked. However, when providing the frequency-scaled context memory structure 440, which is shown at reference numeral 452, an entry 452*a* having frequency index $i_1$ is set to take the value of the entry 450*a* having frequency index $i_1+1$, and an entry 452*c* having frequency index $i_2-1$ is set to take the value of the entry 450*c* having frequency index $i_2+2$. Similarly, the other entries of the frequency-scaled context memory structure 440 can be set in dependence on the entries of the preliminary context memory structure 430, wherein, typically, some of the entries of the preliminary context memory structure are discarded in the case of a frequency compression, and wherein, typically, some of the entries of the preliminary context memory structure 432 are copied to more than one entry of the frequency-scaled context memory structure 440 in the case of a frequency stretching.

Moreover, FIG. 4*b* illustrates how the context state is determined for the decoding of spectral values of the audio frame having temporal index k on the basis of the entries of the frequency-scaled context memory structure 440 (which are represented at reference number 452). For example, when determining the context state (represented, for example, by the context state value 420) for the decoding of the spectral value (or tuple of spectral values) having frequency index $i_1$ of the audio frame having temporal index k, a context value having frequency index $i_1-1$ of the audio frame having temporal index k and entries of the frequency-scaled context memory structure of the audio frame having temporal index k−1 and frequency indices $i_1-1$, $i_1$ and $i_1+1$ are evaluated. Accordingly, entries of the preliminary context memory structure of the audio frame having temporal index k−1 and frequency indices $i_1-1$, $i_1+1$ and $i_1+2$ are effectively evaluated for determining the context for the decoding of the spectral value (or tuple of spectral values) of the audio frame having temporal index k and frequency index $i_1$. Thus, the environment of spectral values, which are used for the context state determination, is effectively changed by the frequency stretching or frequency compression of the preliminary context memory structure (or of the contents thereof).

8.2. Implementation According to FIG. 4*c*

In the following, an example for mapping the context of an arithmetic coder using 4-tuples will be described taking reference to FIG. 4*c*, which shows a tuple-wise processing.

FIG. 4*c* shows a pseudo program code representation of an algorithm for obtaining the frequency-scaled context memory structure (for example, the frequency-scaled context memory structure 440) on the basis of the preliminary context memory structure (for example, the preliminary context memory structure 432).

The algorithm 460 according to FIG. 4*c* assumes that the preliminary context memory structure 432 is stored in an array "self->base.m_qbuf". Moreover, the algorithm 460 assumes that the frequency stretching factor information 436 is stored in a variable "self->base.m_ContextUpdateRatio".

In a first step 460*a*, a number of variables are initialized. In particular, a target tuple index variable "nLinTupleIdx" and a source tuple index variable "nWarpTupleIdx" are initialized to zero. Moreover, a reorder buffer array "Tqi4" is initialized.

In a step 460*b* the entries of the preliminary context memory structure "self->base.m_qbuf" are copied into the reorder buffer array.

Subsequently, a copy algorithm 460*c* is repeated as long as both the target tuple index variable and the source tuple index variable are smaller than a variable nTuples describing a maximum number of tuples.

In a step 460*ca*, four entries of the reorder buffer, a (tuple) frequency index of which is determined by a current value of the source tuple index variable (in combination with a first index constant "firstIdx") are copied to entries of the context memory structure (self->base.m_qbuf[ ][ ]), frequency indices of which entries are determined by the target tuple index variable (nLinTupleIdx) (in combination with the first index constant "firstIdx").

In a step 460*cb*, the target tuple index variable is incremented by one.

In a step 460 cc, the source tuple index variable is set to a value, which is a product of the current value of the target tuple index variable (nLinTupleIdx) and the frequency stretching factor information (self->base.m_ContextUpdateRatio), rounded to the nearest integer value. Accordingly, the value of the source tuple index variable may be larger than the value of the target tuple index variable if the frequency stretching factor variable is larger than one, and smaller than the target tuple index variable if the frequency stretching factor variable is smaller than one.

Accordingly, a value of the source tuple variable is associated with each value of the target tuple index variable (as long as both the value of the target tuple index variable and the value of the source tuple variable are smaller than the constant nTuples). Subsequent to the execution of steps 460*cb* and 460 cc, the copying of entries from the reorder buffer to the context memory structure is repeated in step 460*ca*, using the updated association between a source tuple and a target tuple.

Thus, the algorithm 460 according to FIG. 4*c* performs the functionality of the frequency-scaled context memory structure provider 430*a*, wherein the preliminary context memory structure is represented by the initial entries of the array "self->base.m_qbuf", and wherein the frequency-scaled context memory structure 440 is represented by the updated entries of the array "self->base.m_qbuf".

8.3. Implementation According to FIGS. 4*d* and 4*e*

In the following, an example for mapping the context of an arithmetic coder using 4-tuples will be described taking reference to FIG. 4*c*, which shows a line-wise processing.

FIGS. 4*d* and 4*e* show a pseudo program code representation of an algorithm for performing the frequency scaling (i.e., frequency stretching or frequency compression) of a context.

The algorithm 470 according to FIGS. 4*d* and 4*e* receives, as an input information, the array "self->base.m_qbuf[ ][ ]" (or at least a reference to said array) and the frequency stretching factor information "self self->base.m_ContextUpdateRatio". Moreover, the algorithm 470 receives, as an input information, a variable "self->base.m_IcsInfo->m_ScaleFactorBandsTransmitted", which describes a number of active lines. Moreover, the algorithm 470 modifies the array self->base.m_qbuf[ ][ ], such that the entries of said array represent the frequency-scaled context memory structure.

The algorithm 470 comprises, in a step 470*a*, an initialization of a plurality of variables. In particular, a target line index variable (linLineIdx) and a source line index variable (warpLineIdx) are initialized to zero.

In step 470*b*, a number of active tuples and a number of active lines are computed.

In the following, two sets of contexts are processed, which comprise different context indices (designated by the variable "contextIdx"). However, in other embodiments it is also sufficient to only process one context.

In a step 470*c*, a line temporary buffer array "lineTmpBuf" and a line reorder buffer array "lineReorderBuf" are initialized with zero entries.

In a step 470*d*, entries of the preliminary context memory structure associated with different frequency bins of a plurality of tuples of spectral values are copied to the line reorder buffer array. Accordingly, entries of the line reorder buffer array having subsequent frequency indices are set to entries of the preliminary context memory structure which are associated with different frequency bins. In other words, the preliminary context memory structure comprises an entry "self->base.m_qbuf[CurTuple][contextIdx]" per tuple of spectral values, wherein the entry associated with a tuple of spectral values comprises sub-entries a, b, c, d associated with the individual spectral lines (or spectral bins). Each of the sub-entries a, b, c, d is copied into an individual entry of the line reorder buffer array "lineReorderBuf[ ]" in a step 470*d*.

Consequently, the content of the line reorder buffer array is copied into the line temporal buffer array "lineTmpBuf[ ]" in a step 470*e*.

Subsequently, the target line index variable and the source line index variable are initialized to take the value of zero in a step 470*f*.

Subsequently, entries "lineReorderBuf[warpLineIdx]" of the line reorder buffer array are copied to the line temporal buffer array for a plurality of values of the target line index variable "linLineIdx" in a step 470*g*. The step 470*g* is repeated as long as both the target line index variable and the source line index variable are smaller than a variable "activeLines", which indicates a total number of active (non-zero) spectral lines. An entry of the line temporary buffer array designated by the current value of the target line index variable "linLineIdx" is set to the value of the line reorder buffer array designated by the current value of the source line index variable. Subsequently, the target line index variable is incremented by one. The source line index variable "warpLineIdx" is set to take a value which is determined by the product of the current value of the target line index variable and the frequency stretching factor information (represented by the variable "self->base.m_ContextUpdateRatio".

After the update of the target line index variable and the source line index variable, step 470*g* is repeated, provided both the target line index variable and the source line index variable are smaller than the value of the variable "activeLines".

Accordingly, context entries of the preliminary context memory structure are frequency-scaled in a line-wise manner, rather than in a tuple-wise manner.

In a final step 470*h*, a tuple-representation is reconstructed on the basis of the line-wise entries of the line temporary buffer array. Entries a, b, c, d, of a tuple representation "self->base.m_qbuf[curTuple][contextIdx]" of the context are set in accordance with four entries "lineTmpBuf[(curTuple−1)*4+0]" to "lineTmpBuf[(curTuple−1)*4+3]" of the line temporary buffer array, which entries are adjacent in frequency. In addition, a tuple energy field "e" is, optionally, set to represent an energy of the spectral values associated with the respective tuple. Moreover, an additional field "v" of the tuple representation is, optionally, set if the magnitude of the spectral values associated with said tuple is comparatively small.

However, it should be noted that details regarding the calculation of new tuples, which is performed in a step 470*h*, are strongly dependent on the actual representation of the context and may therefore vary significantly. However, it can be generally said that a tuple-based representation is created on the basis of an individual-line-based representation of the frequency-scaled context in step 470*h*.

To summarize, in accordance with the algorithm 470, a tuple-wise context representation (entries of the array "self->base.m_qbuf[curTuple][contextIdx]") is first split up into a frequency-line-wise context representation (or frequency-bin-wise context representation) (step 470*d*). Subsequently, the frequency scaling is performed in a line-wise manner (step 470*g*). Finally, a tuple-wise representation of the context (updated entries of the array "self->base.m_qbuf[curTuple][contextIdx]") is reconstructed (step 470*h*) on the basis of the line-wise frequency-scaled information.

9. Detailed Description of the Frequency-Domain-to-Time-Domain Decoding Algorithm 9.1. Overview In the following, some of the algorithms performed by an audio decoder according to an embodiment of the invention will be described in detail. For this purpose, reference is made to FIGS. 5*a*, 5*b*, 6*a*, 6*b*, 7*a*, 7*b*, 8, 9, 10*a*, 10*b*, 11, 12, 13, 14, 15 and 16.

First of all, reference is made to FIG. 7*a*, which shows a legend of definitions of data elements and a legend of definitions of help elements. Moreover, reference is made to FIG. 7*b*, which shows a legend of definitions of constants.

Generally speaking, it can be said that the methods described here can be used for the decoding of an audio stream which is encoded according to a time-warped modified discrete cosine transform. Thus, when the TW-MDCT is enabled for an audio stream (which may be indicated by a flag, for example, referred to as "twMDCT" flag, which may be comprised in a specific configuration information), a time-warped filter bank and block switching may replace a standard filter bank and block switching in an audio decoder. Additionally to the inverse modified discrete cosine transform (IMCT) the time-warped filter bank and block switching contains a time-domain-to-time-domain mapping from an arbitrarily spaced time grid to a normal regularly spaced or linearly spaced time grid and a corresponding adaptation of window shapes.

It should be noted here, that the decoding algorithm described here may be performed, for example, by the warp time-warping frequency-domain-to-time-domain converter 180 on the basis of the encoded representation of the spectrum and also on the basis of the encoded time warp information 184,252.

9.2. Definitions:

With respect to the definition of data elements, help elements and constants, reference is made to FIGS. 7*a* and 7*b*.

9.3. Decoding Process-Warp Contour

The codebook indices of the warp contour nodes are decoded as follows to warp values for the individual nodes:

$$\text{warp_node_values}[i] = \begin{cases} 1 & \text{for tw_data_present} = 0,\ 0 \le i \le \text{NUM_TW_NODES} \\ 1 & \text{for tw_data_present} = 1,\ i = 0 \\ \prod_{k=0}^{i-1} \text{warp_value_tbl}[\text{tw_ratio}[k]] & \text{for tw_data_present} = 1,\ 0 < i \le \text{NUM_TW_NODES} \end{cases}$$

However, the mapping of the time warp codewords "tw_ratio[k]" onto decoded time warp values, designated here as "warp_value_tbl[tw_ratio[k]]", may, optionally be dependent on the sampling frequency in the embodiments according to the invention. Accordingly, there is not a single mapping table in some embodiments according to the invention, but there are individual mapping tables for different sampling frequencies.

To obtain the sample-wise (n_long samples) new warp contour data "new_warp_contour[ ]", the warp node values "warp_node_values[ ]" are now interpolated linearly between the equally spaced (interp_dist apart) nodes using an algorithm, a pseudo program code representation which is shown in FIG. 9.

Before obtaining the full warp contour for this frame (for example, for a current frame), the buffered values from the past may be resealed, so that the last warp value of the past warp contour "past_warp_contour[ ]"=1.

$$\text{norm_fac} = \frac{1}{\text{past_warp_contour}[2 \cdot \text{n_long} - 1]}$$

$$\text{past_warp_contour}[i] = \text{past_warp_contour}[i] \cdot \text{norm_fac}$$

$$\text{for } 0 \le i < 2 \cdot \text{n_long}$$

$$\text{last_warp_sum} = \text{last_warp_sum} \cdot \text{norm_fac}$$

$$\text{cur_warp_sum} = \text{cur_warp_sum} \cdot \text{norm_fac}$$

The full warp contour "warp_contour[ ]" is obtained by concatenating the past warp contour "past_warp_contour" and the new warp contour "new_warp_contour", and the new warp sum "new_warp_sum" is calculated as a sum over all new warp contour values "new_warp_contour[ ]":

$$\text{new_warp_sum} = \sum_{i=0}^{n_long-1} \text{new_warp_contour}[i]$$

9.4. Decoding Process-Sample Position and Window Length Adjustment

From the warp contour "warp_contour[ ]", a vector of the sample positions of the warped samples on a linear time scale is computed. For this, the time warp contour is generated in accordance with the following equations:

$$\text{time_contour}[i] = \begin{cases} -w_{res} \cdot \text{last_warp_sum} & \text{for } i = 0 \\ w_{res}\left(-\text{last_warp_sum} + \sum_{k=0}^{i-1} \text{warp_contour}[k]\right) & \text{for } 0 < i \le 3 \cdot \text{n_long} \end{cases}$$

$$\text{where } w_{res} = \frac{\text{n_long}}{\text{cur_warp_sum}}$$

With the helper functions "warp_inv_vec( )" and "warp_time_inv( )", pseudo program code representations of which are shown in FIGS. 10*a* and 10*b*, respectively, the sample position vector and the transition length are computed in accordance with an algorithm, a pseudo program code representation of which is shown in FIG. 11.

9.5. Decoding Process-Inverse Modified Discrete Cosine Transform (IMDCT)

In the following, the inverse modified discrete cosine transform will be briefly described. The analytical expression of the inverse modified discrete cosine transform is as follows:

$$x_{i,n} = \frac{2}{N} \sum_{k=0}^{\frac{N}{2}-1} spec[i][k] \cos\left(\frac{2\pi}{N}(n + n_0)\left(k + \frac{1}{2}\right)\right) \text{ for } 0 \le n < N$$

where:

n=sample index i=window index k=spectral coefficient index

N=window length based on the window_sequence value $n_0$=(N/2+1)/2

The synthesis window length for the inverse transform is a function of the syntax element "window_sequence" (which may be included in the bitstream) and the algorithmic context. The synthesis window length may, for example, be defined in accordance with the table of FIG. 12.

The meaningful block transitions are listed in the table of FIG. 13. A tick mark in a given table cell indicates that a window sequence listed in this particular row may be followed by a window sequence listed in this particular column.

Regarding the allowed window sequences, it should be noted that the audio decoder may, for example, be switchable between windows of different lengths. However, the switching of window lengths is not of particular relevance for the present invention. Rather, the present invention can be understood on the basis of the assumption that there is a sequence of windows of type "only_long_sequence" and that the core coder frame length is equal to 1024.

Moreover, it should be noted that the audio signal decoder may be switchable between a frequency-domain coding mode and a time-domain coding mode. However, this possibility is not of particular relevance to the present invention. Rather, the present invention is applicable in audio signal decoders which are only capable of handling the frequency domain coding mode, as discussed, for example, with reference to FIGS. 1*b* and 2*b*.

9.6. Decoding Process-Windowing and Block switching

In the following, the windowing and block switching, which may be performed by the time-warping frequency-domain-to-time-domain converter 180 and, in particular, by the windower 180*g* thereof, will be described.

Depending on the "window_shape" element (which may be included in a bitstream representing the audio signal) different oversampled transform window prototypes are used, and the length of the oversampled windows is $$N_{os} = 2 \cdot n_long \cdot OS_FACTOR_WIN$$

For window_shape==1, the window coefficients are given by the Kaiser-Bessel derived (KBD) window as follows:

$$W_{KBD}\left(n - \frac{N_{OS}}{2}\right) = \sqrt{\frac{\sum_{p=0}^{N_{OS}-n-1} [W(p, \alpha)]}{\sum_{p=0}^{N_{OS}/2} [W(p, \alpha)]}} \text{ for } \frac{N_{OS}}{2} \le n < N_{OS}$$

where:

W', Kaiser-Besser kernel function is defined as follows:

$$W'(n, \alpha) = \frac{I_0\left[\pi\alpha\sqrt{1.0 - \left(\frac{n - N_{OS}/4}{N_{os}/4}\right)}\right]}{I_0[\pi\alpha]} \text{ for } 0 \le n \le \frac{N_{OS}}{2}$$

$$I_0[x] = \sum_{k=0}^{\infty} \left[\frac{\left(\frac{x}{2}\right)^k}{k!}\right]^2$$

α=kernel window alpha factor, α=4

Otherwise, for window_shape==0, a sine window is employed as follows:

$$W_{SIN}\left(n - \frac{N_{OS}}{2}\right) = \sin\left(\frac{\pi}{N_{OS}}\left(n + \frac{1}{2}\right)\right) \text{ for } \frac{N_{OS}}{2} \le n \le N_{OS}$$

For all kinds of window sequences, the used protoype for the left window part is the determined by the window shape of the previous block. The following formula expresses this fact:

$$\text{left_window_shape}[n] = \begin{cases} W_{KBD}[n], \text{ if window_shape_previous_block} == 1 \\ W_{SIN}[n], \text{ if window_shape_previous_block} == 0 \end{cases}$$

Likewise the prototype for the right window shape is determined by the following formula:

$$\text{right_window_shape}[n] = \begin{cases} W_{KBD}[n], \text{ if window_shape} == 1 \\ W_{SIN}[n], \text{ if window_shape} == 0 \end{cases}$$

Since the transition lengths are already determined, it only should be differentiated between window sequence of type "EIGHT_SHORT_SEQUENCE" and all other window sequences.

In case the current frame is of type "EIGHT_SHORT_SEQUENCE", a windowing and internal (frame-internal) overlap-and-add is performed. The C-code-like portion of FIG. 14 describes the windowing and the internal overlap-add of the frame having window type "EIGHT_SHORT_SEQUENCE".

For frames of any other types, an algorithm may be used, a pseudo program code representation of which is shown in FIG. 15.

9.7. Decoding Process-Time-Varying Re-sampling

In the following, the time-varying re-sampling will be described, which may be performed by the time-warping frequency-domain-to-time-domain converter 180 and, in particular, by the re-sampler 180*i*.

The windowed block z[ ] is re-sampled according to the sample positions (which are provided by the sampling position calculator 180*l* on the basis of the decoded time warp contour information 258) using the following impulse response:

$$b[n] = I_0[\alpha]^{-1} \cdot I_0\left[\alpha\sqrt{1 - \frac{n^2}{\text{IP_LEN_2}^2}}\right] \cdot \frac{\sin\left(\frac{\pi n}{\text{OS_FACTOR_RESAMP}}\right)}{\frac{\pi n}{\text{OS_FACTOR_RESAMP}}}$$

$$\text{for } 0 \le n < \text{IP_SIZE} - 1$$

$$\alpha = 8$$

Before re-sampling, the windowed block is padded with zeros on both ends:

$$zp[n] = \begin{cases} 0, & \text{for } 0 \le n < \text{IP_LEN_2S} \\ z[n - \text{IP_LEN_2S}], & \text{for IP_LEN_2S} \le n < \text{N_f} + \text{IP_LEN_2S} \\ 0, & \text{for } 2 \cdot \text{N_f} + \text{IP_LEN_2S} \le n < \text{N_f} + 2 \cdot \text{IP_LEN_2S} \end{cases}$$

The re-sampling itself is described in a pseudo program code section shown in FIG. 16.

9.8. Decoding Process-Overlapping-and-Adding with Previous Window Sequences

The overlapping-and-adding, which is performed by the overlapper/adder 180*m* of the time-warping frequency-domain-to-time-domain converter 180, is the same for all sequences and can be described mathematically as follows:

$$out_{i,n} = \begin{cases} y'_{i,n} + y'_{i-1,n+n_long} + y'_{i-2,n+2\cdot n_long} & \text{for } 0 \le n < \text{n_long}/2 \\ y'_{i,n} + y'_{i-1,n+n_long} & \text{for n_long}/2 \le n < \text{n_long} \end{cases}$$

9.9. Decoding Process-Memory Update

In the following, a memory update will be described. Even though no specific means are shown in FIG. 2*b*, it should be noted that the memory update may be performed by the time-warping frequency-domain-to-time-domain converter 180.

The memory buffers needed for decoding the next frame are updated as follows:

past_warp_contour[n]=warp_contour[n+n_long], for $0 \le n < 2 \cdot$n_long cur_warp_sum=new_warp_sum last_warp_sum=cur_warp_sum Before decoding the first frame or if the last frame was encoded with an optical LPC domain coder, the memory states are set as follows:

past_warp_contour[n]=1, for $0 \le n < 2 \cdot$n_long cur_warp_sum=n_long last_warp_sum=n_long 9.10. Decoding Process—Conclusion To summarize the above, a decoding process has been described, which may be performed by the time-warping frequency-domain-to-time-domain converter 180. As can be seen, a time-domain representation is provided for an audio frame of, for example, 2048 time-domain samples, and subsequent audio frames may, for example, overlap by approximately 50%, such that a smooth transition between time-domain representations of subsequent audio frames is ensured.

A set of, for example, NUM_TW_NODES=16 decoded time warp values may be associated with each of the audio frames (provided that the time warp is active in said audio frame), irrespective of the actual sampling frequency of the time-domain samples of the audio frame.

10. Spectral Noiseless Coding

In the following, some details regarding the spectral noiseless coding will be described, which may be performed by the context-based spectral value decoder 160 in combination with the context state determinator 170. It should be noted that a corresponding encoding may be performed by the context spectral value encoder in combination with the context state determinator 140, wherein a man skilled in the art will understand the respective encoding steps from the detailed discussion of the decoding steps.

10.1. Spectral Noiseless Coding—Tool Description

Spectral noiseless coding is used to further reduce the redundancy of the quantized spectrum. The spectral noiseless coding scheme is based on an arithmetic coding in conjunction with a dynamically adapted context. The spectral noiseless coding scheme discussed below is based on 2-tuples, that is two neighbored spectral coefficients are combined. Each 2-tuple is split into the sign, the most significant 2-bits wise plane, and the remaining less significant bit-planes. The noiseless coding for the most significant 2-bits wise plane, m, uses context dependent cumulative frequencies tables derived from four previously decoded 2-tuples. The noiseless coding is fed by the quantized spectral values and uses context dependent cumulative frequencies tables derived from (e.g., selected in accordance with) four previously decoded neighboring 2-tuples. Here, the neighborhood, in both, time and frequency, is taken into account, as illustrated in FIG. 16, which shows a graphical representation of a context for a state calculation. The cumulative frequencies tables are then used by the arithmetic coder (encoder or decoder) to generate a variable length binary code.

However, it should be noted that a different size of the context may be chosen. For example, a smaller or a larger number of tuples, which are in an environment of the tuple to decode, may be used for the context determination. Also, a tuple may comprise a smaller or larger number of spectral values. Alternatively, individual spectral values may be used to obtain the context, rather than tuples.

The arithmetic coder produces a binary code for a given set of symbols and their respective probabilities. The binary code is generated by mapping a probability interval, where the set of symbols lies, to a codeword.

10.2 Spectral Noiseless Coding—Definitions

With respect to definitions of variables, constants, and so on, reference is made to FIG. 18, which shows a legend of definitions.

10.3 Decoding Process

The quantized spectral coefficients "x_ac_dec[ ]" are noiselessly decoded starting from the lowest frequency coefficient and progressing to the highest frequency coefficient. They are decoded, for example, by groups of two successive coefficients a and b gathering in a so-called 2-tuple (a, b).

The decoded coefficients x_ac_dec[ ] for a frequency domain mode (as described above) are then stored in an array "x_ac_quant[g][win][sfb][bin]". The order of transmission of the noiseless coding codewords is such that when they are decoded in the order received and stored in the array, bin is the most rapidly incrementing index and g is the slowest incrementing index. Within a codeword, the order of decoding is a and then b.

Optionally, coefficients for a transform-coded-excitation mode may also be evaluated. Even though the above examples are only related to frequency-domain audio encoding and frequency-domain audio decoding, the concepts disclosed herein may actually be used for audio encoders and audio decoders operating in the transform-coded-excitation domain. The decoded coefficients x_ac_dec[ ] for the transform coded excitation (TCX) are stored directly in an array x_tcx_invquant[win][bin], and the order of the transmission of the noiseless coding codewords is such that when they are decoded in the order received and stored in the array, bin is the most rapidly incrementing index and win is the slowest incrementing index. Within a codeword the order of decoding is a and then b.

First, the (optional) flag "arith_reset_flag" determines if the context has to be reset (or should be reset). If the flag is TRUE, an initialization is performed.

The decoding process starts with an initialization phase where the context element vector q is updated by copying and mapping the context elements of the previous frame stored in arrays (or sub-arrays) q[1][ ] into q[0][ ]. The context elements within q are stored, for example, on 4-bits per 2-tuple. For details regarding the initialization, reference is made to the algorithm, a pseudo program code representation of which is shown in FIG. 19.

Subsequent to the initialization, which may be performed in accordance with the algorithm of FIG. 19, the frequency scaling of the context, which has been discussed above, may be performed. For example, the array (or sub-array) q[0][ ] may be considered as the preliminary context memory structure 432 (or may be equivalent to the array self->base.m_qbuf[ ][ ], except for details regarding the dimensions and the regarding the entires e and v). Moreover, the frequency-scaled context may be stored back to the array q[0] [ ] (or to the array "self->base.m_qbuf[ ][ ]"). Alternatively, however, or in addition, the contents of the array (or sub-array) q[1][ ] may be frequency-scaled by the apparatus 438.

To summarize, the noiseless decoder outputs 2-tuples of unsigned quantized spectral coefficients. At first (or, typically, after the frequency scaling), the state c of the context is calculated based on the previously decoded spectral coefficients surrounding the 2-tuple to decode. Therefore, the state is incrementally updated using the context state of the last decoded 2-tuple considering only two new 2-tuples. The state is coded, for example, on 17-bits and is returned by the function "arith_get_context[ ]", a pseudo program code representation of which is shown in FIG. 20.

The context state c, which is obtained as return value of the function "arith_get_context[ ]" determines the cumulative frequency table used for decoding the most significant 2-bits wise plane m. The mapping from c to the corresponding cumulative frequency table index pki is performed by the function "arith_get_pk[ ]", a pseudo program code representation of which is shown in FIG. 21.

The value m is decoded using the function "arith_decode[ ]" called with the cumulative frequencies table, "arith_cf_m[pki][ ]", wherein pki corresponds to the index returned by the function "arith_get_pk[ ]". The arithmetic coder is an integer implementation using a method of tag generation with scaling. The pseudo C-code according to FIG. 22 describes the used algorithm.

When the decoded value m is the escape symbol "ARITH_ESCAPE", the variables "lev" and "esc_nb" are incremented by one and another value m is decoded. In this case, the function "get_pk[ ]" is called once again with the value c & esc_nb<<17 as input argument, where esc_nb is the number of escape symbols previously decoded for the same 2-tuple and bounded to 7.

Once the value m is not the escape symbol "ARITH_ESCAPE", the decoder checks if the successive m forms an "ARITH_STOP" symbol. If the condition (esc_nb>0 && m==0) is true, the "ARITH_STOP" is detected and the decoding process is ended. The decoder jumps directly to the sign decoding described afterwards. The condition means that the rest of the frame is composed of zero values.

If the "ARITH_STOP" symbol is not met, the remaining bit planes are then decoded if any exist for the present 2-tuple. The remaining bit planes are decoded from the most significant to the lowest significant level by calling the function "arith_decode[ ]" lev number of times. The decoded bit planes r permit to refine the previously decoded values a, b in accordance with an algorithm, a pseudo program code of which is shown in FIG. 23.

At this point, the unsigned value of the 2-tuple (a, b) is completely decoded. It is saved in the array "x_ac_dec[ ]" holding the spectral coefficients, as shown in the pseudo program code of FIG. 24.

The context q is also updated for the next 2-tuple. It should be noted that this context update may also be performed for the last 2-tuple. The context update is performed by the function "artih_update_context[ ]", a pseudo program code of which is shown in FIG. 25.

The next 2-tuple of the frame is then decoded by incrementing i by one and by redoing the same process as described above. In particular, the frequency scaling of the context may be performed, and the above described process may be restarted from the function "arith_get_context[ ]" subsequently. When lg/2 2-tuples are decoded within the frame or when the stop symbol "ARITH_STOP" occurs, the decoding process of the spectral amplitude terminates and the decoding of the signs begins.

Once all unsigned quantized spectral coefficients are decoded, the according sign is added. For each non-null quantized value of "x_ac_dec", a bit is read. If the read bit is equal to one, the quantized value is positive, nothing is done and the signed value is equal to the previously decoded unsigned value. Otherwise, the decoded coefficient is negative, and the two's complement is taken from the unsigned value. The sign bits are read from the low to the high frequencies.

The decoding is finished by calling the function "arith_finish[ ]", a pseudo program code of which his shown in FIG. 26. The remaining spectral coefficients are set to zero. The respective context states are updated correspondingly.

To summarize the above, a context-based (or context-dependent) decoding of the spectral values is performed, wherein individual spectral values may be decoded, or wherein the spectral values may be decoded tuple-wise (as shown above). The context may be frequency-scaled, as discussed herein, in order to obtain a good encoding/decoding performance in the case of a temporal variation of the fundamental frequency (or, equivalently, of the pitch).

11. Audio Stream According to FIGS. 27*a*-27*f*

In the following, an audio stream will be described which comprises an encoded representation of one or more audio signal channels and one or more time warp contours. The audio stream described in the following may, for example, carry the encoded audio signal representation 112 or the encoded audio signal representation 152.

FIG. 27*a* shows a graphical representation of a so-called "USAC_raw_data_block" data stream element, which may comprise a signal channel element (SCE), a channel pair element (CPE) or a combination of one or more single channel elements and/or one or more channel pair elements.

The "USAC_raw_data_block" may typically comprise a block of encoded audio data, while additional time warp contour information may be provided in a separate data stream element. Nevertheless, it is naturally possible to encode some time warp contour data into the "USAC_raw_data_block".

As can be seen from FIG. 27*b*, a single channel element typically comprises a frequency domain channel stream ("fd_channel_stream"), which will be explained in detail with reference to FIG. 27*d*.

As can be seen from FIG. 27*c*, a channel pair element ("channel_pair_element") typically comprises a plurality of frequency-domain channel streams. Also, the channel pair element may comprise time warp information, like, for example, a time warp activation flag ("tw_MDCT"), which may be transmitted in a configuration data stream element or in the "USAC_raw_datablock", and which determines whether time warp information is included in the channel pair element. For example, if the "tw_MDCT" flag indicates that the time warp is active, the channel pair element may comprise a flag ("common_tw"), which indicates whether there is a common time warp for the audio channels of the channel pair element. If said flag ("common_tw") indicates that there is a common time warp for multiple of the audio channels, then a common time warp information ("tw_data") is included in the channel pair element, for example, separate from the frequency-domain channel streams.

Taking reference now to FIG. 27*d*, the frequency-domain channel stream is described. As can be seen from FIG. 27*d*, the frequency-domain channel stream, for example, comprises a global gain information. Also, the frequency-domain channel stream comprises time warp data, if the time warping is active (flag "tw_MDCT" is active) and if there is no common time warp information for multiple audio signal channels (flag "common_tw" is inactive).

Further, a frequency-domain channel stream also comprises scale factor data ("scale_factor_data") and encoded spectral data (for example, arithmetically encoded spectral data "ac_spectral_data").

Taking reference now to FIG. 27*e*, the syntax of the time warp data is briefly discussed. The time warp data may, for example, optionally comprise a flag (e.g., "tw_data_present" or "active_pitch_data") indicating whether time warp data is present. If the time warp data is present (i.e., the time warp contour is not flat), the time warp data may comprise the sequence of a plurality of encoded time warp ratio values (e.g., "tw_ratio[i]" or "pitch Idx[i]"), which may, for example, be encoded according to a sampling-rate dependent codebook table, as is described above.

Thus, the time warp data may comprise a flag indicating that there is no time warp data available, which may be set by an audio signal encoder, if the time warp contour is constant (time warp ratios are approximately equal to 1.000). In contrast, if the time warp contour is varying, ratios between subsequent time warp contour nodes may be encoded using the codebook indices, making up the "tw_ratio" information.

FIG. 27*f* shows a graphical representation of the syntax of the arithmetically coded spectral data "ac_spectral_data( )". The arithmetically coded spectral data are encoded in dependence on the status of an independency flag (here: "indepFlag"), which indicates, if active, that the arithmetically coded data are independent from arithmetically encoded data of a previous frame. If the independency flag "indepFlag" is active, an arithmetic reset flag "arith_reset_flag" is set to be active. Otherwise, the value of the arithmetic reset flag is determined by a bit in the arithmetically coded spectral data.

Moreover, the arithmetically coded spectral data block "ac_spectral_data( )" comprises one or more units of arithmetically coded data, wherein the number of units of arithmetically coded data "arith_data( )" is dependent on a number of blocks (or windows) in the current frame. In a long block mode, there is only one window per audio frame. However, in a short block mode, there may be, for example, eight windows per audio frame. Each unit of arithmetically coded spectral data "arith_data" comprises a set of spectral coefficients, which may serve as the input for a frequency-domain-to-time-domain transform, which may be performed, for example, by the inverse transform 180*e*.

The number of spectral coefficients per unit of arithmetically encoded data "arith_data" may, for example, be independent of the sampling frequency, but may be dependent on the block length mode (short block mode "EIGHT_SHORT_SEQUENCE" or long block mode "ONLY_LONG_SEQUENCE").

12. Conclusions

To summarize the above, improvements in the context of the time-warped-modified-discrete-cosine-transform have been discussed. The invention described herein is in a context of a time-warped-modified-discrete-transform coder (see, for example, references [1] and [2]) and comprises methods for an improved performance of a warped MDCT transform coder. One implementation of such a time-warped-modified-discrete-cosine-transform coder is realized in the ongoing MPEG USAC audio coding standardization work (see, for example, reference [3]). Details on the used TW-MDCT implementation can be found, for example, in reference [4].

However, improvements to the mentioned concepts are suggested herein.

13. Implementation Alternatives

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An audio signal decoder, comprising:

a mechanism for receiving an encoded audio signal representation including an encoded spectrum representation, and an encoded time warp information, wherein the encoded spectrum representation includes a codeword describing one or more spectral values or at least a portion of a number representation of one or more spectral values in dependence on a context state;

a context-based spectral value decoder configured to decode the codeword, to acquire decoded spectral values;

a context state determinator configured to determine a current context state in dependence on one or more previously decoded spectral values of the received encoded audio signal representation; and a time warping frequency-domain-to-time-domain converter configured to output a time-warped time-domain representation of a given audio frame of the received encoded audio signal representation on the basis of a set of decoded spectral values associated with the given audio frame and output by the context-based spectral value decoder and in dependence on the time warp information;

wherein the context-state determinator is configured to adapt the determination of the context state to a change of a fundamental frequency between subsequent audio frames; and wherein the audio signal decoder is implemented using a hardware apparatus, or using a computer, or using a combination of a hardware apparatus and a computer.

2. The audio signal decoder according to claim 1, wherein the time warp information describes a variation of a pitch over time; and wherein the context state determinator is configured to derive a frequency stretching information from the time warp information; and wherein the context state determinator is configured to stretch or compress a past context associated with the previous audio frame along the frequency axis in dependence on the frequency stretching information, to acquire an adapted context for a context-based decoding of one or more spectral values of a current audio frame.

3. The audio signal decoder according to claim 2, wherein the context state determinator is configured to derive a first average frequency information over a first audio frame from the time warp information, and to derive a second average frequency information over a second audio frame following the first audio frame from the time warp information; and wherein the context state determinator is configured to compute a ratio between the second average frequency information over the second audio frame and the first average frequency information over the first audio frame in order to determine the frequency stretching information.

4. The audio signal decoder according to claim 3, wherein the context state determinator is configured to derive the first and second average frequency information or the first and second average time warp contour information from a common time warp contour extending over a plurality of consecutive audio frames.

5. The audio signal decoder according to claim 3, wherein the audio signal decoder comprises a time warp calculator configured to calculate a time warp contour information describing a temporal evolution of a relative pitch over a plurality of consecutive audio frames on the basis of the time warp information, and wherein the context state determinator is configured to use the time warp contour information for deriving the frequency stretching information.

6. The audio signal decoder according to claim 5, wherein the audio signal decoder comprises a re-sampling position calculator, wherein the re-sampling position calculator is configured to calculate re-sampling positions for use by the time-warp resampler on the basis of the time warp contour information, such that a temporal variation of the resampling positions is determined by the time warp contour information.

7. The audio signal decoder according to claim 2, wherein the context state determinator is configured to determine a first average time warp contour information over a first audio frame from the time warp information, and wherein the context state determinator is configured to derive a second average time warp contour information over a second audio frame following the first audio frame from the time warp information, and wherein the context state determinator is configured to compute a ratio between the first average time warp contour information over the first audio frame and the second average time warp contour information over the second audio frame, in order to determine the frequency stretching information.

8. The audio signal decoder according to claim 1, wherein the context state determinator is configured to derive a numeric current context value, which describes the context state, in dependence on a plurality of previously decoded spectral values, and to select a mapping rule describing a mapping of a code value onto a symbol code representing one or more spectral values, or a portion of a number representation of one or more spectral values, in dependence on the numeric current context value, wherein the context-based spectral value decoder is configured to decode the code value describing one or more spectral values, or at least a portion of a number representation of one or more spectral values, using the mapping rule selected by the context state determinator.

9. The audio signal decoder according to claim 8, wherein the context state determinator is configured to set up and update a preliminary context memory structure, such that entries of the preliminary context memory structure describe one or more spectral values of a first audio frame, wherein entry indices of the entries of the preliminary context memory structure are indicative of a frequency bin or a set of adjacent frequency bins of the frequency-domain-to-time-domain converter to which the respective entries are associated;

wherein the context state determinator is configured to acquire a frequency-scaled context memory structure for a decoding of a second audio frame following the first audio frame on the basis of the preliminary context memory structure, such that a given entry or a sub-entry of the preliminary context memory structure comprising a first frequency index is mapped onto a corresponding entry or sub-entry of the frequency-scaled context memory structure comprising a second frequency index, wherein the second frequency index is associated with a different frequency bin or a set of adjacent frequency bins of the frequency-domain-to-time-domain converter than the first frequency index.

10. The audio signal decoder according to claim 9, wherein the context state determinator is configured to derive a context state value describing the current context state for a decoding of a code word describing one or more spectral values of the second audio frame, or at least a portion of a number representation of one or more spectral values of a second audio frame, having associated a third frequency index using values of the frequency scaled context memory structure, frequency indices of which values of the frequency-scaled context memory structure are in a predetermined relationship with the third frequency index, wherein the third frequency index designates a frequency bin or a set of adjacent frequency bins of the frequency-domain-to-time-domain converter to which one or more spectral values of the second audio frame to be decoded using the current context state are associated.

11. The audio signal decoder according to claim 9, wherein the context state determinator is configured to set each of a plurality of entries of the frequency-scaled context memory structure comprising a corresponding target frequency index to a value of a corresponding entry of the preliminary context memory structure comprising a corresponding source frequency index, wherein the context state determinator is configured to determine corresponding frequency indices of an entry of the frequency-scaled context memory structure and of a corresponding entry of the preliminary context memory structure such that a ratio between said corresponding frequency indices is determined by the change of the fundamental frequency between a current audio frame, to which the entries of the preliminary context memory structure are associated, and a subsequent audio frame, the decoding context of which is determined by the entries of the frequency-scaled context memory structure.

12. The audio signal decoder according to claim 9, wherein the context state determinator is configured to set up the preliminary context memory structure such that each of a plurality of entries of the preliminary context memory structure is based on a plurality of spectral values of a first audio frame, wherein entry indices of the entries of the preliminary context memory structure are indicative of a set of adjacent frequency bins of the frequency-domain-to-time-domain converter to which the respective entries are associated;

wherein the context state determinator is configured to extract preliminary frequency-bin-individual context values having associated individual frequency bin indices from the entries of the preliminary context memory structure;

wherein the context state determinator is configured to acquire frequency-scaled frequency-bin-individual context values having associated individual frequency bin indices, such that a given preliminary frequency-bin-individual context value comprising a first frequency bin index is mapped onto a corresponding frequency-scaled frequency-bin-individual context value comprising a second frequency bin index, such that a frequency-bin-individual mapping of the preliminary frequency-bin-individual context value is acquired; and wherein the context-state determinator is configured to combine a plurality of frequency-scaled frequency-bin-individual context values into a combined entry of the frequency-scaled context memory structure.

13. An audio signal encoder, comprising:

a frequency-domain representation provider configured to receive an input audio signal and a time warp information, and provide a frequency-domain representation representing a time-warped version of the received input audio signal, time-warped in accordance with the received time warp information;

a context-based spectral value encoder configured to output a codeword describing one or more spectral values of the frequency-domain representation provided by the frequency-domain representation provider, or at least a portion of a number representation of one or more spectral values of the frequency-domain representation provided by the frequency-domain representation provider, in dependence on a context state, to acquire encoded spectral values of the encoded spectrum representation, wherein an encoded representation of the input audio signal comprises an encoded spectrum representation and an encoded time warp information, and wherein the encoded spectrum representation comprises the codeword; and a context state determinator configured to determine a current context state in dependence on one or more previously-encoded spectral values, wherein the context state determinator is configured to adapt the determination of the context state to a change of a fundamental frequency between subsequent audio frames;

wherein the audio signal encoder is implemented using a hardware apparatus, or using a computer, or using a combination of a hardware apparatus and a computer.

14. The audio signal encoder according to claim 13, wherein the context state determinator is configured to derive a numeric current context value in dependence on a plurality of previously encoded spectral values, and to select a mapping rule describing a mapping of one or more spectral values, or of a portion of a number representation of one or more spectral values, onto a code value in dependence on the numeric current context value, wherein the context-based spectral value encoder is configured to output the code value describing one or more spectral values, or at least a portion of a number representation of one or more spectral values, using the mapping rule selected by the context state determinator.

15. A method, comprising:

receiving an encoded audio signal representation including an encoded spectrum representation, and an encoded time warp information, wherein the encoded spectrum representation includes a codeword describing one or more spectral values or at least a portion of a number representation of one or more spectral values in dependence on a context state;

decoding the codeword, to acquire decoded spectral values;

determining a current context state in dependence on one or more previously decoded spectral values of the received encoded audio signal representation; and outputting a time-warped time-domain representation of a given audio frame of the received encoded audio signal representation on the basis of a set of decoded spectral values associated with the given audio frame and provided by the decoding and in dependence on the time warp information;

wherein the determination of the context state is adapted to a change of a fundamental frequency between subsequent audio frames; and wherein the method is performed using a hardware apparatus, or using a computer, or using a combination of a hardware apparatus and a computer.

16. A non-transitory computer-readable medium having stored thereon a computer program for performing the method according to claim 15 when the computer program runs on a computer.

17. A method, comprising:

receiving an input audio signal and a time warp information;

providing a frequency-domain representation representing a time-warped version of the received input audio signal, time-warped in accordance with the received time warp information;

providing a codeword describing one or more spectral values of the provided frequency-domain representation, or at least a portion of a number representation of one or more spectral values of the provided frequency-domain representation, in dependence on a context state, to acquire encoded spectral values of the encoded spectrum representation; and determining a current context state in dependence on one or more previously-encoded spectral values, wherein the determination of the context state is adapted to a change of a fundamental frequency between subsequent audio frames; and outputting an encoded representation of the received input audio signal, including the encoded spectrum representation and the encoded time warp information;

wherein the method is performed using a hardware apparatus, or using a computer, or using a combination of a hardware apparatus and a computer.

18. A non-transitory computer-readable medium having stored thereon a computer program for performing the method according to claim 17 when the computer program runs on a computer.

19. An audio signal decoder, comprising:

a mechanism for receiving an encoded audio signal representation including an encoded spectrum representation, and an encoded time warp information, wherein the encoded spectrum representation includes a codeword describing one or more spectral values or at least a portion of a number representation of one or more spectral values in dependence on a context state;

a context-based spectral value decoder configured to decode the codeword, to acquire decoded spectral values;

a context state determinator linked to the context-based spectral value decoder, wherein the context state determinator is configured to determine a current context state in dependence on one or more previously decoded spectral values of the received encoded audio signal representation; and a time warping frequency-domain-to-time-domain converter linked to the context-based spectral value decoder, wherein the time warping frequency-domain-to-time-domain converter is configured to output an output signal that comprises a time-warped time-domain representation of a given audio frame of the received encoded audio signal representation on the basis of a set of decoded spectral values associated with the given audio frame and provided by the context-based spectral value decoder and in dependence on the time warp information;

wherein the context-state determinator is configured to adapt the determination of the context state to a change of a fundamental frequency between subsequent audio frames; and wherein the audio signal decoder is implemented using a hardware apparatus, or using a computer, or using a combination of a hardware apparatus and a computer.

20. An audio signal encoder, comprising:

a frequency-domain representation provider configured to receive an input audio signal and a time warp information, and to provide a frequency-domain representation representing a time-warped version of the received input audio signal, time-warped in accordance with the received time warp information;

a context-based spectral value encoder connected to the frequency-domain representation provider and configured to provide a codeword describing one or more spectral values of the frequency-domain representation provided by the frequency-domain representation provider, or at least a portion of a number representation of one or more spectral values of the frequency-domain representation provided by the frequency-domain representation provider, in dependence on a context state, to acquire encoded spectral values of the encoded spectrum representation, and output the encoded spectrum representation; and a context state determinator configured to determine a current context state in dependence on one or more previously-encoded spectral values, wherein the context state determinator is configured to adapt the determination of the context state to a change of a fundamental frequency between subsequent audio frames; and wherein the audio signal encoder is implemented using a hardware apparatus, or using a computer, or using a combination of a hardware apparatus and a computer.

* * * * *